US007270132B2

(12) United States Patent
Inui et al.

(10) Patent No.: US 7,270,132 B2
(45) Date of Patent: Sep. 18, 2007

(54) WASHER

(75) Inventors: Hiroaki Inui, Osaka (JP); Makoto Oyama, Osaka (JP); Masaki Yura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 504 days.

(21) Appl. No.: 10/203,746

(22) PCT Filed: Feb. 9, 2001

(86) PCT No.: PCT/JO01/00922

§ 371 (c)(1),
(2), (4) Date: Nov. 22, 2002

(87) PCT Pub. No.: WO01/58335

PCT Pub. Date: Aug. 16, 2001

(65) Prior Publication Data

US 2003/0168087 A1 Sep. 11, 2003

(30) Foreign Application Priority Data

| | | |
|---|---|---|
| Feb. 14, 2000 | (JP) | 2000-034717 |
| Mar. 10, 2000 | (JP) | 2000-066492 |
| Aug. 29, 2000 | (JP) | 2000-258648 |
| Jan. 19, 2001 | (JP) | 2001-011242 |
| Jan. 26, 2001 | (JP) | 2001-018147 |

(51) Int. Cl.
*B06B 3/02* (2006.01)

(52) U.S. Cl. ..... 134/56 D; 134/95.3; 134/186

(58) Field of Classification Search ..... 134/199, 134/56 R, 198; 137/625.15, 625.16, 625.18, 137/625.19, 625, 625.21, 625.22, 625.31, 137/625.32, 625.46, 625.47
See application file for complete search history.

(56) References Cited

U.S. PATENT DOCUMENTS

| | | | | |
|---|---|---|---|---|
| 1,645,227 | A * | 10/1927 | Cease | 134/176 |
| 1,889,858 | A * | 12/1932 | Greene et al. | 239/66 |
| 2,012,178 | A * | 8/1935 | Anderson | 239/66 |
| 2,596,693 | A * | 5/1952 | Karlstrom | 134/112 |
| 2,597,359 | A * | 5/1952 | McDonald et al. | 134/57 D |
| 2,628,628 | A * | 2/1953 | Hertz | 134/146 |
| 2,669,240 | A * | 2/1954 | Thorson | 134/95.3 |
| 2,675,830 | A * | 4/1954 | Vuillemin | 137/625.21 |
| 2,891,563 | A * | 6/1959 | Smith | 137/1 |
| 2,960,990 | A * | 11/1960 | Jones et al. | 134/95.3 |
| 2,992,779 | A * | 7/1961 | James et al. | 239/226 |

(Continued)

FOREIGN PATENT DOCUMENTS

DE 38 16 408 * 11/1989

(Continued)

*Primary Examiner*—Frankie L. Stinson
(74) *Attorney, Agent, or Firm*—Wenderoth, Lind & Ponack, L.L.P.

(57) ABSTRACT

A washer includes a plurality of washing devices for spraying washing water to an object to be washed from various directions of a washing tub, and a washing water feeding device for feeding the washing water. The washing water is sequentially sprayed from respective washing devices. Thus, the washing water can be sprayed to eating utensils from the various directions without increasing fed water, and a washing effect is improved. Speedy washing, energy saving, and water saving can be also achieved.

44 Claims, 43 Drawing Sheets

U.S. PATENT DOCUMENTS

| | | | | | |
|---|---|---|---|---|---|
| 3,026,628 | A | * | 3/1962 | Berger, Sr. et al. | 34/231 |
| 3,060,946 | A | * | 10/1962 | Lantz | 134/112 |
| 3,111,131 | A | * | 11/1963 | Nekola et al. | 134/129 |
| 3,449,772 | A | * | 6/1969 | Werner | 4/490 |
| 3,570,536 | A | * | 3/1971 | Walker et al. | 137/625.11 |
| 3,648,931 | A | | 3/1972 | Jacobs | |
| 3,658,092 | A | * | 4/1972 | Walker et al. | 137/625.21 |
| 3,708,120 | A | * | 1/1973 | Camprubi et al. | 239/66 |
| 3,769,992 | A | * | 11/1973 | Wallestad | 134/144 |
| 3,773,059 | A | * | 11/1973 | Arneson | 134/123 |
| 3,941,537 | A | * | 3/1976 | Abraham | 425/228 |
| 4,212,088 | A | * | 7/1980 | Goettl et al. | 4/490 |
| 4,294,271 | A | * | 10/1981 | Intrater et al. | 134/113 |
| 4,802,508 | A | * | 2/1989 | Styles et al. | 137/624.13 |
| 4,958,660 | A | * | 9/1990 | Eke et al. | 137/625.23 |
| 5,046,522 | A | * | 9/1991 | Le Devehat et al. | 137/385 |
| 5,104,068 | A | * | 4/1992 | Krilla et al. | 244/134 R |
| 5,366,618 | A | * | 11/1994 | Foster | 210/138 |
| 5,524,822 | A | * | 6/1996 | Simmons | 239/17 |
| 5,551,165 | A | * | 9/1996 | Turner et al. | 34/404 |
| 5,613,511 | A | * | 3/1997 | Andersen et al. | 134/167 R |
| 5,704,380 | A | * | 1/1998 | Zelniker et al. | 134/95.3 |
| 5,725,002 | A | * | 3/1998 | Payzant | 134/95.3 |
| 5,924,432 | A | * | 7/1999 | Thies et al. | 134/56 D |
| 6,196,266 | B1 | * | 3/2001 | Breda | 137/625.11 |

FOREIGN PATENT DOCUMENTS

| | | | | |
|---|---|---|---|---|
| DE | 39 04 359 | A1 | | 8/1990 |
| DE | 24 28 991 | | * | 1/1996 |
| DE | 198 57 103 | A1 | | 6/2000 |
| EP | 0 585 905 | A2 | | 3/1994 |
| EP | 0 607 105 | A1 | | 7/1994 |
| EP | 0 786 230 | A2 | | 7/1997 |
| JP | 4-33633 | | | 2/1992 |
| JP | 4-164425 | | | 6/1992 |
| JP | 7-75617 | | | 3/1995 |
| JP | 7-19412 | | | 5/1995 |
| JP | 8-56885 | | * | 3/1996 |
| JP | 9-248270 | | | 9/1997 |
| JP | 11-4797 | | | 1/1999 |
| JP | 11-19019 | | | 1/1999 |

* cited by examiner (When discharge port is formed in cylindrical surface)

(When discharge port is formed in plane surface)

WASHER

FIELD OF THE INVENTION

The present invention relates to a washer for household use or business use, and more particularly to a washer for washing by spraying washing water.

BACKGROUND OF THE INVENTION

A conventional dishwasher for washing eating utensils is described with reference to FIG. 43. The conventional dishwasher comprises body 1, washing tub 2, cover 3, exhaust port 4, rack 5, washing pump 8, washing nozzle 9, drain pump 10, controller 11, feed water hose 12, drain hose 13, heater 14, fan 15, and water level detecting device 20. Cover 3 is used for opening or closing an opening of the washing tub, and has exhaust port 4. Rack 5 accommodates eating utensils. Washing pump 8 pressurizes washing water. Washing nozzle 9 is disposed in a lower part of washing tub 2. Drain pump 10 discharges, from the dishwasher, washing water reserved in the washing tub. Controller 11 controls operations of washing pump 8 and drain pump 10. Heater 14 is disposed on a bottom of washing tub 2, and heats washing water, and heats air during drying. Fan 15 is used for drying. Rack 5 is supported via rollers 6 by a rail surface 7 formed on a side surface of washing tub 2. Washing nozzle 9 sprays the washing water pressurized by washing pump 8, from below to the eating utensils held by rack 5. Water level detecting device 20 detects a washing water level.

For washing eating utensils, the eating utensils to be washed are held in rack 5 of washing tub 2, a detergent is thrown in, and an operation is started. After the start of the operation, firstly a feed water process of supplying a predetermined amount of washing water to washing tub 2 is performed so as to stabilize a pressurizing operation of the washing water by washing pump 8. Washing pump 8 has centrifugal blades (not shown) and an electric motor (not shown) for driving the blades. Approximately a predetermined interval (it is hereinafter called washing water level) is maintained between intake port 16 of washing pump 8 and a washing water surface. Next, a primary washing process is performed. During the primary washing process, the washing water pressurized by washing pump 8 and heated by heater 14 is sprayed together with the detergent from spray port 17 of washing nozzle 9. The washing water is sprayed vertically, or obliquely and upwardly from spray port 17 of washing nozzle 9. Washing nozzle 9 is rotated substantially horizontally by reaction force of the spray. Collision force of the washing water sprayed from the rotating washing nozzle 9, the detergent, and heat are used for washing the eating utensils.

After the primary washing process is performed for a predetermined period, a draining process is performed. During the draining process, the washing water containing dirt removed from the eating utensils is discharged from the dishwasher by drain pump 10. Subsequently, a feed water process of supplying new washing water, a rinsing process of spraying the washing water from washing nozzle 9 to rinse the eating utensils soiled with the detergent or garbage (dirt attached to the eating utensils), and the draining process are sequentially repeated four times. These processes constitute a washing procedure.

After the washing procedure, a drying process is performed. During the drying process, fan 15 feeds air into washing tub 2 from outside of the dishwasher. The air is fed from blast duct 18 into washing tub 2 through blast port 19, and simultaneously heater 14 is intermittently operated, thereby generating warm air. This warm air vaporizes water drops attached to the eating utensils to dry the eating utensils. During the drying process, highly humid air in washing tub 2 is exhausted from the dishwasher through exhaust port 4.

However, the washing nozzle of the conventional dishwasher sprays the washing water to various shapes of eating utensils used in a typical home only from a constant direction. Sufficient washing performance therefore cannot be obtained. When the washing water is not sprayed from an upper part of the washing tub during washing of an eating utensil such as a teacup or a soup bowl having a rim at its bottom, small garbage is apt to accumulate on the rim and water for rinsing does not disperse sufficiently. Therefore, rinsing is insufficient. For addressing these problems, a method of spraying washing water from various directions using a plurality of washing nozzles is proposed in Japanese Patent Application Non-examined Publication No. H5-305050. In this method, water to be reserved in a washing tub must be increased, relative to that associated with the conventional dish washer, for spraying water from the plurality of nozzles at the same time.

The increase of the fed water results in a longer time being required to raise temperature of the washing water. This method therefore requires a longer operation time, more electricity, more usage of water, and a large washing pump. This causes various problems such as increase of cost and increase of noise or vibration due to the spray of much washing water at the same time.

Japanese Patent Application Non-examined Publication No. H5-176875 proposes a method for addressing these problems using a plurality of washing pumps. In this method, however, a plurality of washing pumps must be disposed for respective washing nozzles, and therefore volume ratio of a washing mechanism to an entire dishwasher increases. A space required for washing eating utensils cannot be sufficiently prepared, or size of the dishwasher body increases more than necessary. Japanese Patent Application Non-examined Publication No. H5-176875 has these problems.

Additionally, Japanese Patent Application Non-examined Publication No. H6-30853 discloses a washer having a structure in which a three-way valve is heavily used for water division. However, when this washer is used as a dishwasher that treats washing water containing garbage or foreign matter, operational reliability of the valve cannot be ensured. As a number of diversion channels increases, a number of three-way valves increases. The washer cannot deal with a complex discharge behavior of washing water of each washing nozzle, a specific abnormal sound occurs during a valving operation, and cost increases. Japanese Patent Application Non-examined Publication No. H6-30853 has these problems.

As other examples of a washer spraying washing water, there are a component washer for removing grease or chips from a component machined by a machine tool or the like, and a vegetable washer for removing foreign matter or chemicals attached to vegetables. However, these washers have the problems discussed above.

DISCLOSURE OF THE INVENTION

A washer of the present invention comprises the following elements:

a plurality of washing devices for spraying washing water to an object to be washed from various directions;

a washing water feeding device for feeding the washing water to the washing devices; and a controller for controlling an operation of the washing water feeding device.

Each of the plurality of washing devices has a spray port, and the spray port sprays the washing water. The washing water is sequentially supplied to respective washing devices.

The washer, because of this structure, can spray the washing water to eating utensils without increasing a water amount, and can improve a washing effect. The washer can also wash the eating utensils quickly, and save energy and water.

The washer preferably further comprises a water dividing structure disposed between the washing water feeding device and the plurality of washing devices. The water dividing structure includes a rotary water dividing unit having a discharge port and a divided water output unit having a plurality of divided water discharge ports. Each washing device communicates with each divided water discharge port. The divided water output unit is disposed in the rotary water dividing unit so that the discharge port sequentially faces and communicates with the divided water discharge ports when the rotary water dividing unit rotates. The washing water fed from the washing water feeding device is discharged from the discharge port of the rotary water dividing unit, sequentially fed to each divided water discharge port, guided to each washing device, and sprayed from each washing device.

This structure further improves a washing effect.

DETAILED DESCRIPTION OF THE PREFERRED EMBODIMENTS

Figure 1:
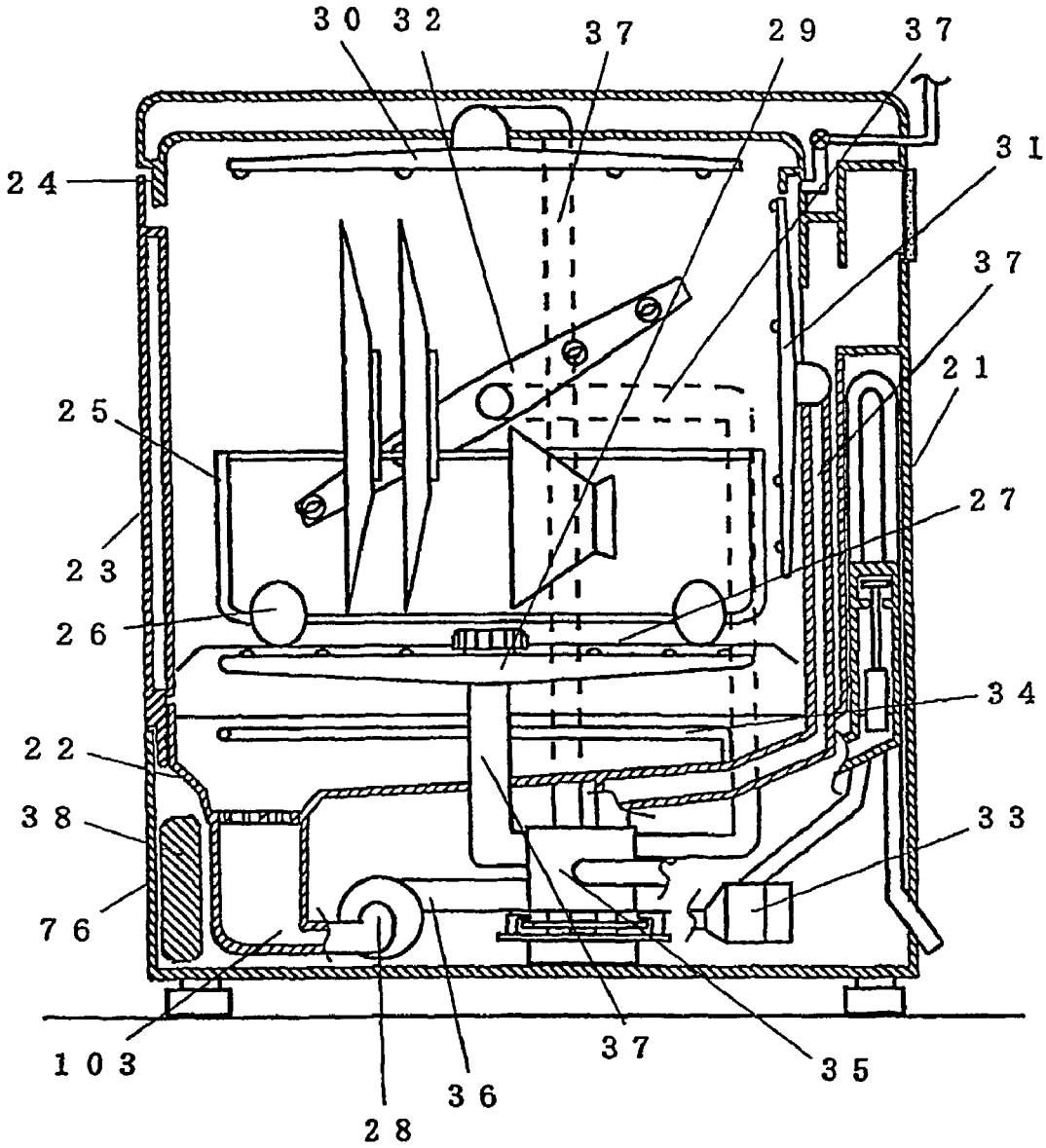
FIG. 1 is a sectional view of a dishwasher in accordance with exemplary embodiment 1 of the present invention.

A washer in accordance with an exemplary embodiment of the present invention comprises a plurality of washing devices and a washing water feeding devices. Each of the plurality of washing devices has a spray port. Washing water is sprayed to objects to be washed through spray ports from various directions. The washing water is sequentially fed to the plurality of washing devices.

This structure allows reduction of washing time, consumed energy, and consumed water. Energy and water can thus be saved.

A washer in accordance with another exemplary embodiment of the present invention comprises a rack for accommodating objects to be washed such as eating utensils, a washing tub for holding the rack, a cover for opening or closing an opening in the washing tub, a plurality of washing devices having a spray port for spraying washing water to the objects to be washed from various directions, a washing water feeding device for pressurizing the washing water, a controlling device for controlling the washing water feeding device or the like, and a water dividing structure. The water dividing structure, which includes a driving device, is disposed in a passage for feeding/discharging the water (hereinafter called feeding/discharging passage) for connecting the washing water feeding device with the washing devices. The washing water is sequentially fed to the plurality of washing devices.

This structure allows spray of washing water to any object to be washed from a plurality of directions without increasing fed water. High efficient washing for allowing speedy washing can thus be realized, and a number of rinsings is decreased. Consumed energy and also consumed water are therefore reduced. Specifically, when the washer washes eating utensils, the eating utensils can be arbitrarily set into the rack and thus a setting position and a setting method can be freely set, in addition to production of the advantages discussed above. As a result, setting ability is further improved.

The washer of this exemplary embodiment preferably has the following construction.

The water dividing structure comprises an aqueduct, a discharge port, a rotary water dividing unit, and a divided water output unit. The aqueduct guides the washing water pressurized by the washing water feeding device. The discharge port is disposed in any surface of a substantial cylinder, and discharges the washing water guided by the aqueduct. The rotary water dividing unit is rotated by a driving device as a driving source. The divided water output unit has a plurality of feeding/discharging passages, covers the rotary water dividing unit, and sequentially feeds the washing water to the washing devices. In this construction, one movable component is employed for the plurality of feeding/discharging passages, and thus changeover between channels is allowed. As a result, a simple and reliable water dividing structure can be realized.

A plurality of discharge ports are formed in the rotary water dividing unit, and the washing water is supplied to the plurality of washing devices. This increases washing water sprayed to the objects to be washed per unit time, and improves washing performance in a short time.

The driving device is structured so as to set an arbitrary rotational speed. This allows the amount of washing water sprayed from each washing device to vary in response to quantity and quality of dirt adhered to eating utensils or the like. As a result, washing time is optimized to improve washing performance, washing time is reduced, or energy is saved.

The driving device preferably includes a rotational angle detecting device for detecting a rotational angle. The washing water can therefore be fed to a specific feeding/discharging passage at any time, and washing energy corresponding to the degree of dirt of on the objects to be washed can be applied.

The driving device is preferably structured so as to forwardly and reversely rotate. When the washing water is sprayed between specific washing devices, the washing water does not need to be fed to a washing device other than a washing device contributing to washing. As a result, efficient washing is allowed.

The discharge ports formed in the rotary water dividing unit are disposed at respective positions where rotational tracks of the discharge ports are not identical. The rotary water dividing unit can be made compact, and its rotating radius can be made small. The feeding/discharging passage is easily assigned to each washing device. A construction where the feeding/discharging passage is not bent is allowed, so that pressure loss in the feeding/discharging passage can be reduced. Therefore, discharge force of the washing devices is increased to improve washing performance, or the washing water feeding device is downsized to downsize a mechanism unit.

At least one of the plurality of divided water discharge ports is preferably disposed in a surface substantially vertical to a rotating shaft of the rotary water dividing unit. Thanks to this divided water discharge port, washing water guided by the aqueduct has low channel resistance and is fed directly to the washing devices. Therefore, the discharge force of the washing devices is increased to improve washing performance, or the washing water feeding device is downsized to further downsize the mechanism unit. Reaction force of the spray of the rotary water dividing unit applied to a driving shaft of the driving device can also be reduced, so that a mounting structure of the driving device becomes simple.

The rotary water dividing unit is preferably disposed substantially horizontally. The rotary water dividing unit for dividing water to the plurality of washing devices is structured so as to have a short radius and be long in the longitudinal direction. An optimum length of the feeding/discharging passage can be set for each washing device disposed at a different position in a washing tub. Installing ability of the water dividing structure itself onto the lower part of the washing tub can be further improved. A water dividing structure having the feeding/discharging passage of which a number of bendings is smaller can be formed, so that passage pressure loss in the water dividing device can be reduced.

The driving shaft of the driving device is preferably disposed in the substantially same direction as a flow direction of washing water discharged from the washing water feeding device. The driving device is disposed on the opposite side of the discharge port of the washing water feeding device with respect to the rotary water dividing unit. The driving device can thus be disposed between the discharge port of the washing water feeding device and the aqueduct. Therefore, pressure loss in the channel decreases, and a structure between the driving shaft of the driving device and a rotating shaft of the aqueduct is simplified. A seal disposed between the driving shaft and the driving source can be formed as a simple structure, so that undesired increase in cost can be prevented.

The divided water discharge port is preferably disposed at a position higher than the discharge port of the washing water feeding device. Air in the washing water feeding device is thus prevented from remaining in the water dividing structure during water feeding, and the air flows into the washing tub through the washing devices. This prevents air from remaining in a casing of the washing water feeding device, and thus entrainment of the air into the washing water. As a result, a problem in that the entrainment disturbs the start of a washing pump is prevented, and washing failure is prevented to secure a stable washing performance.

Any surface of the rotary water dividing unit having the discharge port is preferably conical or curved. A difference between an entering angle and an exiting angle of washing water flow from the rotary water dividing unit to the divided water discharge port can therefore be reduced. Passage pressure loss between the rotary water dividing unit and the divided water discharge port can also be reduced.

The changeover unit disposed in the water dividing structure preferably has a structure in which an opening area of at least one first divided water discharge port and a passage cross sectional area of a first feeding/discharging passage communicating with the first divided water discharge port are larger than an opening area of the discharge port. This can reduce pressure loss of washing water flowing through the changeover unit. High washing and discharge force can therefore be obtained without using an oversized washing water feeding device.

The first divided water discharge port preferably has a rectangular or substantially elliptical shape, and is circumferentially longer than that of the discharge port. The washing device communicating with the first divided water discharge port can discharge washing water for a longer time than that of the other washing devices. The discharge time of the washing devices can be changed without changing rotational speed of the driving source for driving the rotary water dividing unit. Therefore, sufficient washing water can be sprayed to eating utensils from which dirt is easily removed in an inexpensive manner. Washing time of eating utensils can be also reduced.

The first feeding/discharging passage preferably comprises the two following passages: a passage of which cross the sectional area changes from the cross sectional area of the first divided water discharge port to a cross sectional area of a second feeding/discharging passage; and a passage having a cross sectional area substantially equal to a cross sectional area of a second divided water discharge port. Because of this, circulated washing water does not increase even when the passages enlarge. Therefore, fed water is reduced to shorten a warming time, washing time can be reduced, and energy can be saved.

A circumferential length of the discharge port is preferably substantially equal to or longer than a circular arc length between adjacent divided water discharge ports. The discharge port thus surely partially matches with any feeding/discharging passage. Excessive pressure increase can be prevented in a passage from the washing water feeding device to the washing devices. Therefore, excessive load onto a connection part and a seal part in the washing passage is prevented from extremely reducing endurance reliability.

A circumferential length of the discharge port is preferably substantially equal to or longer than the sum of a circular arc length of any divided water discharge port and a circular arc length between adjacent divided water discharge ports. An amount of circulated washing water discharged from the washing water feeding device can thus always be kept constant. Therefore, a pressure variation of a connection part and a seal part in the feeding/discharging passage is prevented, and reduction of endurance reliability is prevented. Washing energy discharged individually from each washing device varies periodically, but washing energy discharged from the washing system as a whole is always constant. Therefore, constant washing energy can be applied to eating utensils to allow efficient washing of the eating utensils.

The changeover unit disposed in the water dividing structure preferably has a rotary water dividing unit including a plurality of discharge ports. All discharge ports can be prevented from simultaneously communicating with the divided water discharge ports during a changeover operation. Washing water discharged from the washing water feeding device is thus prevented from simultaneously being discharged from the plurality of washing devices. Therefore, a small amount of fed water can drive the washing water feeding device; that is a small motor having low power can be used. A mechanism unit can therefore be downsized. A body capable of washing more eating utensils is realized or the mechanism unit is downsized, thereby downsizing body volume. As a result, an installation area required for installing the washer is decreased, and installing ability is improved.

At least one of the plurality of discharge ports preferably has a rectangular or substantially elliptical shape, and is circumferentially longer than the other discharge ports. A small amount of fed water can thus drive the washing water feeding device, though the plurality of discharge ports have different opening areas. Spray time of the washing devices to the divided water discharge port is changed periodically in response to a longitudinal length of the rectangular shape, thereby preventing interference between the washing devices and thus preventing reduction of washing performance.

The plurality of discharge ports and divided water discharge ports are preferably arranged in the rotary water dividing unit and the divided water output unit, respectively, so that washing water is always discharged from any one of the washing devices during washing. When the rotary water dividing unit rotates, a part or the entirety of the opening of the discharge port certainly matches with the opening of the divided water discharge port, wherever the discharge ports lie. Therefore, any one of the washing devices can always spray the washing water to eating utensils or the like, and thus washing efficiency is further improved in a limited washing time.

At least one of the plurality of divided water discharge ports preferably has a rectangular or substantially elliptical shape, and is circumferentially longer than the other divided water discharge ports. The feeding/discharging passage, which communicates with this divided water discharge port has a cross sectional area larger than those of the other feeding/discharging passages. The washing device communicating with the divided water discharge port and the feeding/discharging passage having the larger cross sectional area, can therefore repeat the following discharges of washing water: discharge at a usual flow rate and a low pressure and for a long time; and discharge at a large flow rate and a low pressure and for a longer time. This spray of the washing water has a high removing effect of garbage or the like adhered to eating utensils, and washing from an upper part of the washing tub increases the effect. A variation of discharge pressure or discharge flow rate causes change of spray flow rate and spray angle of the washing devices. This allows wider and more efficient washing of the eating utensils or the like.

The divided water output unit preferably has a passage varying device for varying the cross sectional area of the divided water discharge port or the feeding/discharging passage. Flow rate and pressure of washing water flowing to the washing device communicating with the feeding/discharging passage having the passage varying device are arbitrarily switched. When there are fewer eating utensils, the passage varying device is fully closed to stop spray from a part of the washing device. This increases the spray time from the other washing devices, and exhibits high washing performance in shorter time. For washing extremely soiled eating utensils, high-pressure washing is effective. Narrowing the passage varying device thus allows spray of the washing water at high pressure, and therefore allows speedy washing. The washing method can thus be changed in response to quantity and quality of dirt adhered to the eating utensils or the like.

The controlling device preferably has an operating method of spraying washing water from any washing device. The washing water discharged from the washing water feeding device can be fed to any washing device by changeover of the discharging passage connected to each washing device. Washing is therefore performed without increasing fed water. The washing water is thus sprayed to eating utensils from a plurality of directions though flow rate is low, so that a high washing performance is obtained.

The water dividing structure preferably has a rotational position detecting device. The controlling device preferably controls an operating method so that washing water is sprayed from a substantially upper part or side part in the washing tub at the end of at least any rinsing process of a washing procedure. The washing water is thus sprayed from a substantially upper part at the end of the spraying process of the washing water, so that dirt such as garbage adhered to an object to be washed is prevented from remaining on the object, and the dirt is certainly washed out. Therefore, the dirt such as garbage and the washing water containing the dirt is speedily discharged out of the washer, and rinsing performance is improved.

The water dividing structure preferably has a structure for arbitrarily controlling a feeding time of washing water to each washing device. The controlling device preferably controls an operating method so that a spray time of each washing device is arbitrarily set for spray. The spray time of a washing device for mainly washing eating utensils accommodated in the rack can be arbitrarily set depending on hardness-to-remove of the dirt adhered to the eating utensils. Therefore, even when an extremely dirty object to be washed is included, the dirt remaining on the object is prevented and washing performance is improved.

The controlling device preferably controls an operating method so that a first spray time, i.e. a spray time of each washing device during a primary washing process, is longer than a second spray time, i.e. a spray time of each washing device during a rinsing process. Thus, the optimum spray of washing water is allowed during each process. For example, washing is focused on a local part during the primary washing process, and the washing water is speedily and widely sprayed during the rinsing process. High washing performance can therefore be realized.

The water dividing structure preferably has a structure for feeding washing water to only a specific washing device. The controlling device preferably controls an operating method so that the washing water is selectively sprayed to eating utensils held in a partial region in the rack. Thus, the washing devices can be selectively operated depending on a type or amount of objects to be washed. The objects to be washed can thus be concentratively and efficiently washed.

For accommodating a substantially equal amount of a substantially identical type of objects to be washed, a plurality of racks are preferably disposed in the washing tub. In other words, the rack structure is not one in which a single rack simply and entirely accommodates the objects type-by-type used by a maximum number of persons, but one in which each of a plurality of racks can accommodate a set of eating utensils used by respective one to three persons. Thus, when fewer persons have their meals than usual, or eating timings of a family are different from one member to another, eating utensils can be washed efficiently and speedily in response to a variation of the number of persons eating.

The controlling device preferably controls an operating method so that all washing devices sequentially spray washing water during the primary washing process or the rinsing process. In other words, while the washing is performed with the washing devices only partially operated, all washing devices are temporarily used to wash the entire inside of the washing tub. The inside of the washing tub can therefore be kept clean.

At least one of feeding/discharging passages preferably communicates with a functional device other than the washing devices. This requires no new washing passage, and allows washing water discharged from the washing water feeding device to be fed to the functional device. This feeding operation is performed by controlling washing flow rate, spray time, and its timing using the water dividing structure. Therefore, the functional device is inexpensive, and well-controlled washing water can be directly used. The feeding/discharging passage can be used as a driving source of a movable unit such as an open/close valve disposed in the functional device. A solenoid valve or other driving source is not required.

At least one of the feeding/discharging passages preferably communicates with a draining passage for draining washing water out of the washer. This allows elimination of a drain pump for draining the washing water in the washing tub. Therefore, volume of a washing mechanism unit can be reduced to reduce volume and cost of a product, or washing volume of the same product can be expanded.

The functional device preferably has a function of a foreign matter collecting device for collecting foreign matter contained in washing water. The foreign matter in the washing water can thus be certainly collected without newly forming a passage for collecting the foreign matter. The washing water used for a final rinsing process does not need to be passed among the foreign matter. The washer can therefore have high rinsing performance.

At least one of the washing devices preferably communicates with a washing device for rotating and spraying washing water. A plurality of washing devices can thus spray the washing water to objects to be washed from various directions. Therefore, high efficient washing performance can be obtained independently of shapes, setting positions, or a setting method of the objects to be washed.

The washing water feeding device is preferably vertically installed. The aqueduct of the water dividing structure can thus be installed at a level higher than the discharge port of the washing water feeding device and lower than the height of a lower part of the washing tub. The level of a mechanism unit (a washing pump, a drain pump, or a fan) formed in the lower part of the washing tub can thus be lowered.

A plurality of washing devices preferably jets air sequentially. Washing water containing dirt can thus be removed from objects to be washed during a draining operation in the rinsing process. Rinsing performance can therefore be improved. Drying air is efficiently jetted to the objects during a drying process. Drying performance can therefore be improved. The washing water is not sprayed simultaneously from the plurality of washing devices, but sprayed sequentially. A small blast device can be used.

The washing water feeding device preferably has a function as the blast device. Conventionally, when a blast device is newly installed in the washing passage, a mechanism for preventing washing water from intruding into the blast device is required. The washer of the present embodiment, however, does not require the mechanism. The washer is therefore simpler and inexpensive.

Exemplary embodiments of the present invention will be described hereinafter with reference to the accompanying drawings.

Exemplary Embodiment 1

Figure 2:
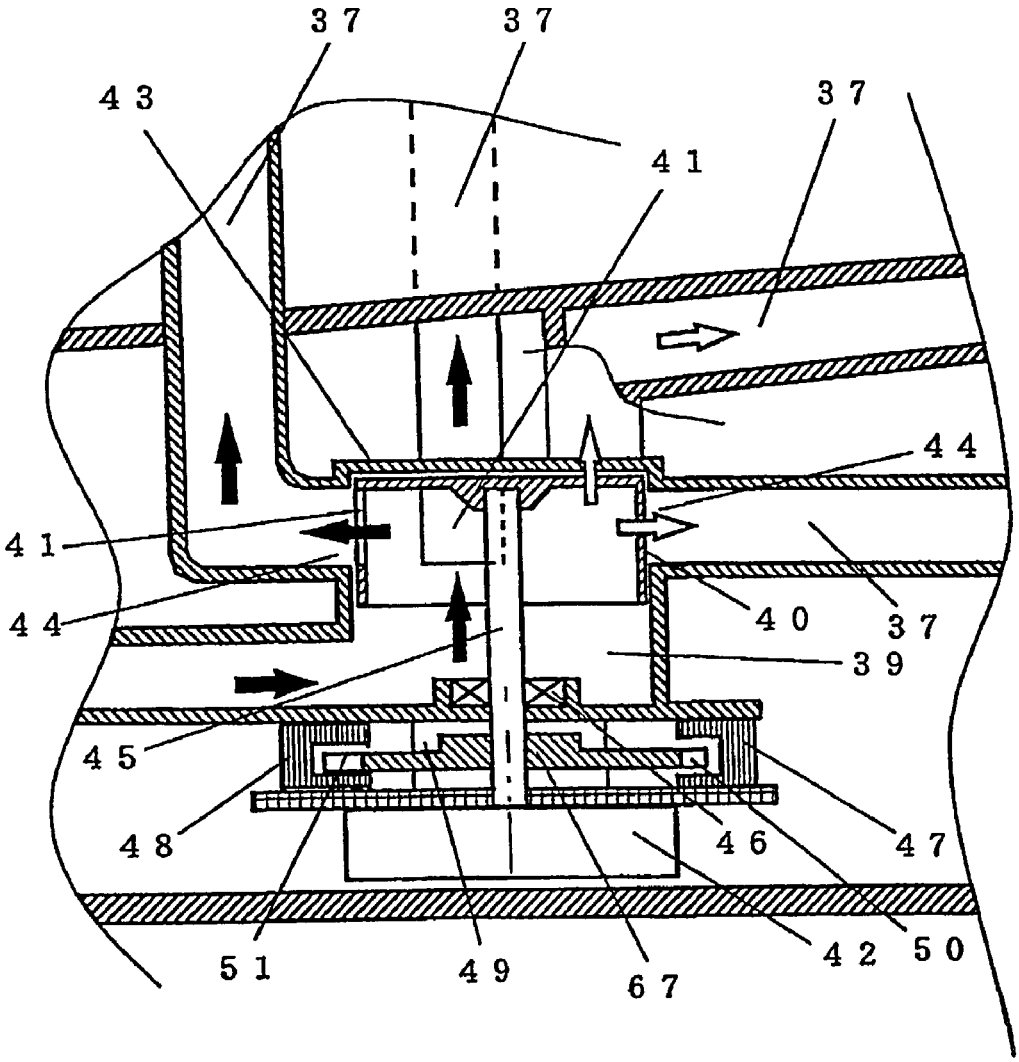
FIG. 2 is a fragmentary sectional view showing a water dividing structure and flow of washing water in the dishwasher in accordance with exemplary embodiment 1.
Figure 3:
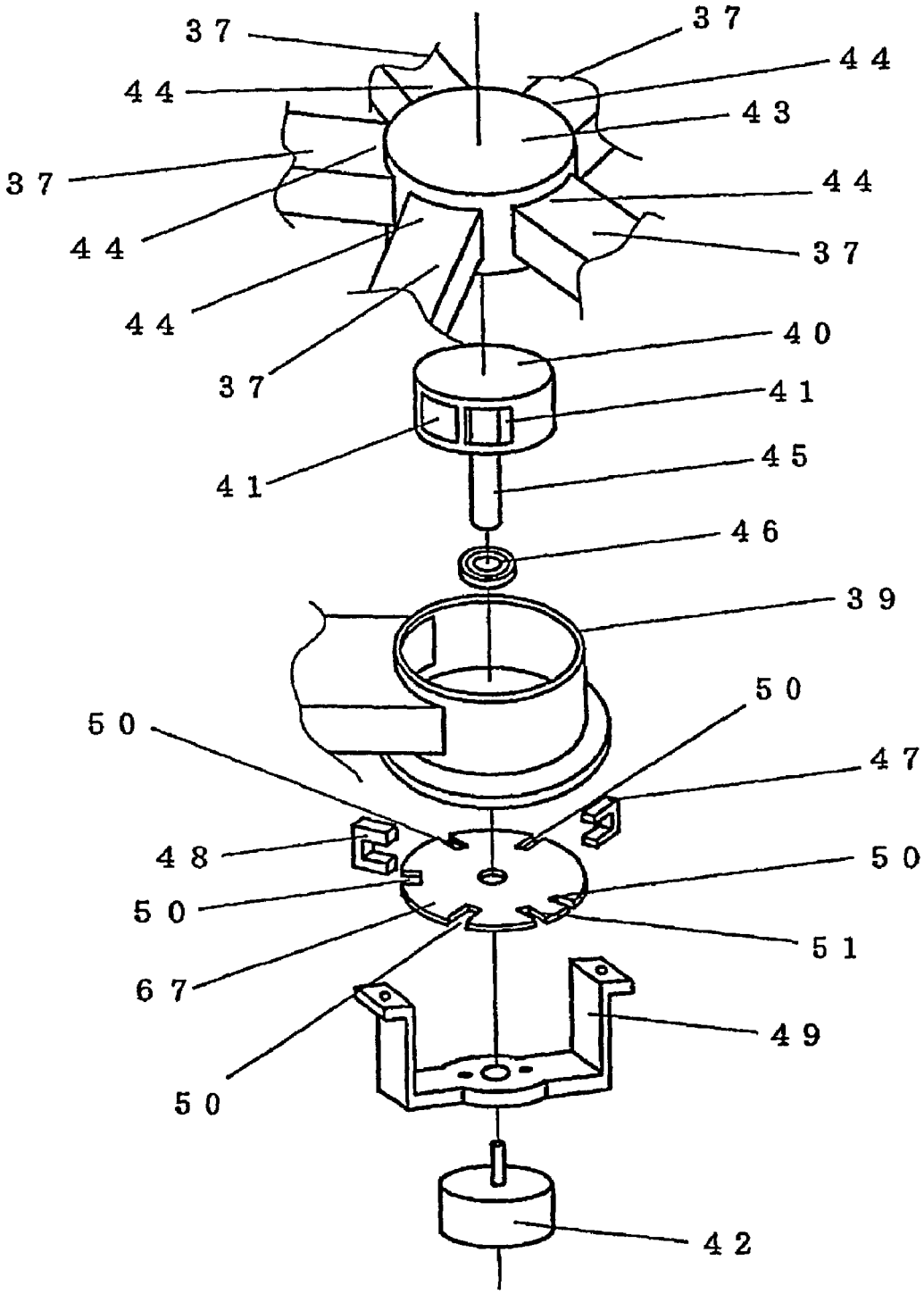
FIG. 3 is an exploded perspective view showing the water dividing structure of the dishwasher in accordance with exemplary embodiment 1.
Figure 4:
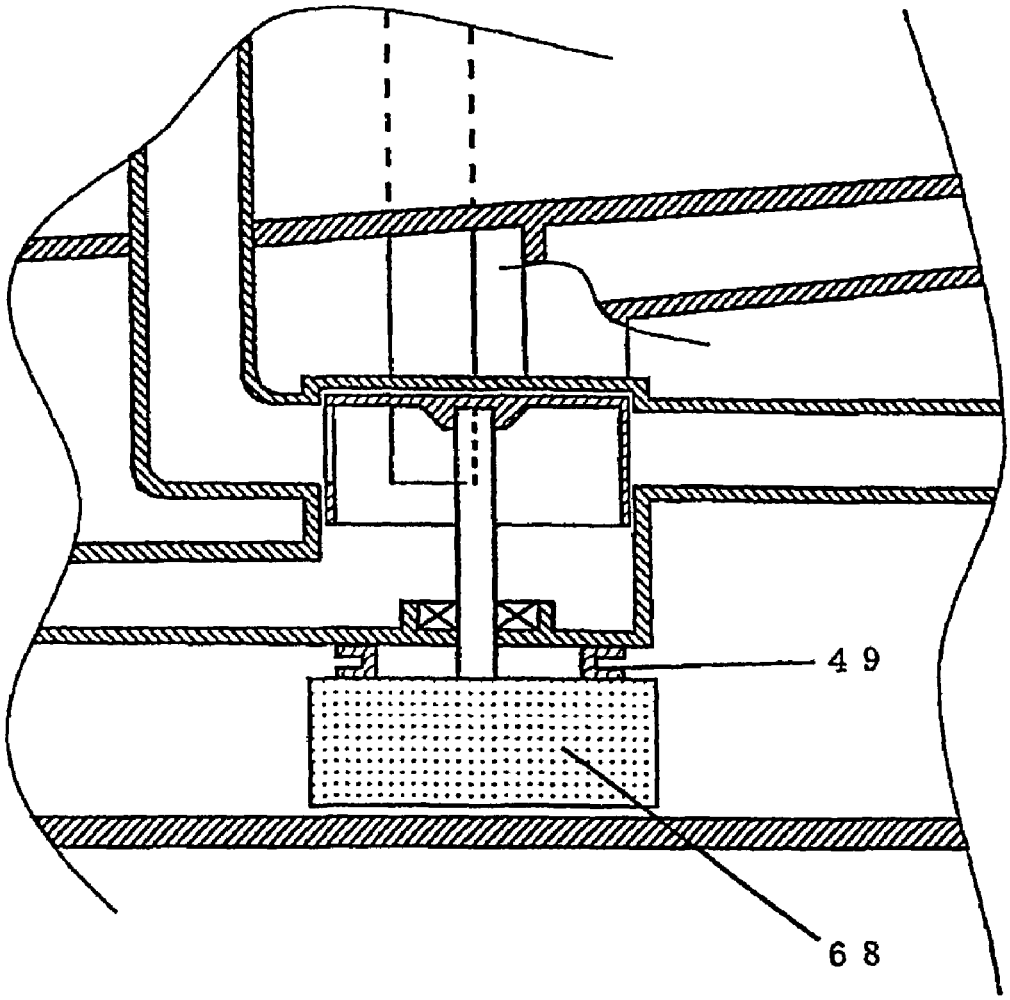
FIG. 4 is a fragmentary sectional view showing a driving device of another water dividing structure of the dishwasher in accordance with exemplary embodiment 1.
Figure 5:
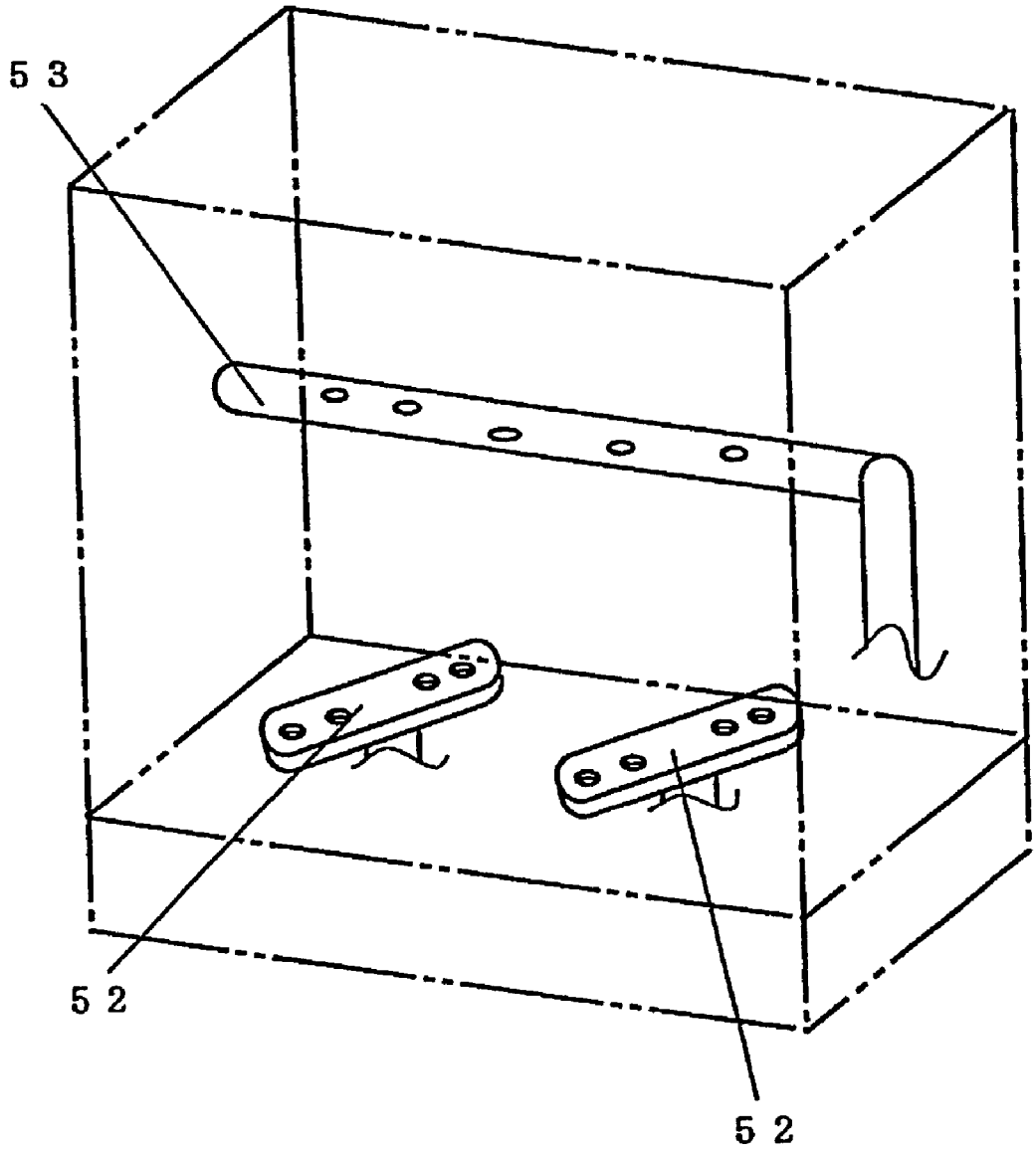
FIG. 5 is a perspective view of still another washing system of the dishwasher in accordance with exemplary embodiment 1.
Figure 6:
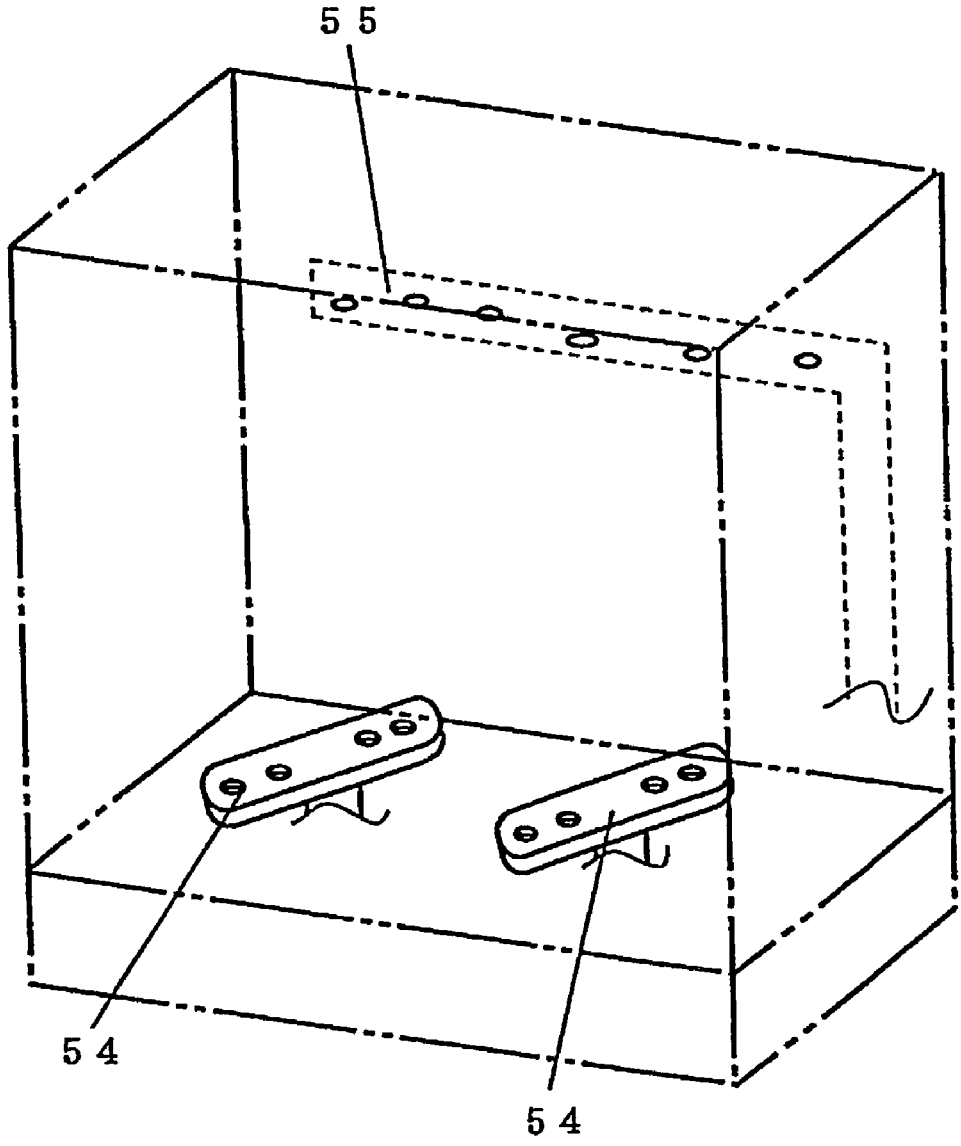
FIG. 6 is a perspective view of still another washing system of the dishwasher in accordance with exemplary embodiment 1.
Figure 7:
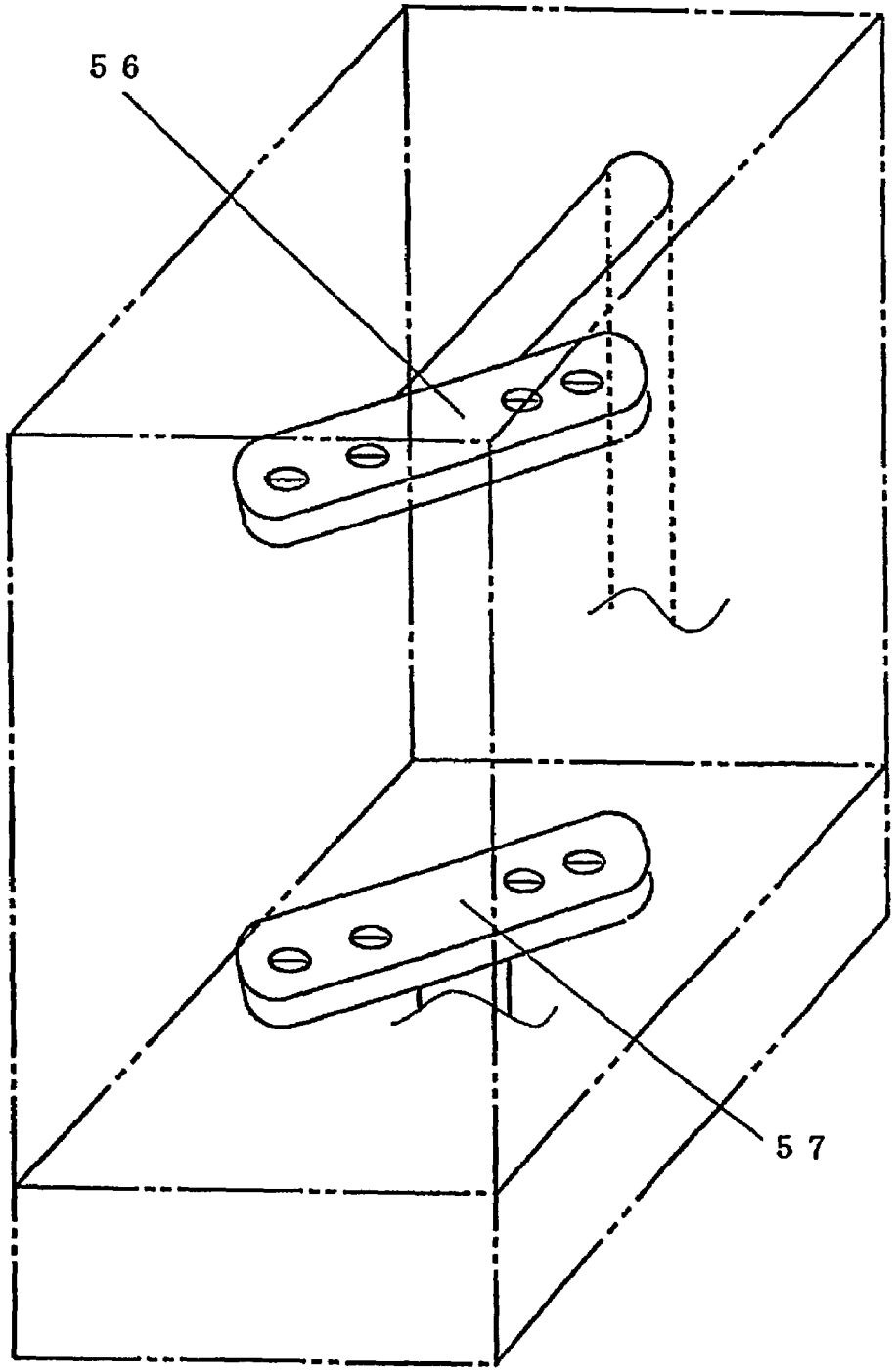
FIG. 7 is a perspective view of still another washing system of the dishwasher in accordance with exemplary embodiment 1.
Figure 8:
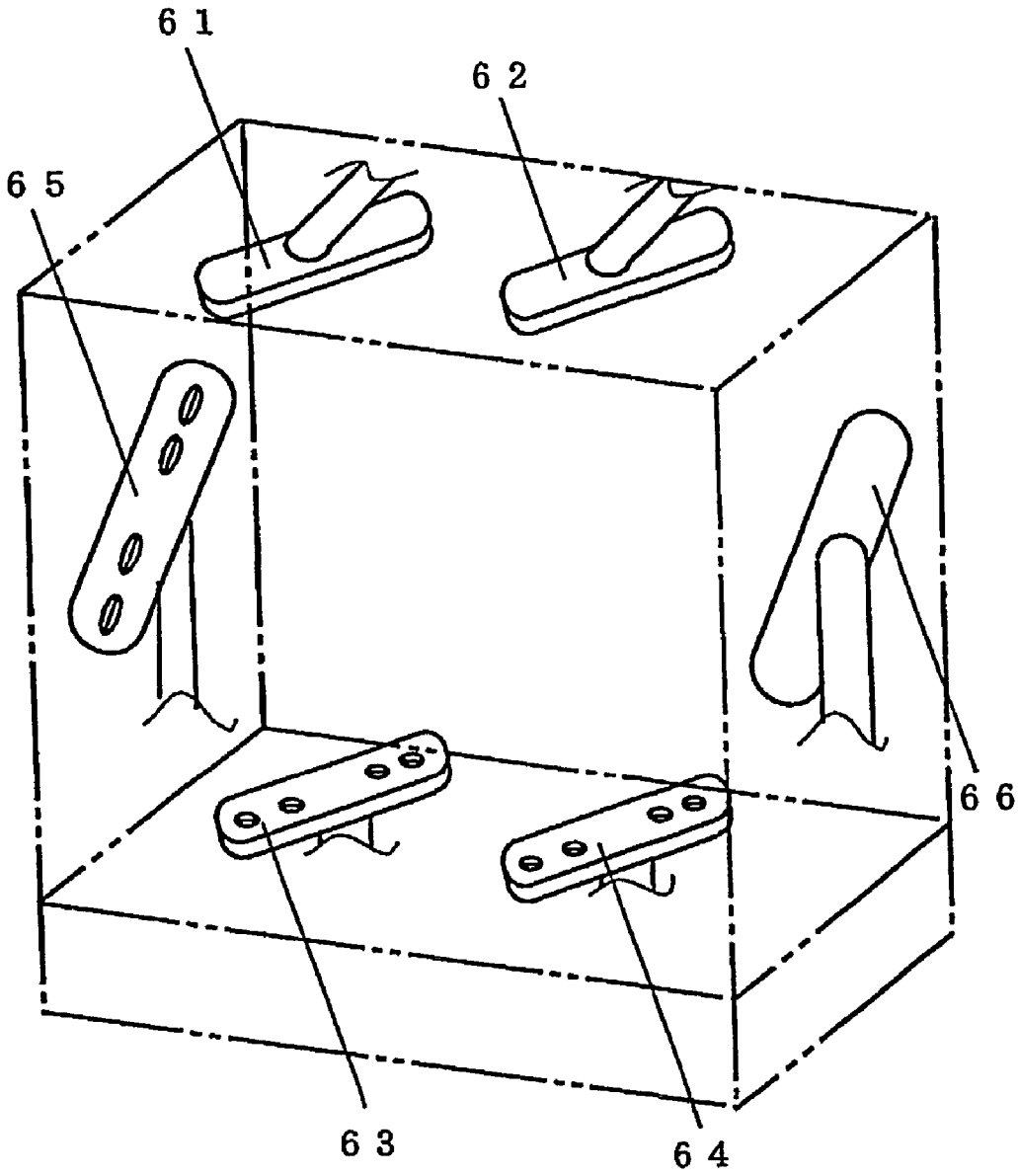
FIG. 8 is a perspective view of still another washing system of the dishwasher in accordance with exemplary embodiment 1.
Figure 9:
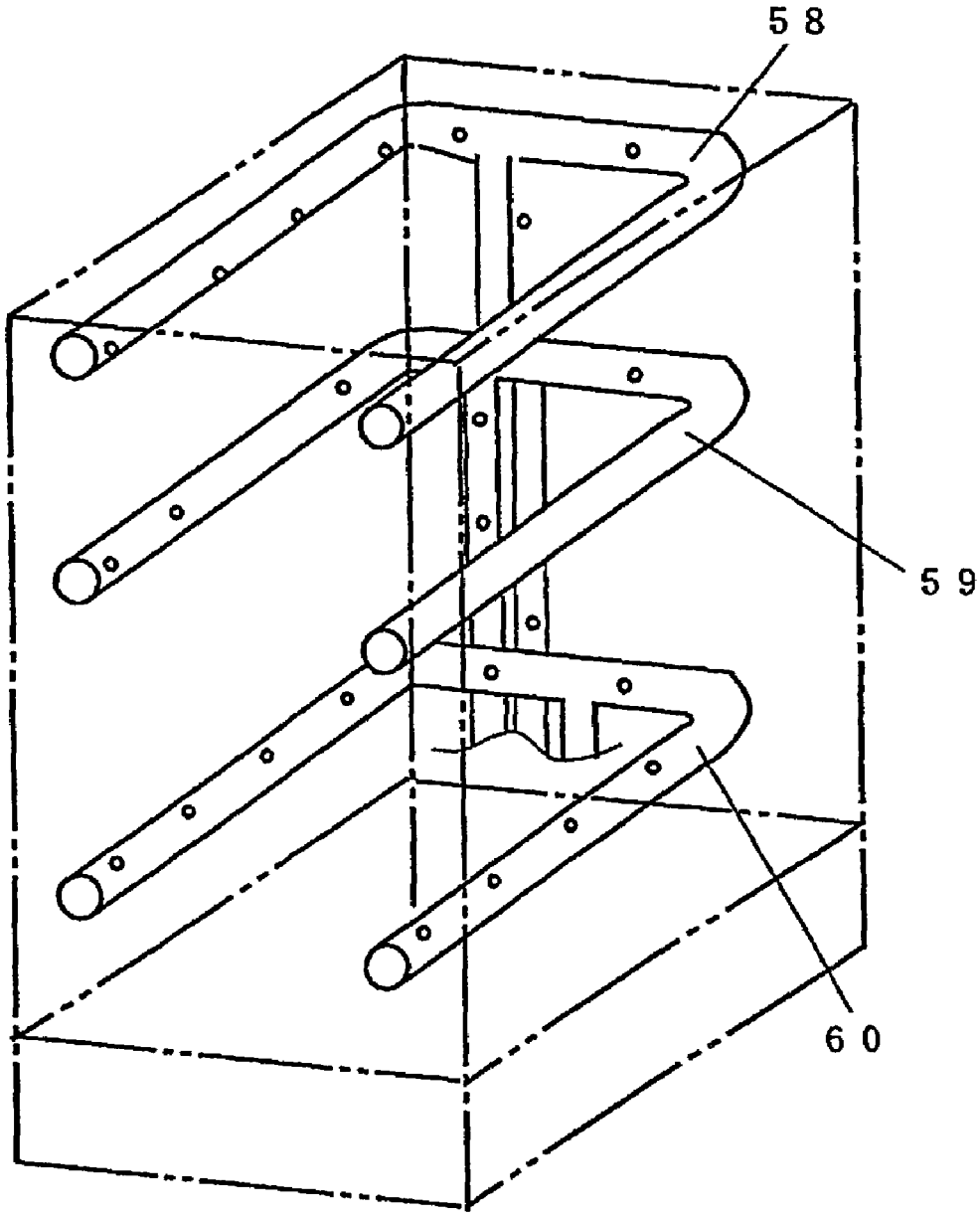
FIG. 9 is a perspective view of still another washing system of the dishwasher in accordance with exemplary embodiment 1.
Figure 10:
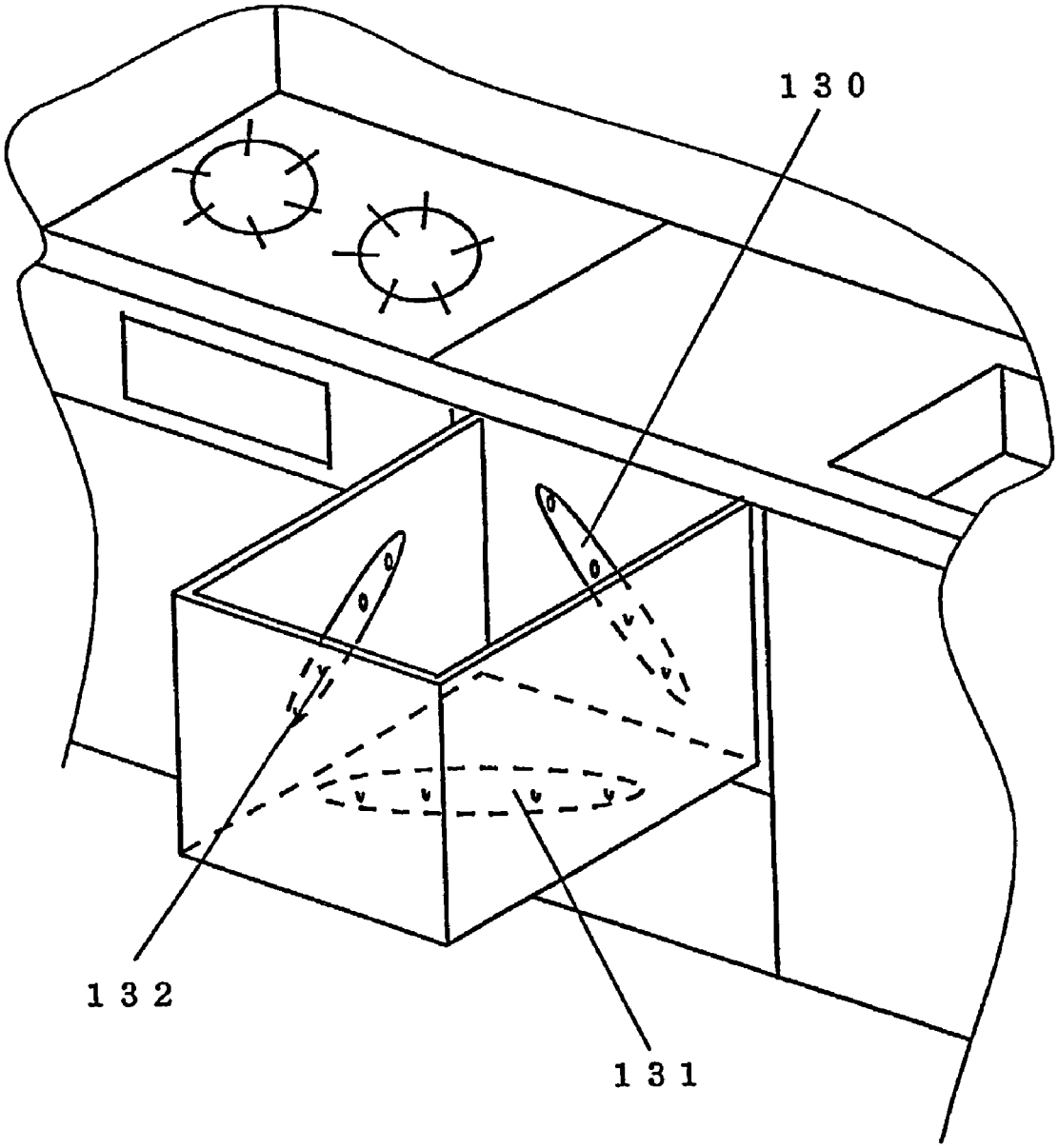
FIG. 10 is a perspective view of still another washing system of the dishwasher in accordance with exemplary embodiment 1.

FIG. 1 is a sectional view of a dishwasher in accordance with exemplary embodiment 1 of the present invention. FIG. 2 is a fragmentary sectional view showing a water dividing structure and flow of washing water in the dishwasher. FIG. 3 is an exploded perspective view showing a water dividing structure of the dishwasher. FIG. 4 is a fragmentary sectional view showing a driving device of another water dividing structure of the dishwasher. FIG. 5 is a perspective view of still another washing device of the dishwasher. FIG. 6 is a perspective view of still another washing device of the dishwasher. FIG. 7 is a perspective view of still another washing device of the dishwasher. FIG. 8 is a perspective view of still another washing device of the dishwasher. FIG. 9 is a perspective view of still another washing device of the dishwasher. FIG. 10 is a perspective view of still another washing device of the dishwasher.

In FIG. 1, the dishwasher comprises body 21, washing tub 22, cover 23, exhaust port 24, rack 25, roller 26, rail surface 27, washing pump (washing water feeding device) 28, washing nozzle (washing device) 29, spray port 17, washing nozzle 30, washing nozzle 31, washing nozzle 32, drain pump 33, heater 34, water dividing structure 35, and controller (controlling device) 38.

Cover 23 is used for opening or closing an opening in the washing tub. Exhaust port 24 is formed in cover 23. Rack 25 accommodates eating utensils, and roller 26 rotates. Rail surface 27 is disposed on a side face of washing tub 22. Washing pump (washing water feeding device) 28 pressurizes washing water. Washing nozzle (washing device) 29 is disposed in a lower part of washing tub 22. Washing nozzle (washing device) 30 is disposed in upper part of washing tub 22. Washing nozzle (washing device) 31 is disposed on a back face of washing tub 22. Washing nozzle (washing device) 32 is disposed on the left face of washing tub 22. Rack 25 is supported by rail surface 27 through rotating roller 26. Washing nozzle 29 sprays the washing water to the eating utensils through spray port 17 while turning.

The right face of washing tub 22 has a washing nozzle (not shown) that sprays the washing water while turning. A total of five washing nozzles are thus disposed. Washing nozzle 29, washing nozzle 30, washing nozzle 31, washing nozzle 32, and the washing nozzle (not shown) for the right face constitute a washing system. Drain pump 33 drains from the dishwasher, the washing water reserved in washing tub 22. Heater 34 heats the washing water, and heats air during drying. Heater 34 is disposed in the bottom part of washing tub 22. Water dividing structure 35 is disposed in feeding/discharging passage 37 for connecting discharge port 36 in the washing pump with each washing nozzle. Controller (controlling device) 38 controls washing pump 28, drain pump 33, and water dividing structure 35.

In FIG. 2 and FIG. 3, the dishwasher comprises aqueduct 39 for guiding the washing water pressurized by the washing pump, a rotary water dividing unit 40, driving motor (driving device) 42, divided water output unit 43, rotating shaft 45, oil seal 46, stationary position sensor 48, and frame 49.

Rotary water dividing unit 40 has two discharge ports 41 formed in a side face of a substantial cylinder, and discharge ports 41 discharge the washing water guided by aqueduct 39. Rotary water dividing unit 40 is rotated by driving motor (driving device) 42 as a driving source. Divided water output unit 43 involves rotary water dividing unit 40, and has divided water discharge ports 44 communicating with five feeding/discharging passages 37. Rotating shaft 45 connects a driving shaft (not shown) of driving motor 42 with rotary water dividing unit 40. Divided water output unit 43 has the oil seal 46 for watertightly sealing a gap between it and rotating shaft 45.

Aqueduct 39, rotary water dividing unit 40, driving motor 42, and divided water output unit 43 constitute a water dividing structure. Rotation detecting disk 67 having rotational angle detecting slit 50 and stationary position detecting slit 51 on a peripheral part is coaxially fixed to rotating shaft 45. Rotation detecting disk 67 detects a rotational angle of rotary water dividing unit 40 with rotational angle detecting sensor 47 fixed to aqueduct 39. Stationary position sensor 48 is used for positioning to match a hole position of a discharge port 41 to that of a divided water discharge port 44. Frame 49 supports the driving motor, and fixes driving motor 42 to aqueduct 39. For supporting driving motor 42, frame 49 may be structured integrally with aqueduct 39 in a positioned state. Driving motor 42, rotation detecting disk 67, rotational angle detecting sensor 47, stationary position sensor 48 for positioning, and controller 38 constitute a rotational angle detecting device.

Driving motor 42 described in the present exemplary embodiment has a direct current motor that is easily varied in rotational speed and rotational direction by controller 38. However, driving motor 42 is not limited to this, i.e. a geared motor including a change gear may be used in consideration of use at low rotational speed. An alternating current motor may be used depending on a control method or a motor size. In the present exemplary embodiment, as the rotation detecting device for detecting a stationary position and a rotational angle during rotation of rotary water dividing unit 40, a combination of an optical sensor using a light receiving/emitting element and rotation detecting disk 67 for passing or shielding light is used. However, the rotation detecting device is not limited to this, i.e. a stepping motor 68 capable of controlling change of rotational speed and switching of rotational direction as shown in FIG. 4, or a motor (not shown) including an encoder may be used. Such structure can produce a similar advantages.

Referring to FIG. 5, FIG. 6, FIG. 7, FIG. 8, FIG. 9, and FIG. 10, there are illustrated combinations of washing nozzles disposed at tips of the water dividing structure (not shown). In these drawings, washing water is sprayed sequentially to wash eating utensils and cooking utensils, namely objects to be washed. The washing nozzles are configured as, for example, the following combination: rotating nozzle 52 for spraying the washing water while turning and bar nozzle 53 (FIG. 5); rotating nozzle 54 and fixed nozzle 55 (FIG. 6); two upper and lower rotating nozzles 56, 57 (FIG. 7); two rotating nozzles 61, 62 disposed in the upper part of the washing tub, two rotating nozzles 63, 64 disposed in the lower part of the washing tub, and rotating nozzles 65, 66 disposed on left and right side faces, respectively, of the washing tub (FIG. 8); only a plurality of fixed nozzles 58, 59, 60 (FIG. 9); rotating nozzles 130, 131, 132 for spraying the washing water while rotating in a drawer type washer (FIG. 10); or a rotating nozzle and a tower nozzle (not shown). Thus, washing nozzles having different combinations can be used depending on conditions such as a size and a shape of the washing tub, or whether the washer has a single rack or a double-stack rack.

A basic operation of the dishwasher is similar to that of a conventional dishwasher, and therefore description of the operation is omitted.

Operations and functions of water dividing structure 35, namely a characteristic structure of the present embodiment, will be hereinafter described. Washing water pressurized by washing pump 28 flows through aqueduct 39, and discharges from discharge port 41 formed in rotary water dividing unit 40. At this time, rotary water dividing unit 40 is rotated by driving motor 42, so that the washing water discharging from discharge port 41, sequentially discharges from five divided water discharge ports 44, and flows to respective washing nozzles. The washing water is sequentially fed to washing nozzle 29 (lower face), washing nozzle for the right face (not shown), washing nozzle 32 (left side face), washing nozzle 31 (back face), and washing nozzle 30 (upper part). Thus, the washing water is not simultaneously fed to five washing nozzles, but sequentially fed to them. Therefore, the washing water can be sprayed to any object to be washed from a plurality of directions without increasing fed water.

Dirt adhered to eating utensils or the like can thus be washed out quickly, and high efficient washing can be realized. Detergent or dirt attached to the eating utensils can be rinsed quickly, so that a number of rinsings can be decreased. The number of rinsings can be decreased without increasing water for one feeding. Therefore, heating time of the washing water using the heater can be reduced, and energy and water can be saved.

A number of washing nozzles can be increased without increasing fed water, so that a washing method can be provided in which the washing water is sprayed to objects to be washed such as eating utensils from various directions. Therefore, when the user tries to set the objects into the rack, a user need not select setting positions and a setting method of placing the objects vertically or bottom upward. The user can freely set the objects to be washed. The dishwasher can have high setting ability. The dishwasher can have sufficient washing performance even for an eating utensil such as a square bowl, a deep and small bowl, or a square plate that cannot receive sufficient washing water because of spray from a single direction.

Water dividing structure 35 does not have a changeover valve or the like in feeding/discharging passage 37. Water dividing structure 35 has a mechanism for switching each feeding/discharging passage 37 between substantially cylindrical rotary water dividing unit 40 rotated by driving motor 42 and divided water output unit 43. Therefore, intrusion of a foreign matter into the washing water does not cause malfunction of a changeover valve, and thus the water dividing structure can be simple and have unit reliability.

Two discharge ports 41 are disposed for five divided water discharge ports 44. Vertical and horizontal dimensions of each divided water discharge port 44 are equal to those of each discharge port 41. The washing water can thus simultaneously be fed to two washing nozzles. Spray time during which each washing nozzle sprays the washing water during one rotation of rotary water dividing unit 40 is two times longer than spray time of the case in which the number of discharge ports 41 is one. Discharge pressure of the washing water decreases a little, but washing power higher than that in a prior art washer can be secured. This is so because eating utensils held in an upper rack (not shown) are conventionally washed only by the lower washing nozzles, but in the present embodiment, they are washed also with the washing water sprayed from the upper part of washing tub 22. Therefore, amount of washing water sprayed to the objects to be washed per unit time is increased, and washing performance is improved.

Driving motor 42 can freely set a rotational speed of rotary water dividing unit 40 with controller 38. For example, when less dirt is adhered to an eating utensil such as a teacup or an eating utensil used for salad, the dirt is instantly washed out and removed from the eating utensil only by spray of washing water. In this case, the spray time from one washing nozzle is not made long, but the rotational speed of rotary water dividing unit 40 is made high and the washing water is sprayed to the eating utensil in unit time from various directions. This allows speedy and more efficient washing. On the contrary, when an extremely dirty eating utensil to which much part of an egg or oil is adhered is washed, the spray time from one washing nozzle during one rotation of rotary water dividing unit 40 is made long. This improves washing performance compared with a case in which the spray time is not made long. Thus, amount of the washing water sprayed from each washing device is varied in response to quantity and quality of the dirt adhered to eating utensils, thereby optimizing and thus improving washing performance, shortening washing time, or saving energy.

Using rotation detecting disk 67, rotational angle detecting sensor 47, and stationary position sensor 48 for positioning, driving motor 42 can recognize a relatively positional relationship between discharge port 41 in rotary water dividing unit 40 and five divided water discharge ports 44. For example, for reducing washing time, times for sprays from the washing nozzles in the lower part and upper part of washing tub 22 can be made longer than spray times of the other washing nozzles. The spray of the washing water to the cover causes increase of washing noise, but for minimizing the spray the spray time from the washing nozzle on the back face may be shorter than the spray times of the other washing nozzles. Thus, the washing water can be fed to a specific feeding/discharging passage at any time, washing energy can be applied in response to a degree of dirt on the objects to be washed, and washing performance can be improved. Washing noise can also be reduced.

Driving motor 42 rotates forwardly or reversely under control of controller 38, so that the motor can arbitrarily rotate clockwise or counter-clockwise. For example, when eating utensils are set only on a right half in the rack in the dishwasher shown in FIG. 8, washing water is sprayed only from rotating nozzles 62, 64, 66 to most efficiently wash the eating utensils. When rotary water dividing unit 40 is rotated only in a single direction, the washing water is also fed to rotating nozzles 61, 63, 65 for washing the left side in the rack where no eating utensil is placed, and therefore washing is inefficient. However, in addition to use of rotational angle detecting sensor 47 and stationary position sensor 48 for positioning, controller 38 controls driving motor 42 to rotate it forwardly or reversely. The washing water can therefore be sprayed only from rotating nozzles 62, 64, 66, and efficient washing is allowed in response to setting positions of eating utensils. As a result, speedy washing is allowed, and energy is saved.

In a washing method using a plurality of washing nozzles, generally, a feeding/discharging passage is required for each washing nozzle to increase fed water. When only fixed nozzles are used as shown in FIG. 9, many spray ports 17 are required for securing a predetermined washing performance. In the present embodiment, however, at least one or all of washing nozzles are rotating nozzles that spray washing water while turning. Therefore, in spite of a smaller amount of fed water, the washing water can be sprayed to objects to be washed from various directions. High efficiency washing can be obtained independently of shapes, setting positions, and a setting method of the eating utensils.

The driving device controls the rotary water dividing unit so as to match the opening position of a discharge port 41 with that of a divided water discharge port 44 during a draining process. This allows the washing water to be discharged from the washer without remaining in the water dividing structure, the washing nozzles, and the feeding/discharging passages. Therefore, garbage and detergent components contained in the washing water are discharged, and thus washing performance and rinsing performance are improved. The present invention is not limited to the method of matching the position of a discharge port with that of a divided water discharge port, and the rotary water dividing unit may be continuously rotated. The latter case also produces similar advantages.

In the washer of the present embodiment, the following elements do not need to be integrally formed, and each element may be individually formed. The elements are, for example, the device for controlling rotational speed or rotational direction (normal or reverse) of the driving motor, a rotational angle detecting device, and the washing nozzles including a rotating nozzle. A dishwasher has been described in the present embodiment, but the present invention is not limited to this dishwasher. The washer structure of the present embodiment may also be employed for a washer having a process of spraying washing water during washing and rinsing for removing foreign matter. The washer having the process of spraying washing water is, for example, a component washer for removing grease or chips from a component machined by a machine tool or the like, a washer for a semiconductor wafer, or a vegetable washer for removing foreign matters or chemicals from vegetables. In this case, similar advantages are realized.

Exemplary Embodiment 2

Figure 11:
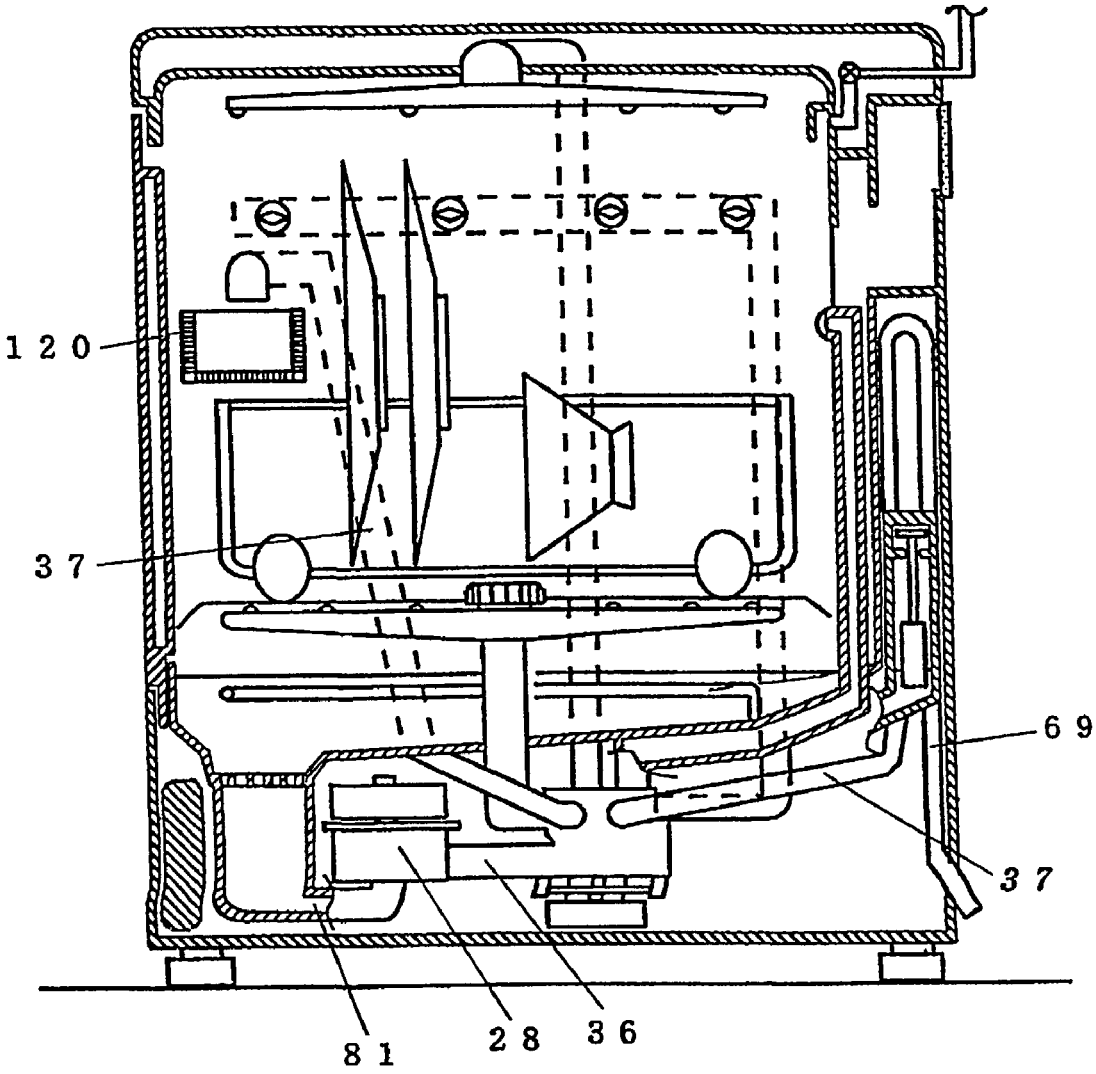
FIG. 11 is a sectional view of a dishwasher in accordance with exemplary embodiment 2 and exemplary embodiment 18 of the present invention.

FIG. 11 is a sectional view of a dishwasher in accordance with exemplary embodiment 2 of the present invention.

The washer of the present exemplary embodiment differs from that of exemplary embodiment 1 in the following structure. Washing pump 28 is disposed vertically. Feed water port 81 of the washing pump 28 is disposed in a lower end of the washing pump. Discharge port 36 of the washing pump 28 is disposed in an upper part of feed water port 81 of the washing pump 28 and projects substantially horizontally. Divided water discharge port 44 is disposed higher than discharge port 36. Stationary position sensor 48 for detecting a stationary position of rotary water dividing unit 40 and rotational angle detecting sensor 47 for detecting a rotational angle during rotation of rotary water dividing unit 40 have a micro switch, and rotation detecting disk 67 having concavities is combined with position sensor 48 and rotational angle detecting sensor 47. In addition to detecting methods shown in exemplary embodiment 1 and exemplary embodiment 2, a detecting method employing a sensor using magnetism may also be used.

Elements of exemplary embodiment 2 similar to those in exemplary embodiment 1 have the same reference numbers, and the descriptions of these elements is omitted.

Operations and functions of the washer will be described hereinafter.

Washing pump 28 is disposed vertically in the lower part of washing tub 22. In a feed water process for feeding the washing water to washing tub 22, the driving device controls the rotary water dividing unit so as to match the position of discharge port 41 with that of divided water discharge port 44 before feeding of the water. Otherwise, the driving device controls the rotary water dividing unit to continuously rotate it during the feed water process. In a conventional washer having a horizontally placed washing pump, discharge port 36 of the washing pump is positioned in an upper part of the pump. In this case, water dividing structure 35 must also be disposed in the upper part of the pump, and the height of a mechanism unit must be increased. In the present embodiment, however, washing pump 28 is disposed vertically, so that discharge port 36 of the washing pump can be disposed at a lower position of the pump. Therefore, air exhausted from washing pump 28 can flow through water dividing structure 35 and smoothly exit each washing nozzle, even when the mechanism unit is lessened in height.

Regarding a positional relationship between discharge port 36 and divided water discharge port 44, divided water discharge port 44 is disposed higher than discharge port 36 of the washing pump with reference to a floor surface of receiving body 21. During the water feeding, air from washing pump 28 does not remain in water dividing structure 35, and flows into washing tub 22 through washing nozzles 29, 30, 31, 32. This prevents a problem of air remaining in a casing of washing pump 28, such that entrainment of the air into the washing water occurs, and therefore the washing pump does not work. As a result, washing failure is prevented and stable washing performance can be secured.

The elements, depending on the arrangement of the washing pump and a height relation between the washing pump and the divided water discharge port as described in embodiment 2, do not need to be formed integrally, and these elements may be independently formed.

Exemplary Embodiment 3

Figure 13:
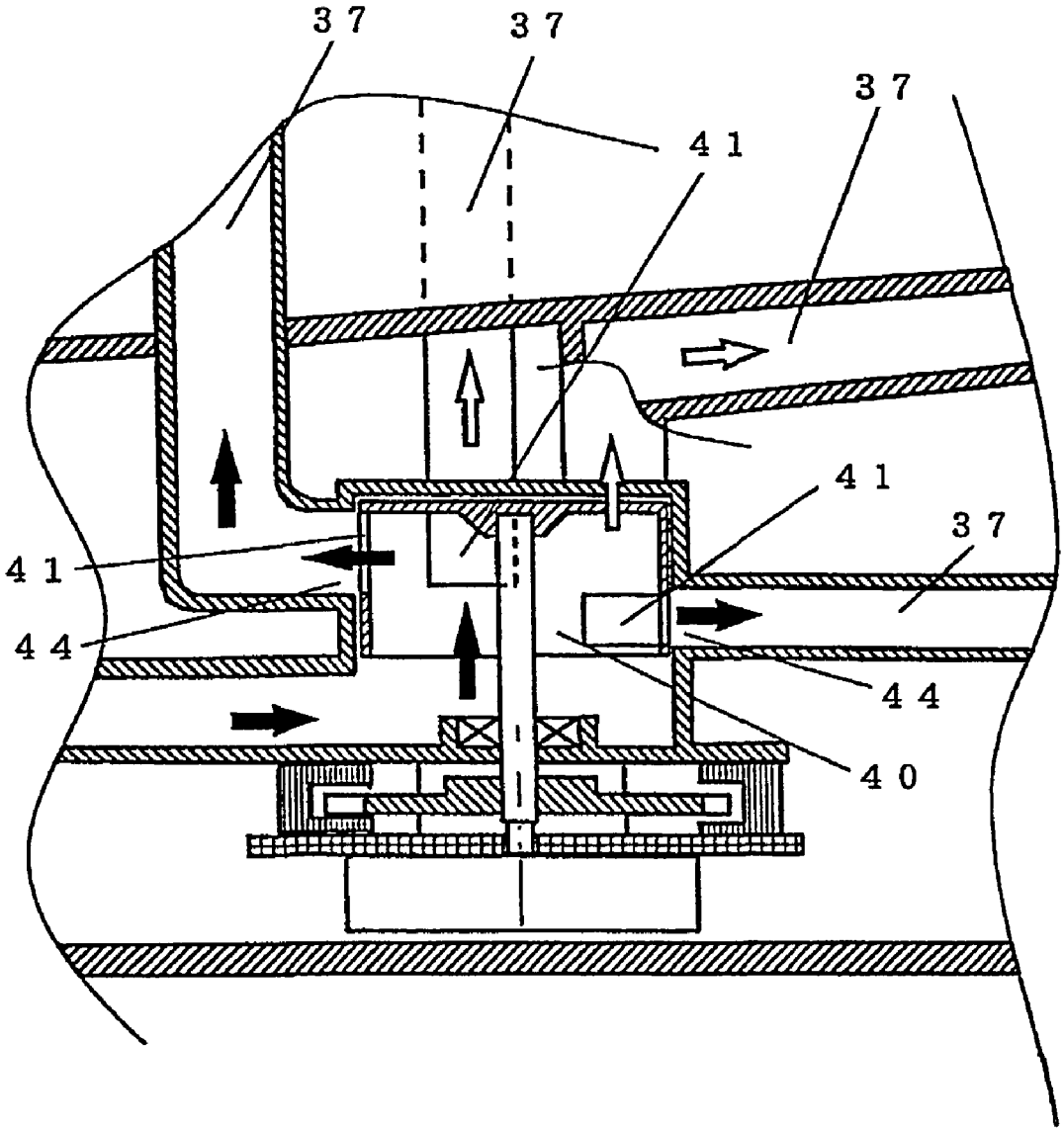
FIG. 13 is a fragmentary sectional view showing a water dividing structure and flow of washing water in a dishwasher in accordance with exemplary embodiment 3 of the present invention.
Figure 14:
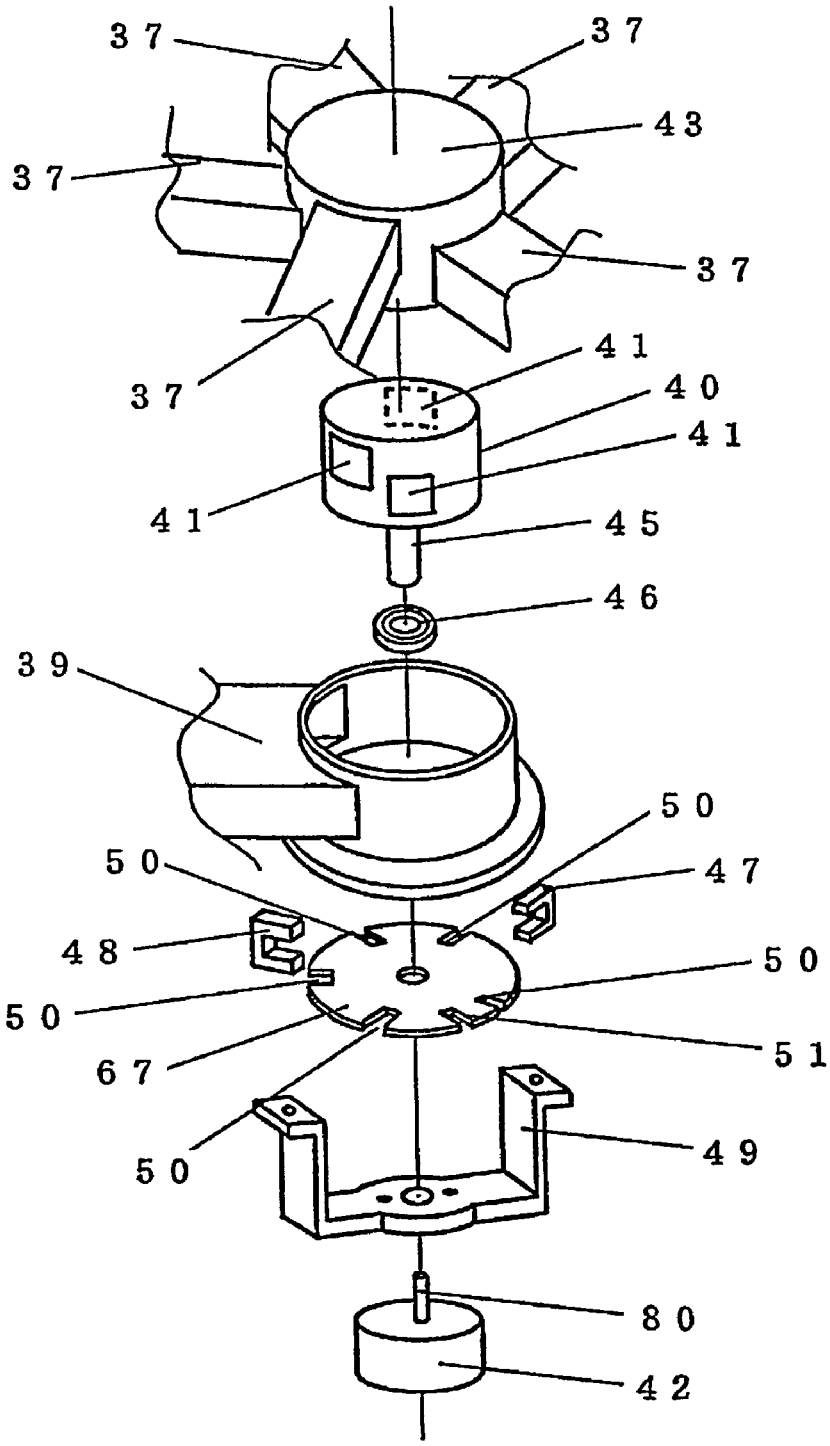
FIG. 14 is an exploded perspective view of the water dividing structure of the dishwasher in accordance with exemplary embodiment 3.

FIG. 13 is a fragmentary sectional view showing a structure of a water dividing structure and flow of washing water in a dishwasher in accordance with exemplary embodiment 3 of the present invention. FIG. 14 is an exploded perspective view of the water dividing structure of the dishwasher.

The washer of exemplary embodiment 3 differs from that of exemplary embodiment 1 in the following structure. A plurality of discharge ports 41 are vertically separated from each other by any distance in the axial direction of rotary water dividing unit 40. Rotation tracks of discharge ports 41 are not identical. Washing/discharging passages 37 having divided water discharge ports 44 are disposed on different planes.

Regarding the displacement of rotation tracks of discharge ports 41, the rotation tracks of discharge ports 41 may be overlapped with each other, or the rotation tracks may not be overlapped with each other at all. Any one of these arrangements produces advantages of the present invention. When the rotary water dividing unit is formed substantially horizontally, feeding/discharging passages 37 can be formed at any right and left positions of the divided water output unit. Therefore, a washing device, a water dividing structure, and other mechanism units can be arranged optimally.

Elements of exemplary embodiment 3 similar to those in exemplary embodiment 1 have the same reference numbers, and the descriptions of these elements is omitted.

Operations and functions of water dividing structure 35, namely a characteristic structure of embodiment 3, will be described hereinafter. Regarding a positional relationship of the plurality of discharge ports 41 in rotary water dividing unit 40, discharge ports 41 are disposed at positions where respective rotation tracks of the plurality of discharge ports 41 are not identical. Rotation radius of rotary water dividing unit 40 can therefore be decreased while an opening area is kept equal to that in a structure where discharge ports 41 are disposed on a substantially identical track. Assignment of feeding/discharging passages 37 to a plurality of washing nozzles 29, 30, 31, 32 is facilitated in a lower part of washing tub 22, and thus water dividing structure 35 is downsized and installing ability is improved. Bending frequency of feeding/discharging passages 37 is low, and therefore pressure loss in feeding/discharging passages 37 can be reduced. As a result, discharge force of washing nozzles is increased and washing performance is improved, or a washing pump is downsized to further downsize the mechanism unit.

Exemplary Embodiment 4

Figure 15:
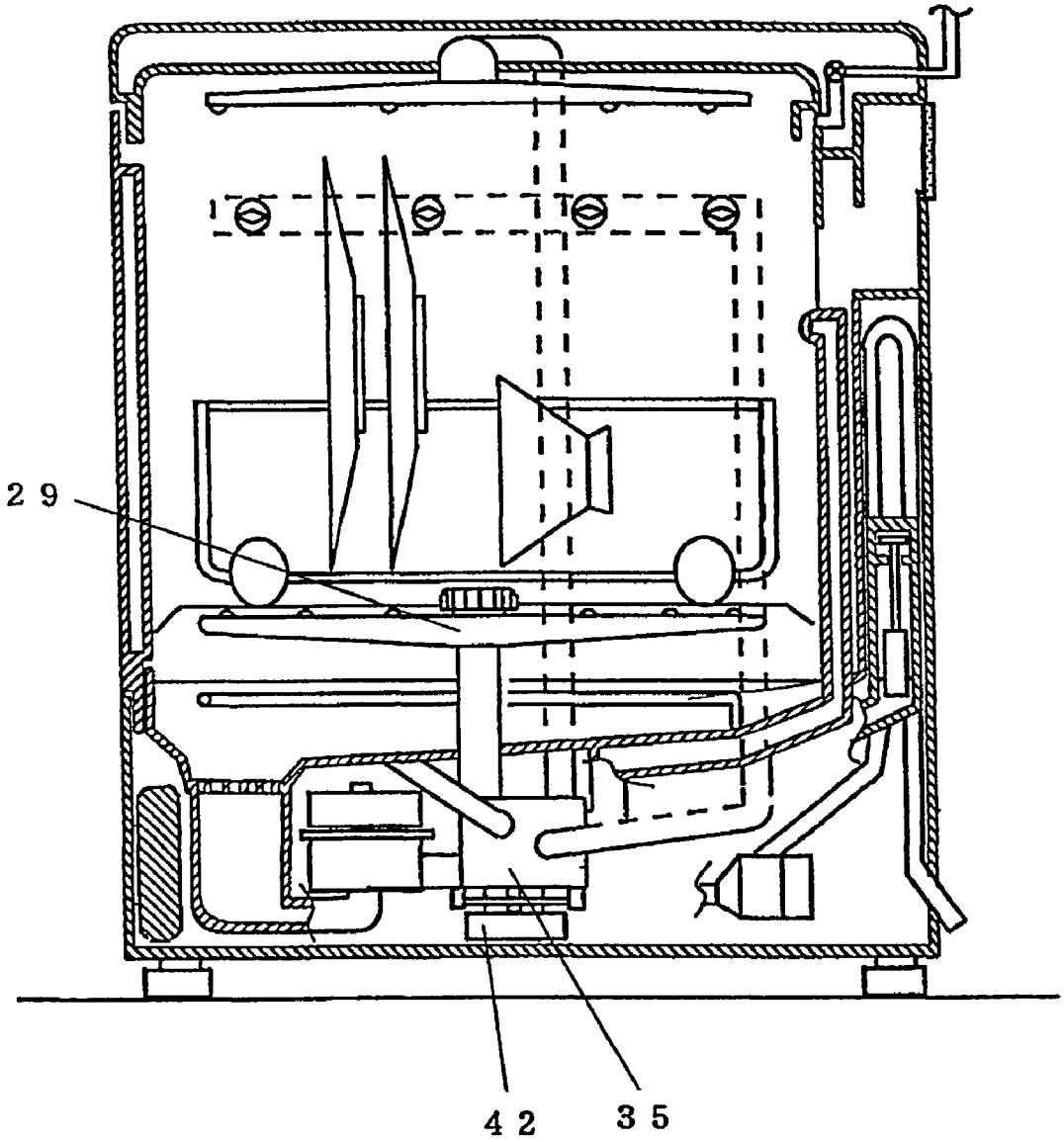
FIG. 15 is a sectional view of a dishwasher in accordance with exemplary embodiment 4 of the present invention.
Figure 16:
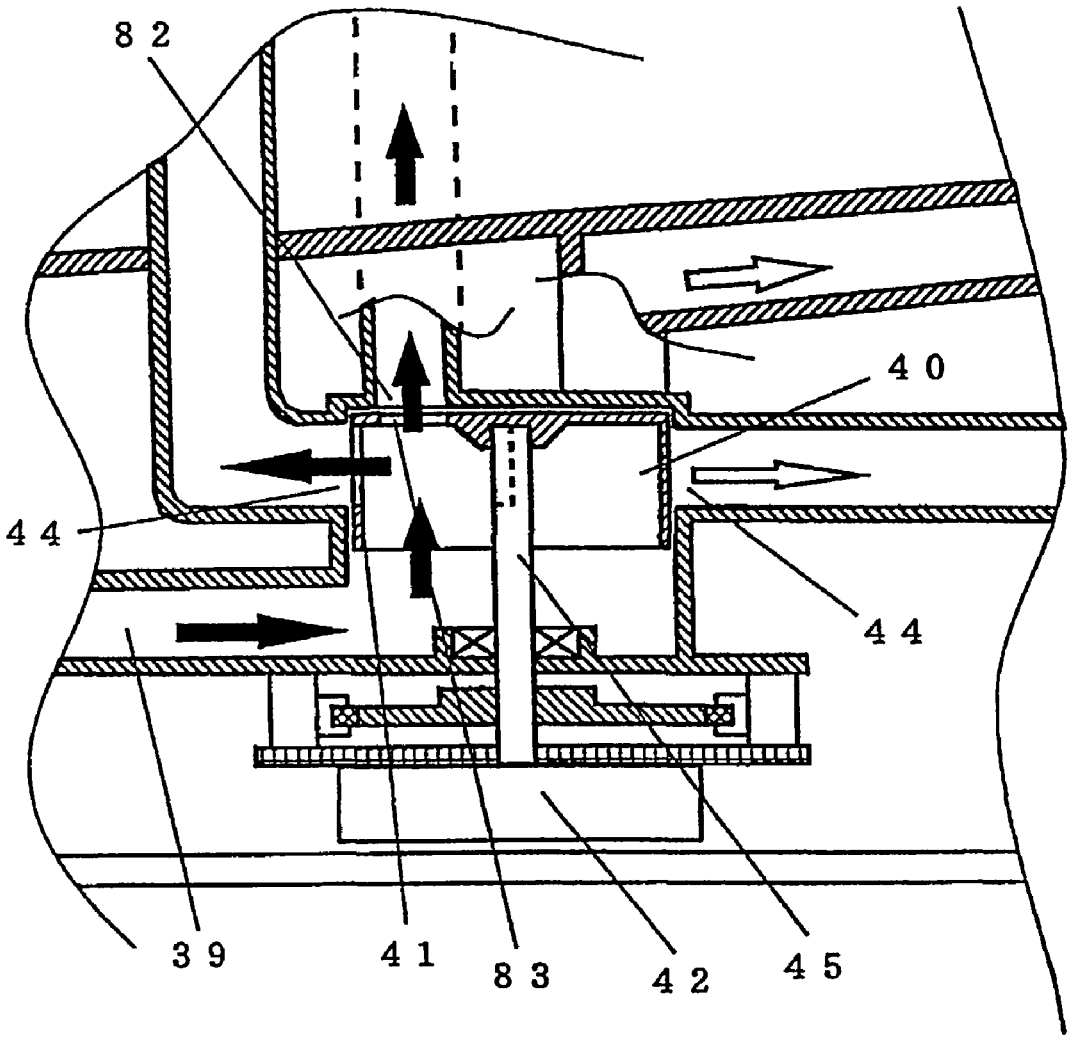
FIG. 16 is a fragmentary sectional view showing a water dividing structure and flow of washing water in the dishwasher in accordance with exemplary embodiment 4.
Figure 17:
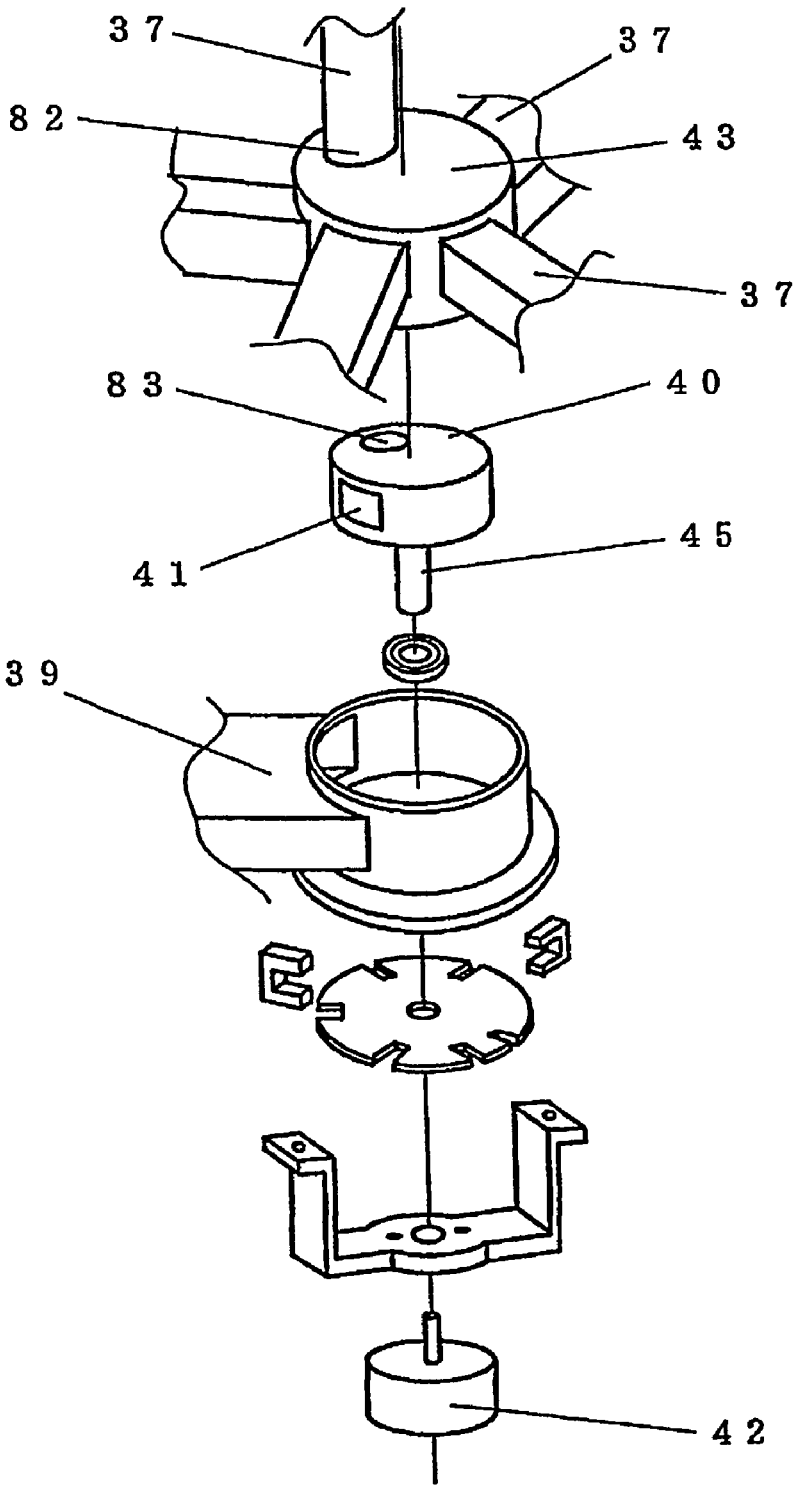
FIG. 17 is an exploded perspective view of the water dividing structure of the dishwasher in accordance with exemplary embodiment 4.

FIG. 15 is a sectional view of a dishwasher in accordance with exemplary embodiment 4 of the present invention. FIG. 16 is a fragmentary sectional view showing a structure of a water dividing structure and flow of washing water in the dishwasher. FIG. 17 is an exploded perspective view of the water dividing structure of the dishwasher.

The washer of exemplary embodiment 4 differs from that of exemplary embodiment 1 in the following structure. One of divided water discharge ports 82 is formed in a face that is substantially vertical to rotating shaft 45 of rotary water dividing unit 40. Discharge ports 83 are formed not only in a side face of rotary water dividing unit 40 but also in a top face thereof.

Elements of exemplary embodiment 4 similar to those in exemplary embodiment 1 have the same reference numbers, and the description of these elements is omitted.

Operations and functions of the washer will be described hereinafter. Water dividing structure 35 is vertically placed in exemplary embodiment 1, so that all of a plurality of divided water discharge ports 44 discharge the washing water substantially vertically to rotating shaft 45 of rotary water dividing unit 40. The washing water flowing upwardly in rotary water dividing unit 40 discharges from discharge ports 41, changing its flow direction by about 90°. A pressure loss therefore occurs in this stage. Specifically, when the washing water is fed to washing nozzle 29 for spraying the washing water from a lower direction, this pressure loss largely affects washing performance. In exemplary embodiment 4, however, a channel is not bent substantially vertically by rotary water dividing unit 40. Therefore, the washing water guided by aqueduct 39 is fed directly to washing nozzle 29 through discharge port 83 and divided water discharge port 82.

Thus, pressure loss can be minimized. Therefore, discharge force of washing nozzles is increased and washing performance is improved, or a washing pump is downsized to further downsize a mechanism unit. The structure discussed above decreases force in a thrust direction that is applied to driving shaft 80 of driving motor 42, and reduces reaction force of the spray (radial force) of the washing water discharged from discharge ports 41 in rotary water dividing unit 40. Therefore, a mounting structure of driving motor 42 is simplified, and an inexpensive dishwasher is obtained.

Exemplary Embodiment 5

Figure 18:
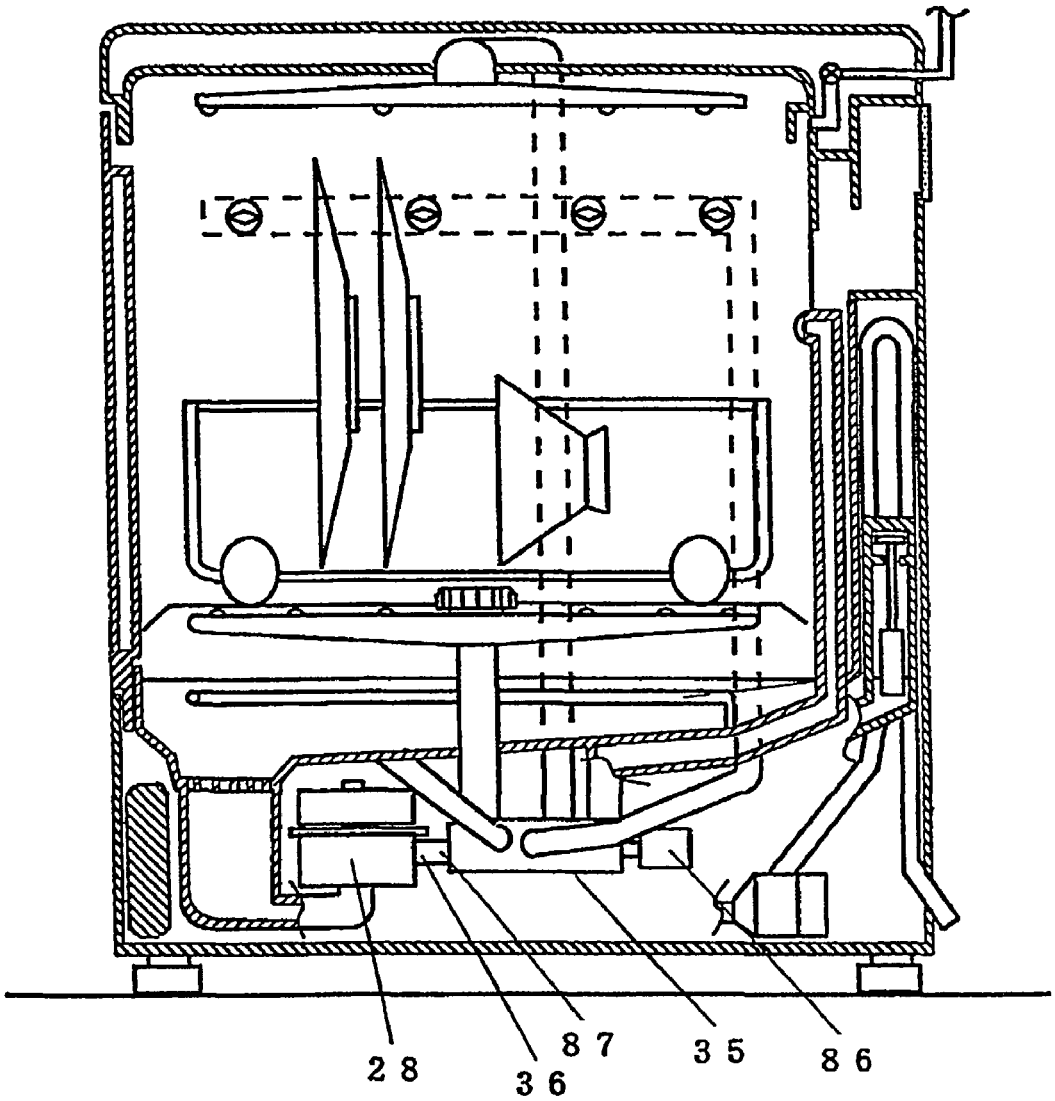
FIG. 18 is a sectional view of a dishwasher in accordance with exemplary embodiment 5 of the present invention.
Figure 19:
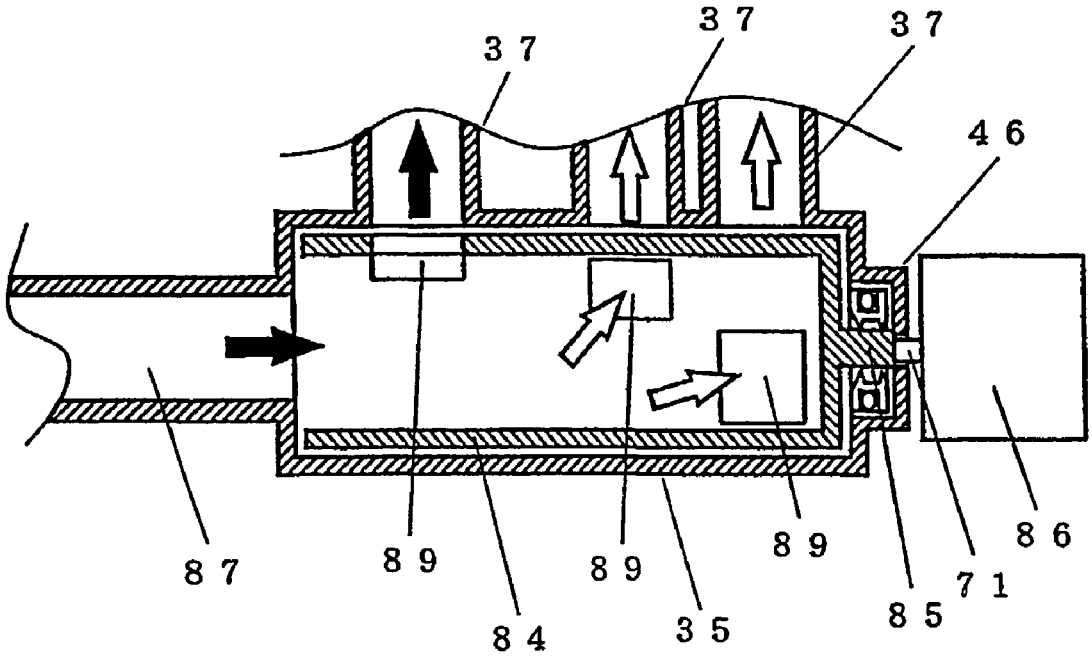
FIG. 19 is a fragmentary sectional view showing a water dividing structure and flow of washing water in the dishwasher in accordance with exemplary embodiment 5.

FIG. 18 is a sectional view of a dishwasher in accordance with exemplary embodiment 5 of the present invention. FIG. 19 is a fragmentary sectional view showing a structure of a water dividing structure and flow of washing water in the dishwasher.

The washer of exemplary embodiment 5 differs from that of exemplary embodiment 1 in the following structure.

Rotary water dividing unit 84 is disposed so that its axis is directed substantially horizontally. Driving shaft 71 of driving motor 86 is disposed in a substantially the same direction as a flow direction of washing water discharged from washing pump 28. Driving motor 86 is disposed on a side of rotary water dividing unit 84 that is opposite the side of rotary water dividing unit 84 on which discharge port 36 of washing pump 28 is disposed.

Elements of exemplary embodiment 5 similar to those in exemplary embodiment 1 have the same reference numbers, and the description of these elements is omitted.

Operations and functions of the washer will be described hereinafter. Since the axis of rotary water dividing unit 84 is directed substantially horizontally, discharge port 36 of the washing pump, aqueduct 87, and rotary water dividing unit 84 can be arranged substantially coaxially. A plurality of feeding/discharging passages 37 can be horizontally disposed in a side face of rotary water dividing unit 84. Rotary water dividing unit 84 can thus be configured of a slender shape having a small diameter. Pressure loss in a path from discharge port 36 to discharge port 89 can be minimized. Lengths of feeding/discharging passages can thus be optimized for washing nozzles 29, 30, 31, 32 disposed at different positions of washing tub 22. Water dividing structure 35 itself can also be disposed in the lower part of the washing tub, and the installing ability of water dividing structure 35 is also improved. A water dividing structure where the number of bendings of feeding/discharging passages 37 is less can be obtained, and therefore, passage pressure loss in water dividing structure 35 is reduced.

Regarding the arrangement of driving motor 86, driving motor 86 is disposed on the opposite side of the rotary water dividing unit 84 with respect to discharge port 36 of washing pump 28. Driving motor 86 does not therefore need to be disposed between discharge port 36 and aqueduct 87. When driving motor 86 is disposed between discharge port 36 and aqueduct 87, a water dividing structure having a bent path between discharge port 36 and adequate 87 is required, pressure loss increases, and connecting structure between driving shaft 71 and rotating shaft 85 of rotary water dividing unit 84 is complicated.

In the washer of embodiment 5, however, pressure loss in a channel is reduced, and connecting structure between the driving shaft of the motor 86 and the rotating shaft of rotary water dividing unit 84 is simplified. A seal mechanism disposed between the rotary water dividing unit and the driving motor can also be formed as a simple structure using an oil seal. Therefore, undesired increase in cost can be prevented, and thus the washer is inexpensive.

The washer of embodiment 5 allows reduction of pressure loss in each channel where the washing water flows, and also allows a water dividing structure to be compact. Therefore, washing performance extremely improves, and a compact and inexpensive dishwasher is obtained.

The elements, depending on the installation direction of the rotary water dividing unit and the installation position of the driving device as described in embodiment 5, do not need to be formed integrally, and each element may be individually formed.

Exemplary Embodiment 6

Figure 20:
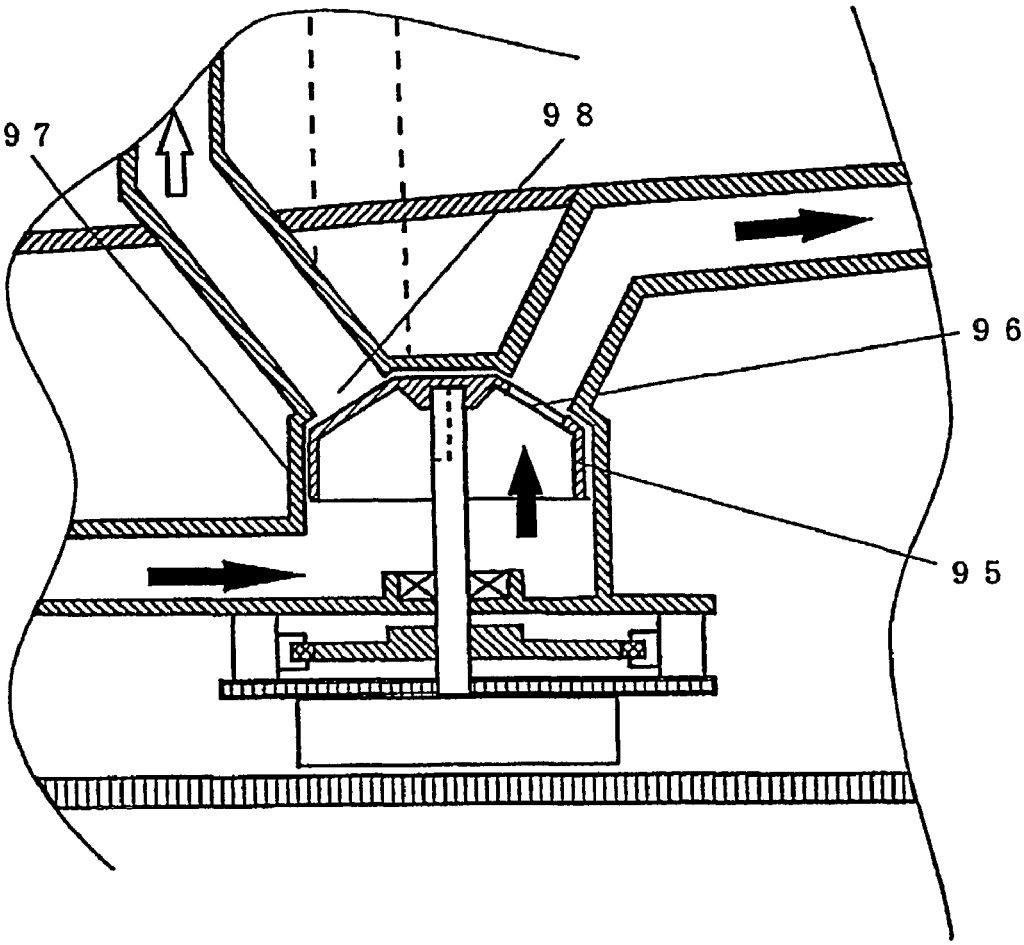
FIG. 20 is a fragmentary sectional view showing a water dividing structure and flow of washing water in a dishwasher in accordance with exemplary embodiment 6 of the present invention.

FIG. 20 is a fragmentary sectional view showing a structure of a water dividing structure and flow of washing water in a dishwasher in accordance with exemplary embodiment 6 of the present invention.

The washer of exemplary embodiment 6 differs from that of exemplary embodiment 1 in the following structure.

Any face of a rotary water dividing unit having discharge port 96 and any face of divided water output unit 97 corresponding to a face of the rotary water dividing unit constitute a cone as shown in FIG. 20.

Elements of exemplary embodiment 6 similar to those in exemplary embodiment 1 have the same reference numbers, and the descriptions of these elements is omitted.

Difference between an entering angle and an exiting angle of the washing water flowing from rotary water dividing unit 95 to divided water discharge port 98 can therefore be reduced due to this structure. Pressure loss in a passage leading from rotary water dividing unit 95 to divided water discharge port 98 can thus be reduced. Discharge pressure of washing nozzles therefore increases. Therefore, washing performance is improved, a washing pump is downsized, a mechanism unit is further downsized, and thus the dishwasher can be further downsized. Difference between the entering angle and the exiting angle may be substantially 90° or less in a plane having the discharge port in the rotary water dividing unit and a plane having the divided water discharge port in the divided water output unit. For example, these faces are planar, spherical, or curved. Such structure produces similar advantages.

Exemplary Embodiment 7

Figure 21:
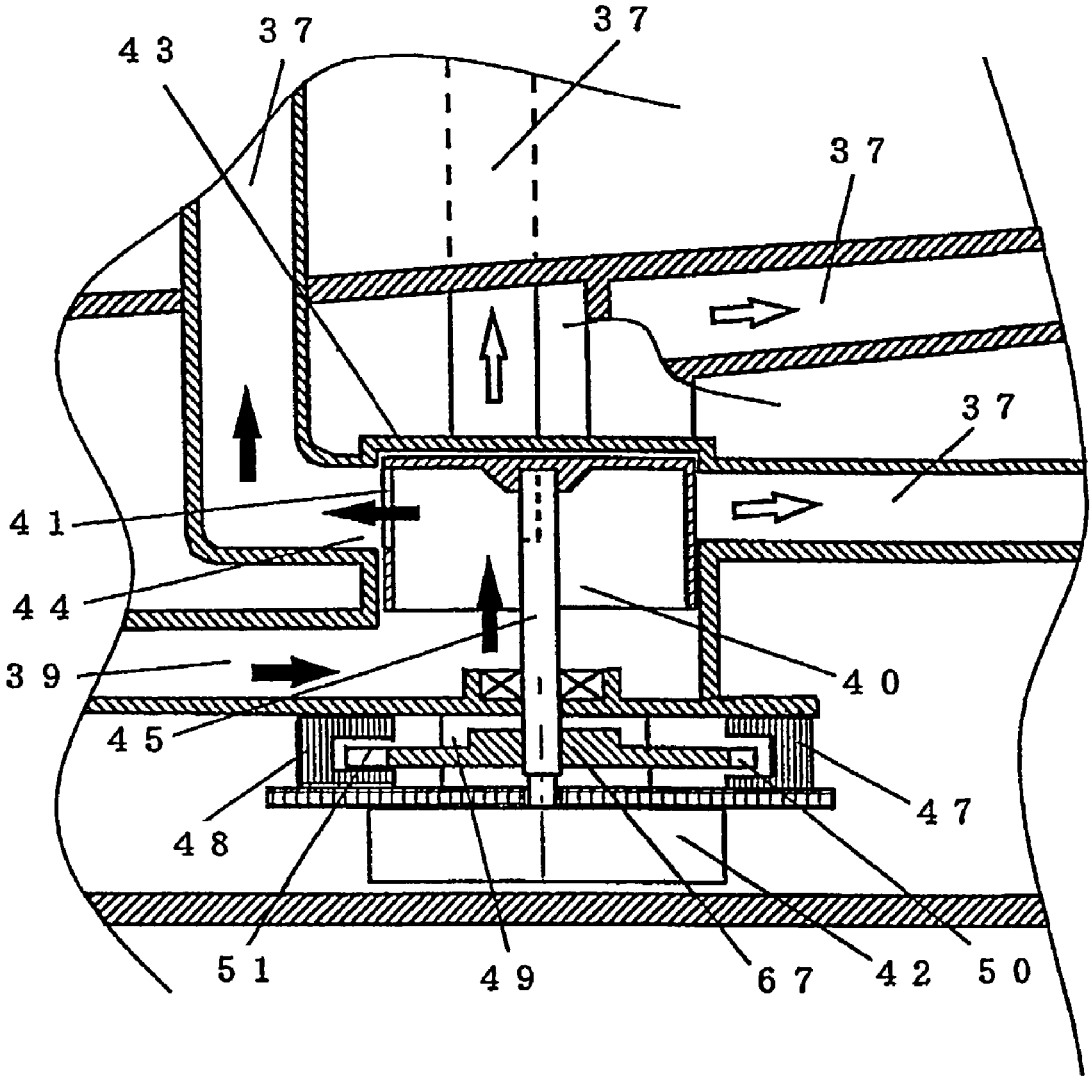
FIG. 21 is a fragmentary sectional view of a changeover unit of a dishwasher in accordance with exemplary embodiment 7 of the present invention.
Figure 22:
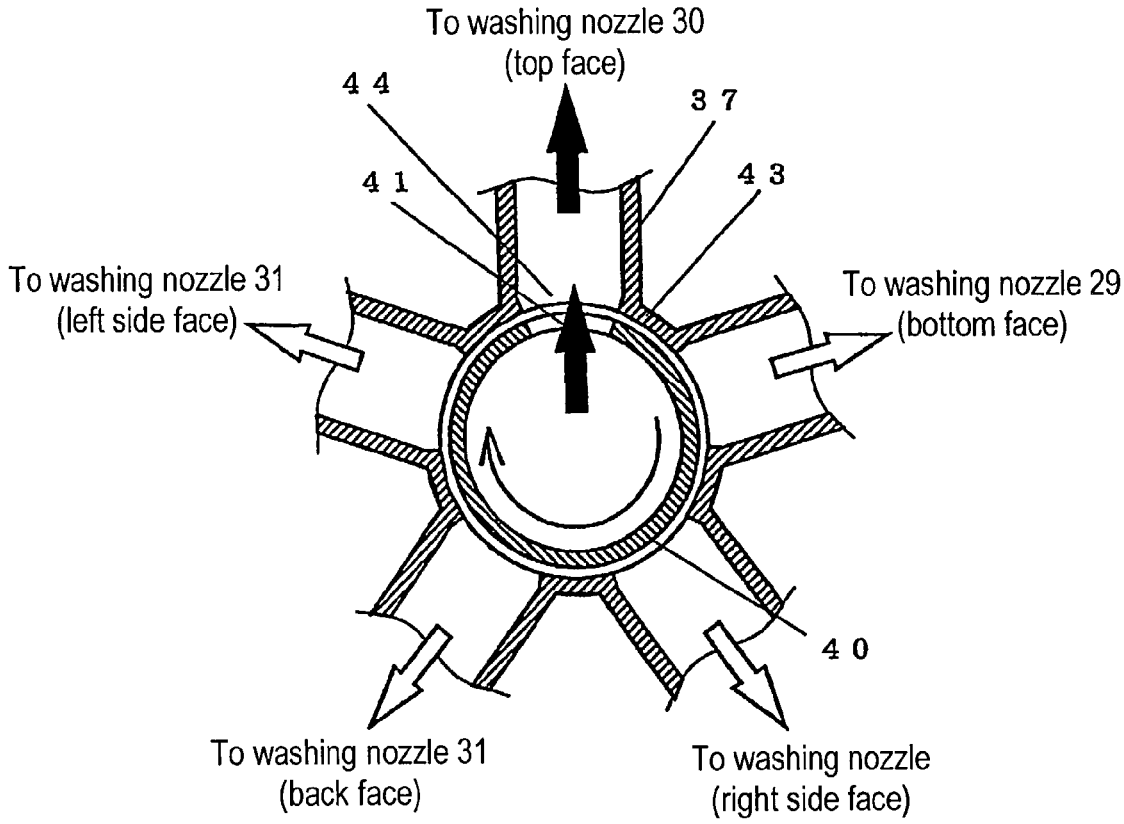
FIG. 22 is a fragmentary sectional view showing a spray state of the changeover unit of the dishwasher in accordance with exemplary embodiment 7.
Figure 23:
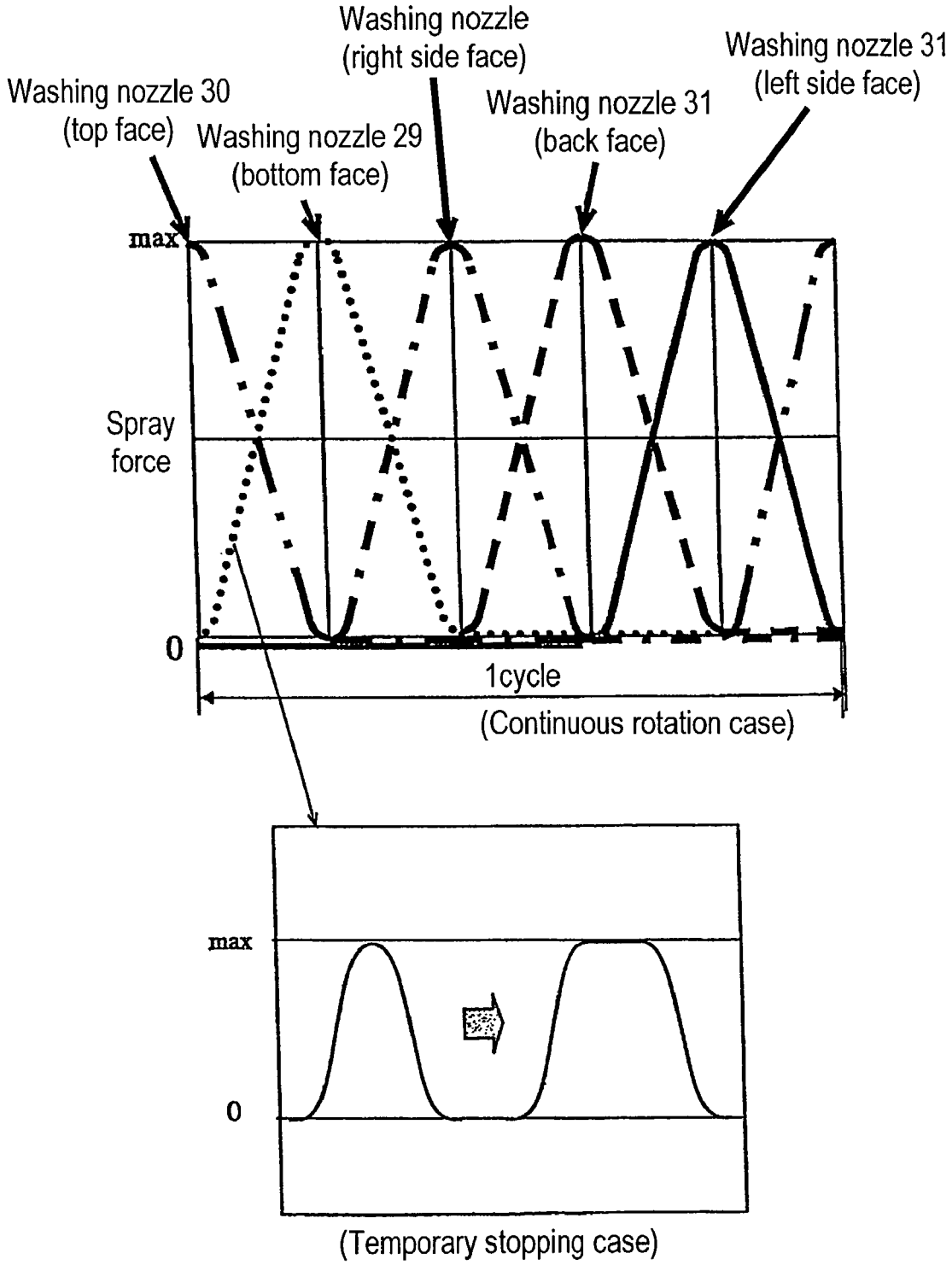
FIG. 23 is a graph showing water spray force of water sprayed, during one rotation of a water dividing structure, from each washing device of the dishwasher in accordance with exemplary embodiment 7 of the present invention.

FIG. 21 is a fragmentary sectional view of a changeover unit of a dishwasher in accordance with exemplary embodiment 7 of the present invention. FIG. 22 is a fragmentary sectional view showing a spray state of the changeover unit of the dishwasher. FIG. 23 is a graph showing water spray force of water sprayed from each washing device of the dishwasher, during one rotation of a water dividing structure.

The washer of exemplary embodiment 7 differs from that of exemplary embodiment 1 in the following structure.

As shown in FIG. 21, rotation detecting disk (rotational position detecting device, controlling device) 67 having rotational angle detecting slits (rotational angle detecting structure) 50 and stationary position detecting slit (rotational position detecting structure) 51 on its outer periphery is coaxially fixed to rotating shaft 45. Rotational angle detecting sensor (rotational angle detecting device, sensor using receiving and emitting of light) 47 fixed to aqueduct 39 detects a rotational angle of rotary water dividing unit 40. Stationary position sensor (rotational position detecting device, sensor using receiving and emitting of light) 48 for positioning is disposed at a position where the opening of discharge port 41 matches with that of specific divided water discharge port 44. Stationary position sensor 48 for positioning is used for matching the opening position of discharge port 41 with that of divided water discharge port 44. A rotational position detecting device comprises stationary position sensor 48 for positioning, stationary position detecting slit 51, and rotation detecting disk 67.

By using rotational angle detecting sensor 47 and stationary position sensor 48, the washing water can be discharged from a specific washing device, and the controlling device can determine which discharge port 41 matches with divided water discharge port 44. Stationary position detecting slit 51 is formed at such a position that a state where both rotational angle detecting sensor 47 and stationary position sensor 48 detect light, or neither of them detects light, occurs only once for one rotation of rotation detecting disk 67. A plurality of rotational angle detecting slits 50 formed in rotation detecting disk 67 is formed at positions where the opening of divided water discharge port 44 matches with that of discharge port 41. When only rotational angle detecting sensor 47 detects or does not detect light, a controller determines that "the opening of divided water discharge port 44 matches with that of discharge port 41". When both rotational angle detecting sensor 47 and stationary position sensor 48 detect light, or neither of them detects light, the controller determines that "rotary water dividing unit 40 comes to a stationary position". Frame (water dividing structure) 49 for supporting a driving motor has a function of fixing driving motor 42 to aqueduct 39. Driving motor 42 is supported with frame 49 positioned to aqueduct 39, and these may be integrally structured. Rotary water dividing unit 40, rotating shaft 45, oil seal 46, frame 49 for supporting the driving motor, a driving shaft 80, and driving motor 42 constitute a changeover unit. Aqueduct 39, divided water output unit 43, and changeover unit 101 constitute a water dividing structure (water dividing structure 35).

The number of discharge ports 41 in embodiment 7 is one; however, the number is not limited to this. However, the number of discharge ports 41 is preferably smaller than a number of feeding/discharging passages 37. This produces similar advantages.

Discharge port 41 is formed in a side face of rotary water dividing unit 40 in embodiment 7; however, the present invention is not limited to this. Discharge port 41 may be formed in a face substantially vertical to rotating shaft 45 and directed towards divided water discharge port 44 formed in divided water output unit 43. This produces similar advantages.

FIG. 22 shows a state where rotary water dividing unit 40 rotates to sequentially match divided water discharge port 44 formed in the side face of rotary water dividing unit 40 with discharge port 41 communicating with each washing nozzle, and thus washing water is sequentially fed to each washing nozzle.

FIG. 23 shows variation of spray force of each washing nozzle during one rotation of rotary water dividing unit 40.

Various combinations of washing nozzles are considered in response to a condition such as a single-stack rack or a double-stack rack, but a washing method using a plurality of washing nozzles produces advantages similar to that of embodiment 7.

Operations and functions of water dividing structure 35, which is a characteristic structure of embodiment 7, will be described hereinafter. Washing water pressurized by washing pump 28 firstly passes through aqueduct 39 and discharges from discharge port 41 formed in rotary water dividing unit 40. At this time, rotary water dividing unit 40 is continuously rotated at a low speed by driving motor 42, and the opening position of discharge port 41 sequentially matches with those of five divided water discharge ports 44. When these opening positions match with each other, the washing water is fed to each washing nozzle through each discharging passage.

The operations will be described hereinafter. Stationary position sensor 48 and rotational angle detecting sensor 47 function to temporarily stop rotary water dividing unit 40 at a position where divided water discharge port 44 communicating with a lower face of washing nozzle 30 matches with discharge port 41. At this time, the washing water is sprayed from washing nozzle 30 for a certain amount of time. Next, for feeding the washing water to washing nozzle 29, rotary water dividing unit 40 is rotated until discharge port 41 matches with divided water discharge port 44 communicating with washing nozzle 29. After stoppage of rotary water dividing unit 40 for the certain amount of time, the rotary water dividing unit is rotated again. Such a series of operations are performed. FIG. 23 shows spray force of each washing nozzle and operations of rotary water dividing unit 40. When rotary water dividing unit 40 is rotated continuously, an opening area between discharge port 41 and divided water discharge port 44 gradually changes, and therefore the spray force continuously changes. When rotary water dividing unit 40 is temporarily stopped during an operation, the maximum spray force can be maintained for a certain amount of time.

The water dividing structure can thus switch between discharging passages for the washing water discharged from the washing pump, so that the washing pump power and a fed water amount required for operating a single washing nozzle can operate a plurality of washing nozzles.

When a conventional structure using only a single nozzle is changed to the structure using a plurality of washing nozzles, washing performance can be improved using a washing pump having a power equivalent to that of a conventional pump. At this time, the fed water does not need to be increased, so that a longer operating time is not required. Consumed energy and water are saved, and high washing performance is obtained.

In a conventional washing method where upper and lower nozzles spray water simultaneously, water flows may interfere with each other on an eating utensil to disturb exhibition of original performance. In the washing method of embodiment 7, however, washing water is sequentially sprayed, so that the sprayed washing water flows do not interfere with each other and thus efficient washing is obtained.

During a primary washing process or a rinsing process in embodiment 7, the controller is controlled so that the washing water is finally sprayed from a washing nozzle disposed on a top face or a side face of the washing tub. The structure is firstly described. Stationary position detecting slit 51 formed in rotational detecting disk 67 is set so that the slit matches with discharge port 41 and divided water discharge port 44 for discharging the washing water to washing nozzle 30 disposed in an upper part of washing tub 22.

Each washing nozzle also sequentially sprays the washing water during a rinsing process. During completion of the rinsing process, controller 38 performs the following control. Rotary water dividing unit 40 is temporarily stopped based on a signal of stationary position sensor 48 in consideration of the rotational speed and the position of rotary water dividing unit 40 and a certain spray time from the upper part of the tub. The washing water is then sprayed from the upper part of the tub for a certain amount of time.

A specific spray method will be illustrated hereinafter.

The primary washing time and the rinsing time during an operational program are generally set based on timing and temperature of washing water. A heating/rinsing process finally performed during the rinsing process finishes when the temperature of the washing water reaches about 70°. The rinsing process comprises a process of performing a rinsing operation controlled based on two or three time periods and a heating/rinsing process controlled based on the temperature of the washing water. The heating/rinsing process serves to raise the temperature of the washing water to about 70°.

During the primary washing process and the rinsing process controlled based on time, therefore, rotary water dividing unit 40 is firstly moved to a stationary position, an operation is then started, a spray time and a stop time for each washing nozzle of rotary water dividing unit 40 are set, and finally the washing water is sprayed from the washing nozzle disposed on the top face or the side face of the tub. The controller thus controls the operation.

The fed water amount and the temperature of the washing water during water feeding varies during the heating/rinsing process, so that a finishing time of the heating and rinsing cannot be specified. However, the stationary position of the rotary water dividing unit is set to a spray position for the washing nozzle disposed on the top face or the side face of the tub, thereby finishing the operation when the temperature of the washing water rises to a temperature close to a value for finishing the heating and rinsing. Otherwise, after the temperature rises, the washing water is sprayed from the washing nozzle disposed on the top face or the side face of the tub, and then the operation is finished. During the process of stopping the operation based on a time control, the spray time or the stop time during the operation is changed in response to the finishing time, thereby realizing the operation of embodiment 7. A performing method of these operations is determined based on a characteristic of any process.

The washing water is sprayed to eating utensils from the upper part in of the tub during completion of any process in embodiment 7. Therefore, dirt is easily removed from the eating utensils to allow certain rinsing. Re-adhesion of dirt to a rim at a bottom of a cup can be minimized. Fine garbage or the like adhered to the eating utensils can be discharged early during the washing process. The washing performance is further improved.

When the process of performing rinsing from the upper part of the tub is performed during at least several rinsing processes, its advantages can be obtained. However, when rinsing from the upper part of the tub is performed during all rinsing processes and the primary washing process, the advantages are further improved.

Regarding the spray time of each washing device, the controller controls rotational angle detecting sensor 47, stationary position sensor 48, and driving motor 42 in a structure of embodiment 7, and thus the spray time of the washing water from each washing device can be arbitrarily set. Dirt adhered to eating utensils is easily removed or is hardly removed depending on types of the dirt, when the eating utensils are washed. For example, a grain of rice or the like adhered to a rice bowl is hardly removed, and dirt on a teacup or the like is relatively easily removed. The rack in the dishwasher is designed so that setting positions of the eating utensils in response to types of the eating utensils are restricted to some extent. A spray mechanism for the washing nozzles is designed in response to this.

The washing nozzle for spraying the washing water toward a setting position of a teacup having the hardly removed dirt requires a long spray time in embodiment 7. A washing nozzle for spraying the washing water to a vessel for small articles also requires a spray time longer than that of the other washing nozzles. Here, the dirt adhered to the vessel is easily removed by the spray from the upper part of the tub. Thus, a spray time of each washing nozzle can be set, in consideration of easiness of removal of the dirt and a spray direction where the dirt is easily removed depending on an eating utensil arrangement. As an example, a spray time of each washing nozzle is set so that spray times for a place having hard-to-remove dirt, a place having easy-to-remove dirt, and other places are 30 seconds, 5 seconds, and 10 seconds, respectively.

In the dishwasher accommodating eating utensils having different hard-to-remove dirt, therefore, an operation having an optimal spray time corresponding to characteristics of eating utensils and dirt allows more efficient washing, prevents washing failure, and provides high washing performance.

Spray times during a primary washing process and rinsing process will be described hereinafter. The spray time is defined as shown below in embodiment 7. The spray time means a certain amount of time in which any washing nozzle sprays the washing water in a state where discharge port 41 is stopped temporarily. Specifically, the spray time during the primary washing process is called a first spray time, and the spray time during the rinsing process is called a second spray time.

The controller in embodiment 7 is operated so that the first spray time is longer than the second spray time. During the primary washing process, essentially, a chemical force due to detergent and a washing force due to heat are combined for washing in order to remove dirt adhered to eating utensils. Specifically, in the case of using of a machine force generated by the spray of the washing water, high washing performance is obtained by spraying a large quantity of washing water at a time, rather than by spraying a small quantity of washing water several times. On the contrary, during the rinsing process, a spraying of the washing water and several water dischargings and water feedings are repeated in a short time to mainly wash away fine dirt adhered to the eating utensils or the inside of the washing tub. The eating utensils are more certainly rinsed in a short time by spraying the washing water to the eating utensils uniformly from the most possible directions. In other words, preferably, the first spray time is set long and the washing is certainly performed, and the second spray time is set short and the number of sprayings from each washing nozzle is increased. As an example, preferably, the first spray time is 10 seconds, and the second spray time is 5 seconds.

During washing in embodiment 7, therefore, the optimal spray time of each washing nozzle is set, thereby realizing high washing performance.

The water dividing structure illustrated in embodiment 7, the operating method of spraying the washing water from the upper part of the tub during completion of the operation, spray time difference between the primary washing process and the rinsing process, and the operating method allowing setting of the spray time of each washing nozzle in any process do not need to be wholly realized. For example, each process or each element may be independent. All procedures of the washing process do not need to be performed. For example, at least one procedure of it may be performed, and similar advantages can be produced.

The rotary water dividing unit in embodiment 7 mainly rotates and stops repeatedly; however, the present invention is not limited to this. A rotary water dividing unit may be continuously moved. In the latter case, the rotational speed is varied to perform an operation similar to that in embodiment 7. Thus, similar advantages can be produced. A structure in which the rotary water dividing unit rotates at a constant speed is also allowed, and similar advantages can be produced.

Exemplary Embodiment 8

Figure 24:
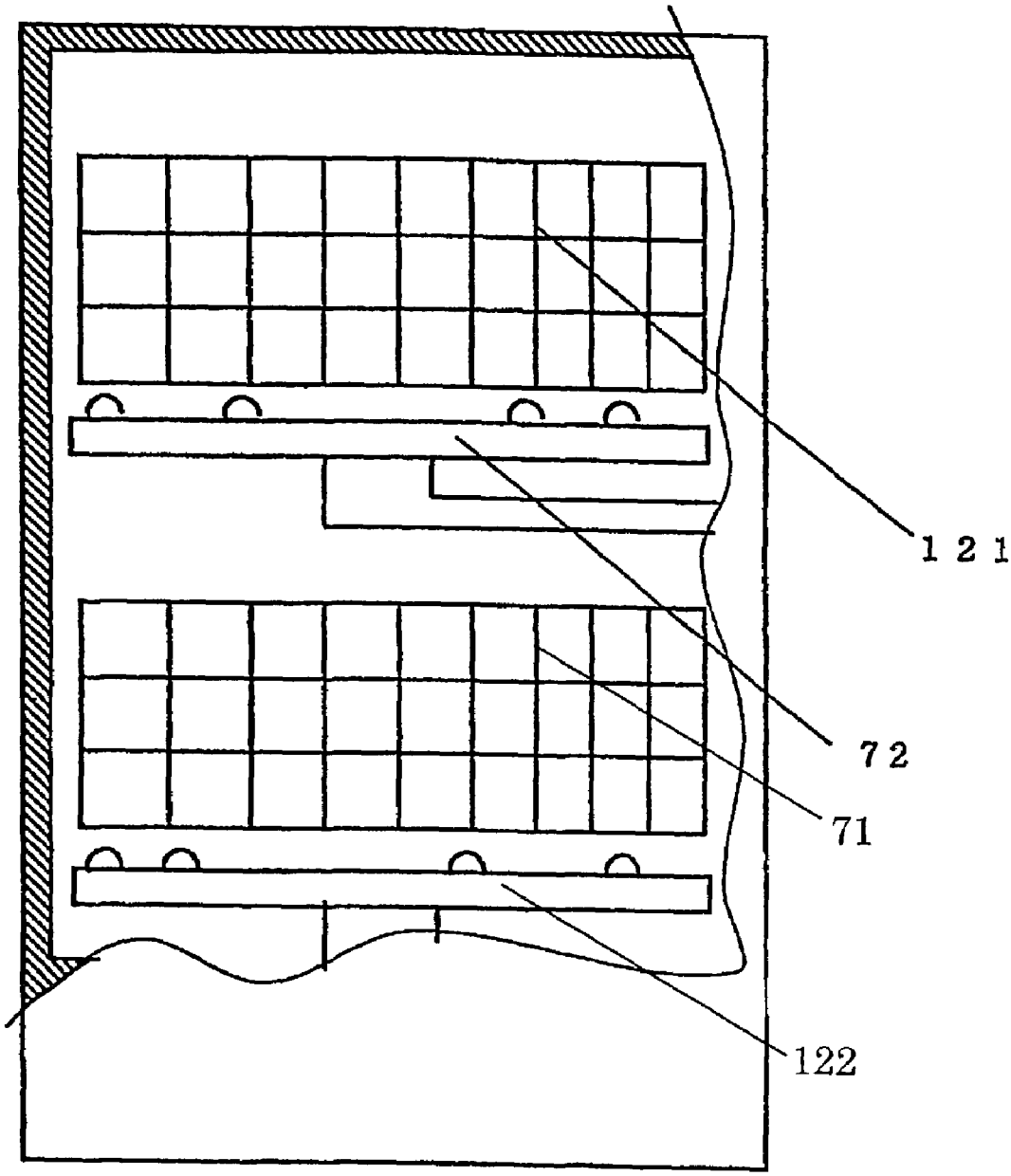
FIG. 24 is a fragmentary sectional view of a double-stack rack of a dishwasher in accordance with exemplary embodiment 8 of the present invention.
Figure 25:
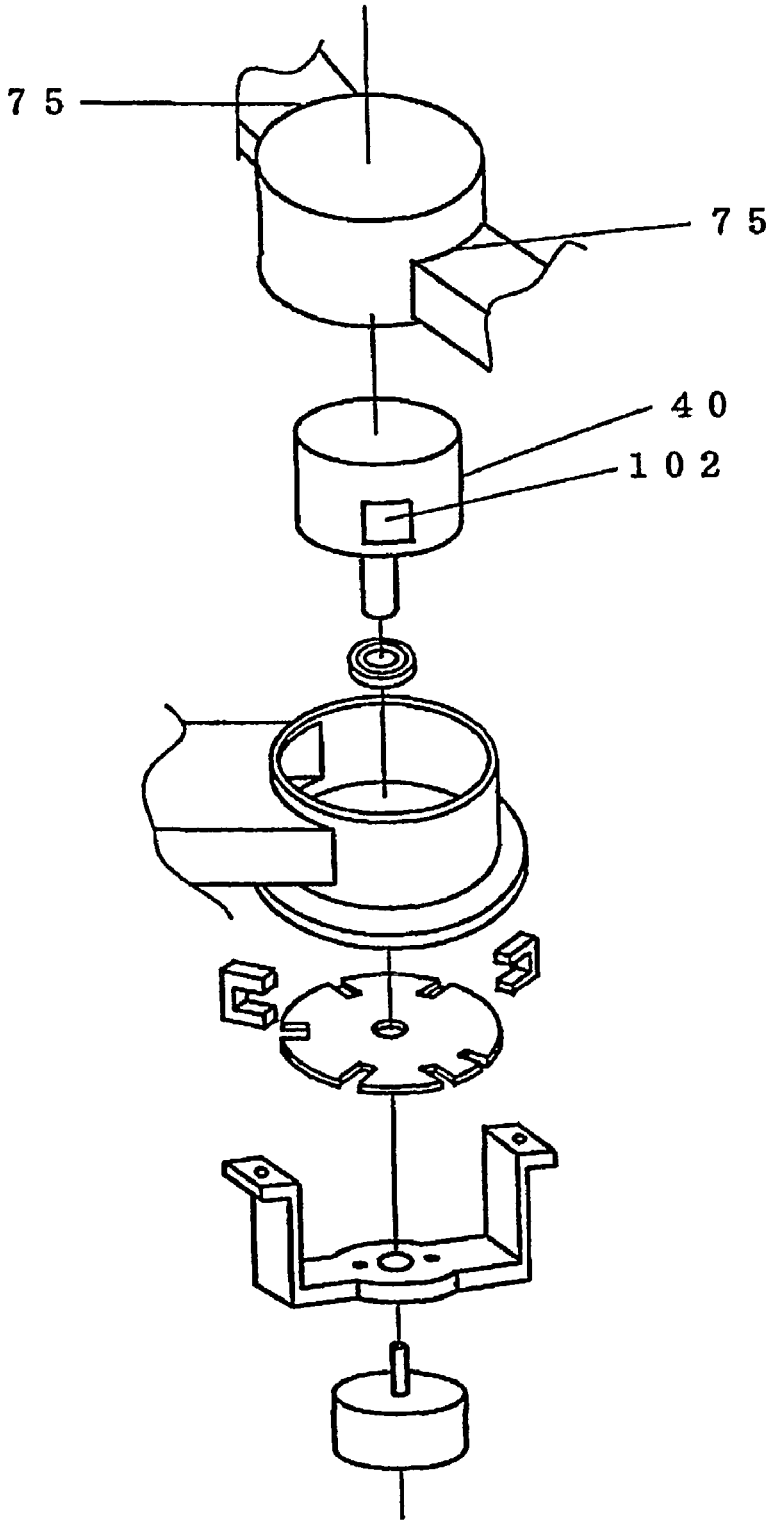
FIG. 25 is a fragmentary perspective view of a water dividing structure of the dishwasher in accordance with exemplary embodiment 8.

FIG. 24 is a fragmentary sectional view showing a double-stack rack of a dishwasher in accordance with exemplary embodiment 8. FIG. 25 is a fragmentary perspective view of a water dividing structure of the dishwasher.

The washer of exemplary embodiment 8 differs from that of exemplary embodiment 1 in the following structure.

The rack of the dishwasher comprises upper rack 121 and lower rack 122. Washing water discharged from discharge port 102 formed in rotary water dividing unit 124 is discharged to two washing nozzles; washing nozzle 72 for the upper rack and washing nozzle 73 for the lower rack. Divided water output unit 126 therefore has two divided water discharge ports 75.

Basic structures and operations of the water dividing structure in exemplary embodiment 8 are similar to those in exemplary embodiment 1. Elements of exemplary embodiment 8 similar to those in exemplary embodiment 1 have the same reference numbers, and the descriptions of these elements is omitted.

Operations and functions will be described hereinafter. As discussed above, the dishwasher of embodiment 8 has a structure in which the rack comprises the upper and lower racks and the upper and lower racks have washing nozzles 72, 73, respectively. In this structure, washing water can be sequentially sprayed from usual upper and lower washing nozzles using water dividing structure 35, and further washing nozzle 72 for the upper rack or washing nozzle 73 for the lower rack can be easily individually operated. For washing eating utensils together such as cups low in height, for example, a user sets the eating utensils into upper rack 121, pushes an upper rack washing course switch (not shown) formed on an operating unit (not shown) to select a washing course for the eating utensils in the upper rack. At this time, discharge port 102 rotates until it faces divided water discharge port 75 communicating with washing nozzle 72 for the upper rack. The washing water is sprayed from washing nozzle 72 to wash the eating utensils in upper rack 121. A water amount fed to washing tub 22 is less than that for washing the eating utensils accommodated in both the upper and lower racks. Therefore, the time required for raising washing temperature is reduced, and the washing time can be reduced.

For washing large cooking utensils such as a bowl, a pan, and a frying pan used for cooking, these cooking utensils are set into lower rack 122 capable of easily holding bulky eating utensils having large volume. A lower rack washing course switch (not shown) formed on the operating unit (not shown) is pushed to wash these cooking utensils. An operation of discharge port 102 is opposite against the operation discussed above, and discharge port 102 rotates until it faces divided water discharge port 75 communicating with washing nozzle 73 for the lower rack. The washing water is sprayed from washing nozzle 73 to wash the eating utensils in lower rack 122. Thus, water consumption is reduced and washing time can be reduced, similarly to the case of washing of the utensils in the upper rack. Power consumption is also reduced.

In embodiment 8, a washing device can be selectively operated in response to types or volume of eating utensils. The eating utensils can be concentratively and efficiently washed.

Exemplary Embodiment 9

Figure 26:
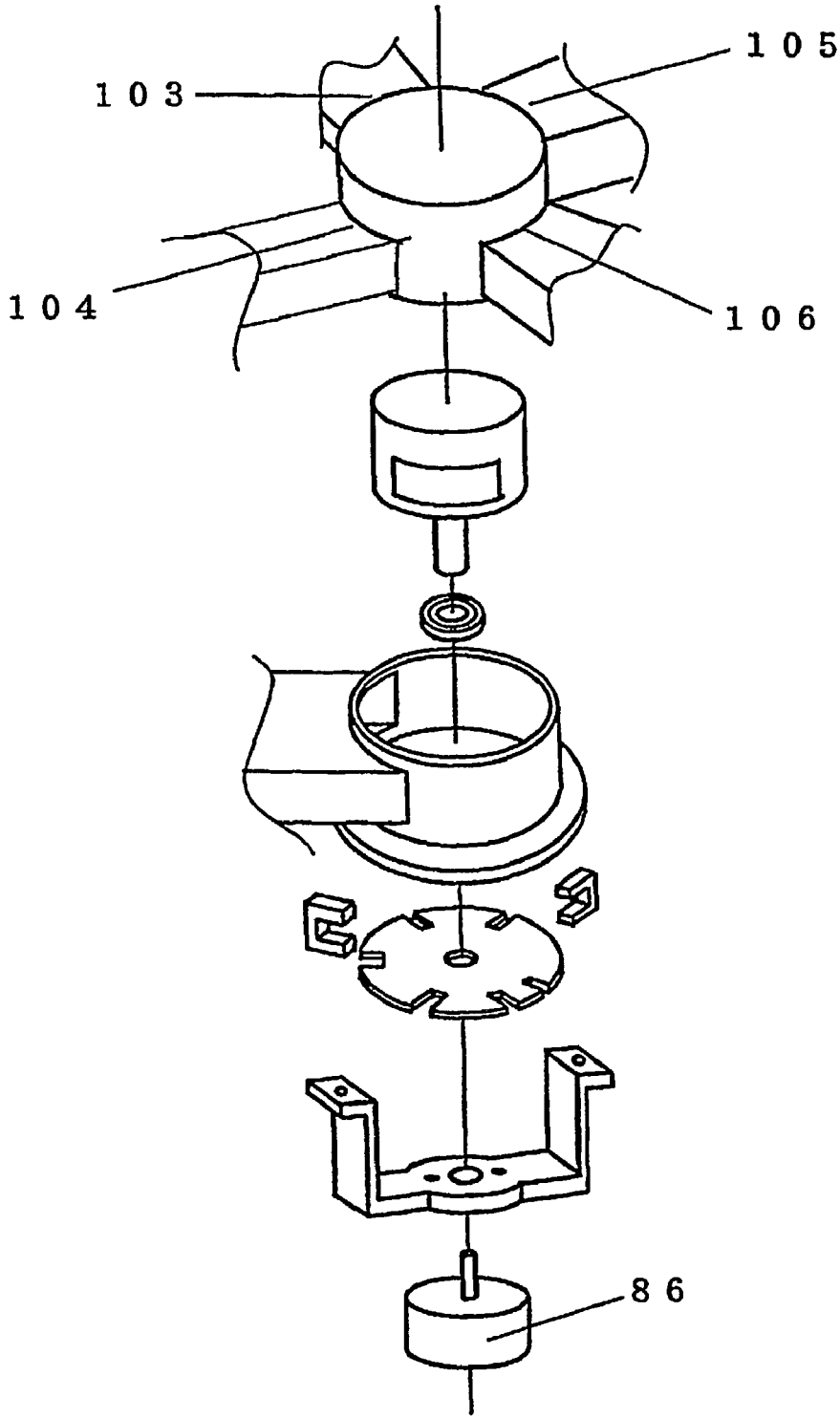
FIG. 26 is an exploded perspective view of a water dividing structure of a dishwasher in accordance with exemplary embodiment 9 of the present invention.
Figure 27:
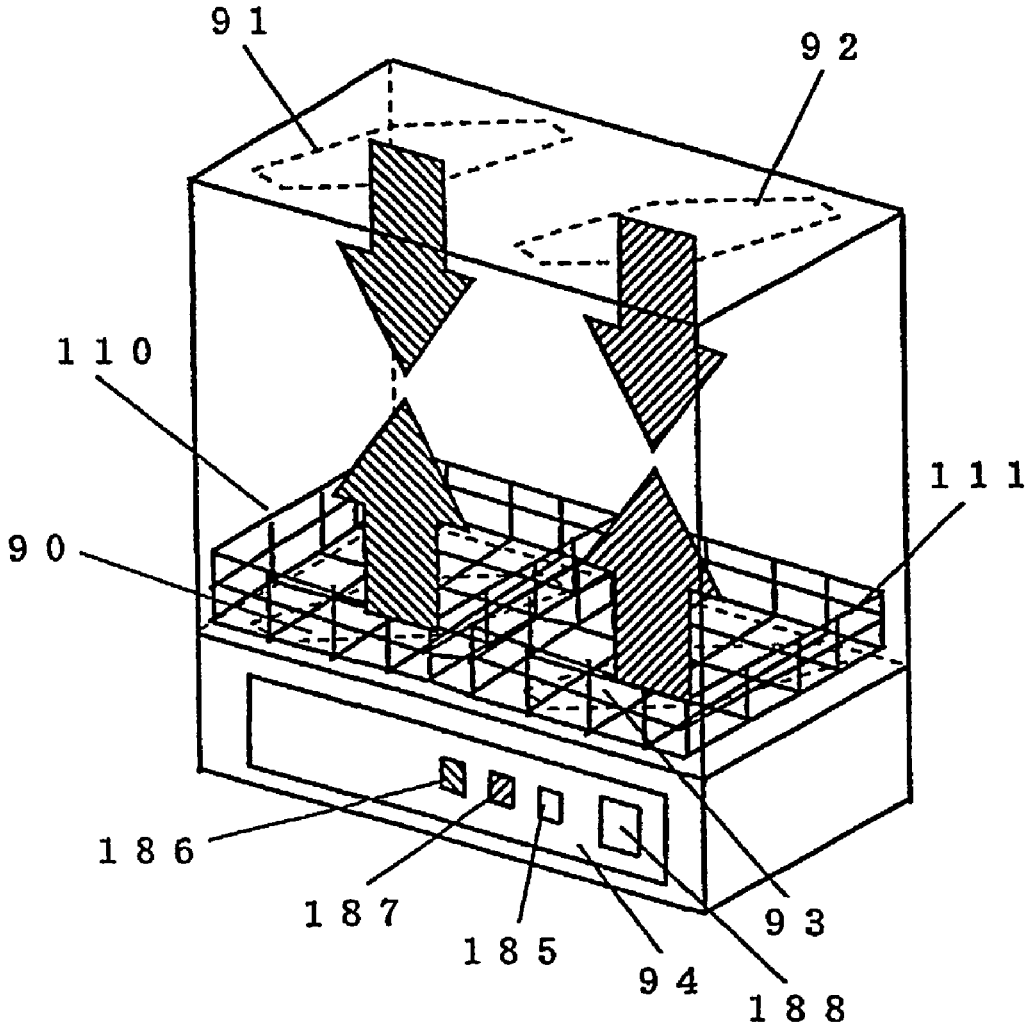
FIG. 27 is a perspective view showing spray of washing water in the dishwasher in accordance with exemplary embodiment 9.
Figure 28:
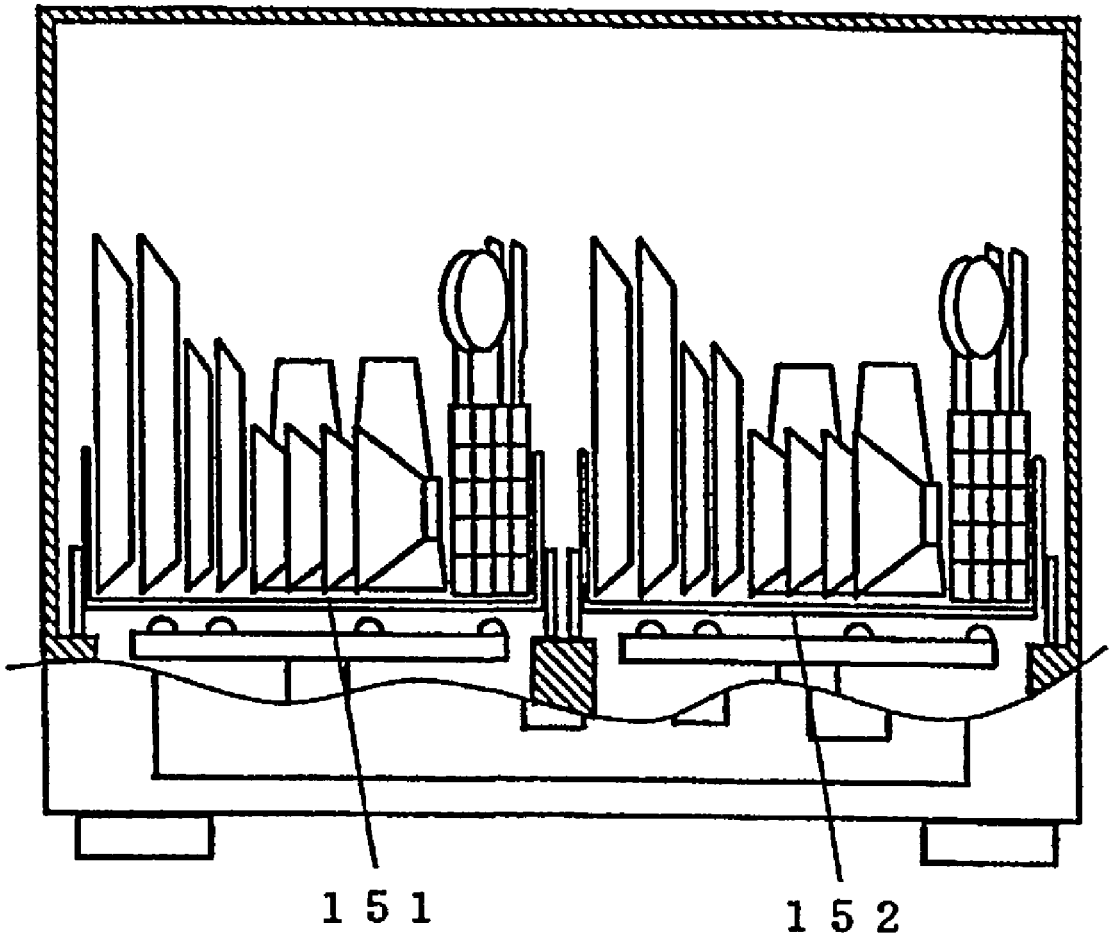
FIG. 28 is a sectional view showing a rack state in the dishwasher in accordance with exemplary embodiment 9.

FIG. 26 is an exploded perspective view of a water dividing structure of a dishwasher in accordance with exemplary embodiment 9 of the present invention. FIG. 27 is a perspective view showing spray of washing water in the dishwasher. FIG. 28 is a sectional view showing a rack state in the dishwasher.

The washer of exemplary embodiment 9 differs from that of exemplary embodiment 1 in the following structure.

A body, of which a depth is smaller than a width, includes two washing nozzles disposed in a lower part of a washing tub, and a water dividing structure, as shown in FIG. 26, FIG. 27, and FIG. 28. Thus, only utensils in left rack 110 or right rack 111 can be washed. An operation of sequentially spraying the washing water from all washing devices is performed during any washing process.

Basic structures and operations of the water dividing structure in exemplary embodiment 9 are similar to those in exemplary embodiment 1. Elements of exemplary embodiment 9 similar to those in exemplary embodiment 1 have the same reference numbers, and the descriptions of these elements is omitted.

In FIG. 26, the washing water is sprayed only to the left rack or the right rack. Driving motor 86 is formed of a direct current motor capable of rotating forwardly and reversely, and four divided water discharge ports communicating with left and right washing nozzles 90, 91, 92, 93 are formed of divided water discharge port 103 for the lower left washing nozzle 90, divided water discharge port 104 for the upper left washing nozzle 91, divided water discharge port 105 for the upper right washing nozzle 92, and divided water discharge port 106 for the lower right washing nozzle 93. For washing only utensils in the left rack 110, controller 38 controls rotary water dividing unit 40 to forwardly and reversely rotate it between divided water discharge port 103 for the lower left washing nozzle 90 and divided water discharge port 104 for the upper left washing nozzle 91. For washing only utensils in the right rack 111, controller 38 controls rotary water dividing unit 40 to forwardly and reversely rotate it between divided water discharge port 105 and divided water discharge port 106.

In FIG. 27, the washing nozzles comprise lower left washing nozzle 90, upper left washing nozzle 91, upper right washing nozzle 92, and lower right washing nozzle 93. Operating unit 94 includes operating switch 185 for making right and left washing nozzles sequentially spray the washing water, left operating switch 186 for making upper and lower washing nozzles on the left side alternately spray the washing water, right operating switch 187, and a washing course selecting switch 188 for being selected in response to dirt on the eating utensils.

In FIG. 28, washing tub 22 is provided with two racks, left rack 151 and right rack 152, and these racks can be drawn independently. Respective rack configurations of left rack 151 and right rack 152 are the same. The same volume of eating utensils having the same configuration can be set into each rack.

Functions for independently washing eating utensils accommodated in left rack 151 and right rack 152 will be firstly described. As is well known in a common home, volume of eating utensils set into a dishwasher and setting timing vary between a weekday and a holiday, or between breakfast or dinner and lunch. For example, in a conventional dishwasher, when a dinner time of a housewife and a child differs from that of another person, generally, eating utensils of the another person as the last to have dinner are set into the rack, and then a washing operation for the eating utensils of all members is started. With this method, however, the eating utensils of the housewife and the child that are firstly set into the rack are allowed to stand for a long time until the operation of the dishwasher is begun. Therefore, disadvantageously, dirt adhered to the eating utensils of the housewife and child is hardly removed, and washing quality is degraded. Another disadvantage occurs when eating utensils corresponding to a half of the number of members are set into one rack, for example, when plates are set on the left side in the rack and rice bowls are set on the right side in the rack. In other words, all washing nozzles must be operated in order to wash the eating utensils, in spite of a half volume of eating utensils.

In embodiment 9, however, a half volume of eating utensils can be washed with less fed water, so that eating utensils having dirt thereon are not allowed to stand uselessly and clearing of the table can be finished early.

When a washing operation is repeated using only part of a plurality of washing nozzles, generally, garbage or soil water partially accumulates in the non-used side of the washing tub, and therefore generates odor and is unsanitary.

In the structures described in embodiment 9 and embodiment 8, however, an operation of sequentially spraying washing water from all the washing devices is performed during a primary washing process or during a rinsing process. Therefore, even when only part of the washing devices is operated, the entire inside of the washing tub is washed with all the washing devices and thus the inside of the washing tub can be kept clean.

The function and the operating method using a plurality of racks, and the operating method of sequentially spraying washing water from all washing devices during completion of a process do not need to be wholly performed. For example, each of them may be independently performed.

Exemplary Embodiment 10

Figure 29:
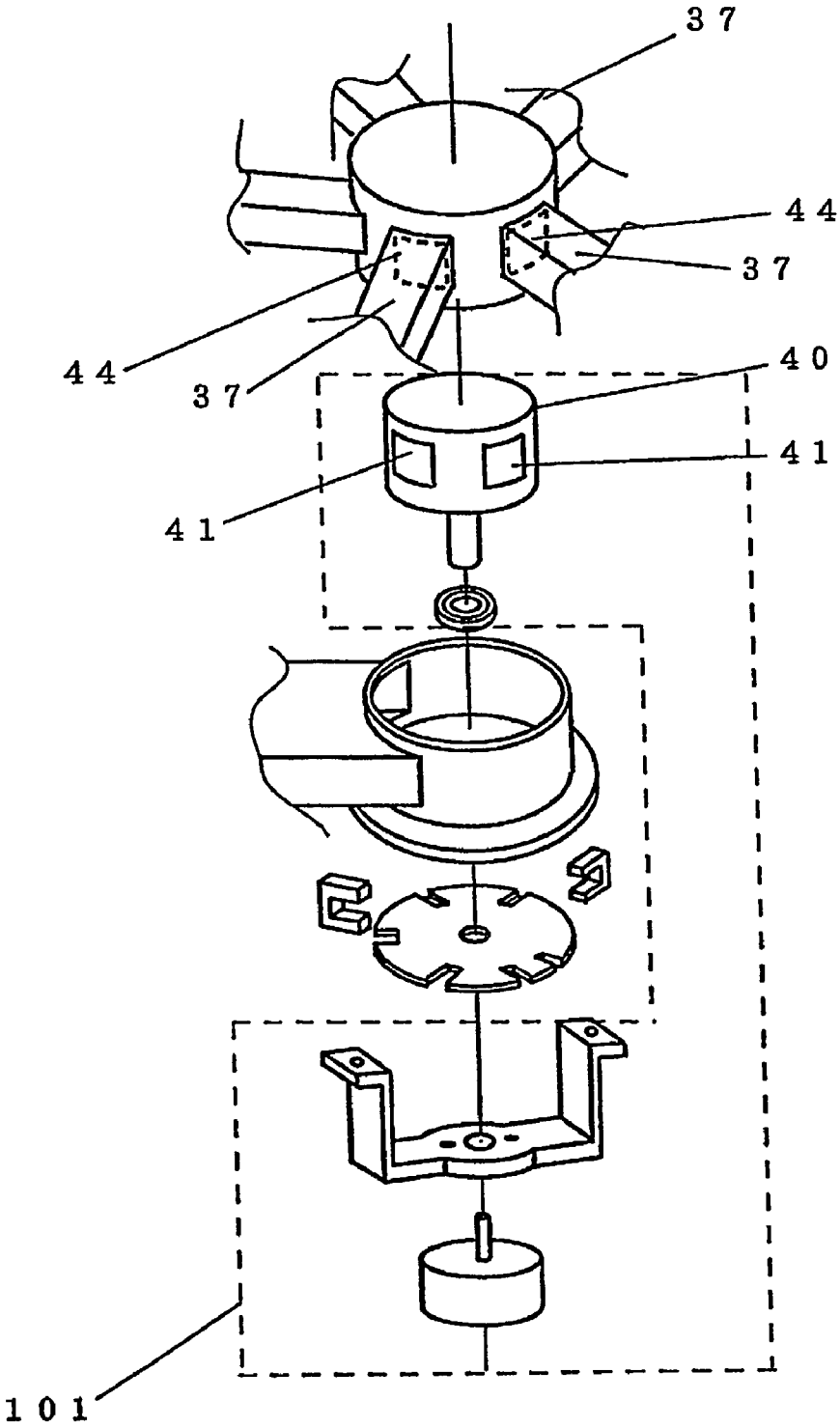
FIG. 29 is an exploded perspective view of a water dividing structure of a dishwasher in accordance with exemplary embodiment 10 of the present invention.
Figure 30:
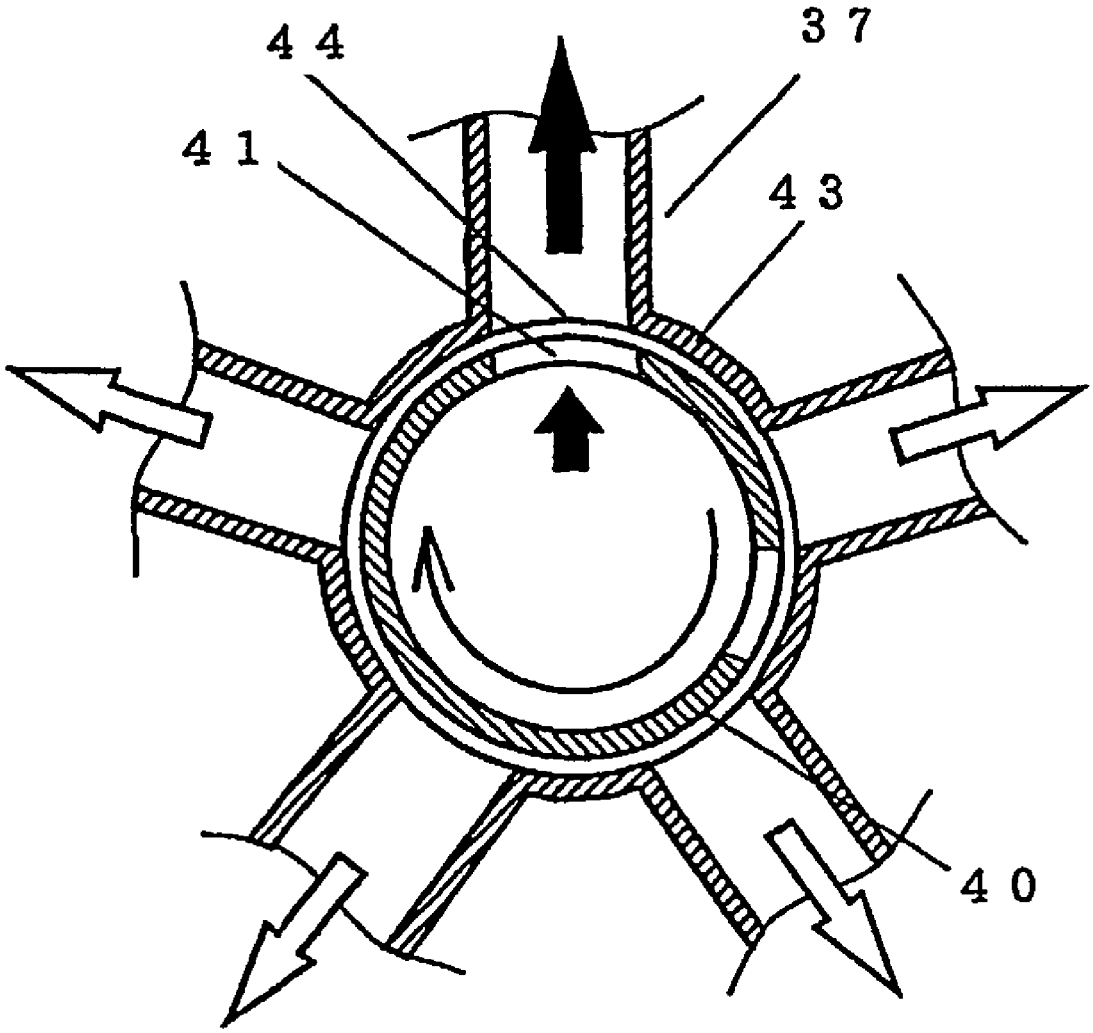
FIG. 30 is a fragmentary sectional view of a changeover unit of the dishwasher in accordance with exemplary embodiment 10.

FIG. 29 is an exploded perspective view of a water dividing structure of a dishwasher in accordance with exemplary embodiment 10 of the present invention. FIG. 30 is a fragmentary sectional view of a changeover unit of the dishwasher.

The washer of exemplary embodiment 10 differs from that of exemplary embodiment 1 in the following structure.

Two discharge ports 41 are arranged not to simultaneously match with divided water discharge ports 44, as shown in FIG. 29 and FIG. 30. A positional relationship of the discharge ports 41 and divided water discharge ports is maintained so that passage pressure loss does not occur when rotary water dividing unit 40 rotates to match discharge port 41 with a divided water discharge port 44 and washing water from discharge port 41 flows into the divided water discharge port 44.

Two discharge ports 41 are arranged on the same circumference of rotary water dividing unit 40 in embodiment 10. Two additional discharge ports 41 may be formed on a different circumference, but in this case, it is prohibited that all discharge ports 41 match with a plurality of divided water discharge ports 44. Thus, advantages are produced.

In FIG. 30, rotary water dividing unit 40 rotates to sequentially match divided water discharge ports 44 formed in a side face of the rotary water dividing unit with discharge ports 41 communicating with respective washing nozzles, and to sequentially feed the washing water to the respective washing nozzles. An effective opening area between discharge port 41 and divided water discharge port 44 continuously varies with rotating rotary water dividing unit 40. When the effective opening area is maximum, namely when one discharge port 41 matches exactly with one divided water discharge port 44, maximum flow rate is supplied to the washing nozzle. At this time, variation of the effective opening area occurs at two points. Discharge ports 41 and divided water discharge ports 44 are arranged so that the sum of the effective opening areas at two points substantially equals an area of one discharge port 41. The effective opening area determined by a relative positional relationship between discharge ports 41 and divided water discharge ports 44 is used for determining a circulated flow rate of a washing pump. The effective opening area is suppressed to a value that is derived by subtracting the area of one discharge port 41 from the area of all discharge ports 41. Thus, when there are three discharge ports 41, the discharge ports 41 are arranged so as to suppress the effective opening area to the area of about two discharge ports 41. For feeding the washing water to all washing nozzles at the same time, a large washing pump is required and the fed water must be increased. Disadvantageously, a mechanism unit is enlarged, washing time is increased, and water consumption is increased. The effective opening area depends on the number of washing nozzles, the number of discharge ports, and power of the washing pump. For reducing fed water, the effective opening area may be suppressed to a value not smaller than a value that is derived by subtracting the area of one discharge port from the area of all discharge ports.

In a conventional washer employing a plurality of washing nozzles, the washing water must be simultaneously fed to the washing nozzles, and therefore a large washing pump and much fed water are required.

In the washer in embodiment 10, however, a water dividing structure can switch between discharging passages of washing water discharged from a washing pump. Therefore, the washing pump's power and the amount of fed water required for operating a single washing nozzle can operate a plurality of washing nozzles.

As a result, the mechanism unit and products are downsized. Capacity for eating utensils is expanded, energy and water are largely saved, and operating time is reduced.

Exemplary Embodiment 11

Figure 31:
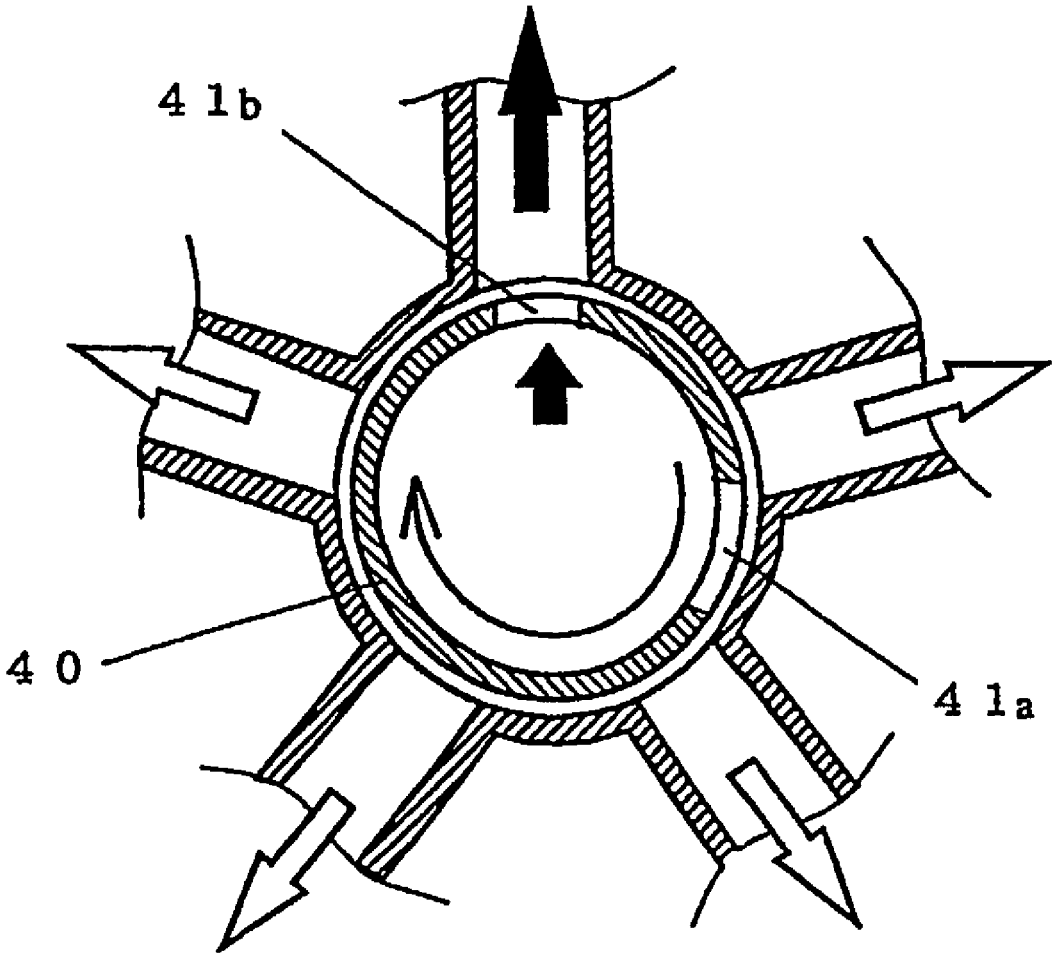
FIG. 31 is a fragmentary sectional view of a changeover unit of a dishwasher in accordance with exemplary embodiment 11 of the present invention.

FIG. 31 is a fragmentary sectional view of a changeover unit of a dishwasher in accordance with exemplary embodiment 11 of the present invention.

The washer of exemplary embodiment 11 differs from that of exemplary embodiment 1 in the following structure.

As shown in FIG. 31, the opening of one discharge port 41*a* of two discharge ports has a rectangular or substantially elliptical shape circumferentially longer than that of another discharge port 41*b*. Rotary water dividing unit 40 is rotated by driving motor 42 that simply continuously rotates at a constant speed without requiring the detection of a position or a rotational angle. Basic structures and functions for forming a water dividing structure are similar to those of exemplary embodiment 1. Elements of exemplary embodiment 11 similar to those in exemplary embodiment 1 have the same reference numbers, and the descriptions of these elements is omitted.

Operations and functions will be described hereinafter. Since a plurality of divided water discharge ports 44 have the same shape and rotary water dividing unit 40 rotates at a constant speed, spray time of the washing water by each washing nozzle for one spray increases with increasing circumferential circular arc length of the discharge port. When the washing water is discharged from two discharge ports having different circular arc lengths to respective divided water discharge ports 44, the washing water is sprayed from one washing nozzle alternately during two different spray times. Specifically, when there are many washing nozzles and discharge ports, the washing water is sprayed simultaneously from a plurality of washing nozzles, and therefore washing waters sprayed from adjacent washing nozzles interfere with each other to degrade washing performance. That is, when the washing waters collides with each other before collision of the washing waters with eating utensils, washing energy applied to dirt adhered to the eating utensils is reduced. When a washing water flow collides with a washing water flow on an eating utensil for rinsing garbage, rinsing performance is reduced. Degradation of washing performance thus occurs.

In exemplary embodiment 11, however, spray timings of washing waters from respective washing nozzles can be arbitrarily staggered. The washing waters sprayed from respective washing nozzles can therefore be prevented from interfering with each other, and degradation of washing performance, which disadvantageously occurs during a simultaneous washing method of multi washing nozzles, can be extensively reduced. Stable and high washing performance, energy saving, and speedy washing can be realized.

The driving motor of the rotary water dividing unit continuously operates in embodiment 11, so that the speed of the driving motor does not need be varied and a detecting unit for a position of a feeding/discharging passage is not required. This simplifies the structure and reduces cost.

Exemplary Embodiment 12

Figure 32:
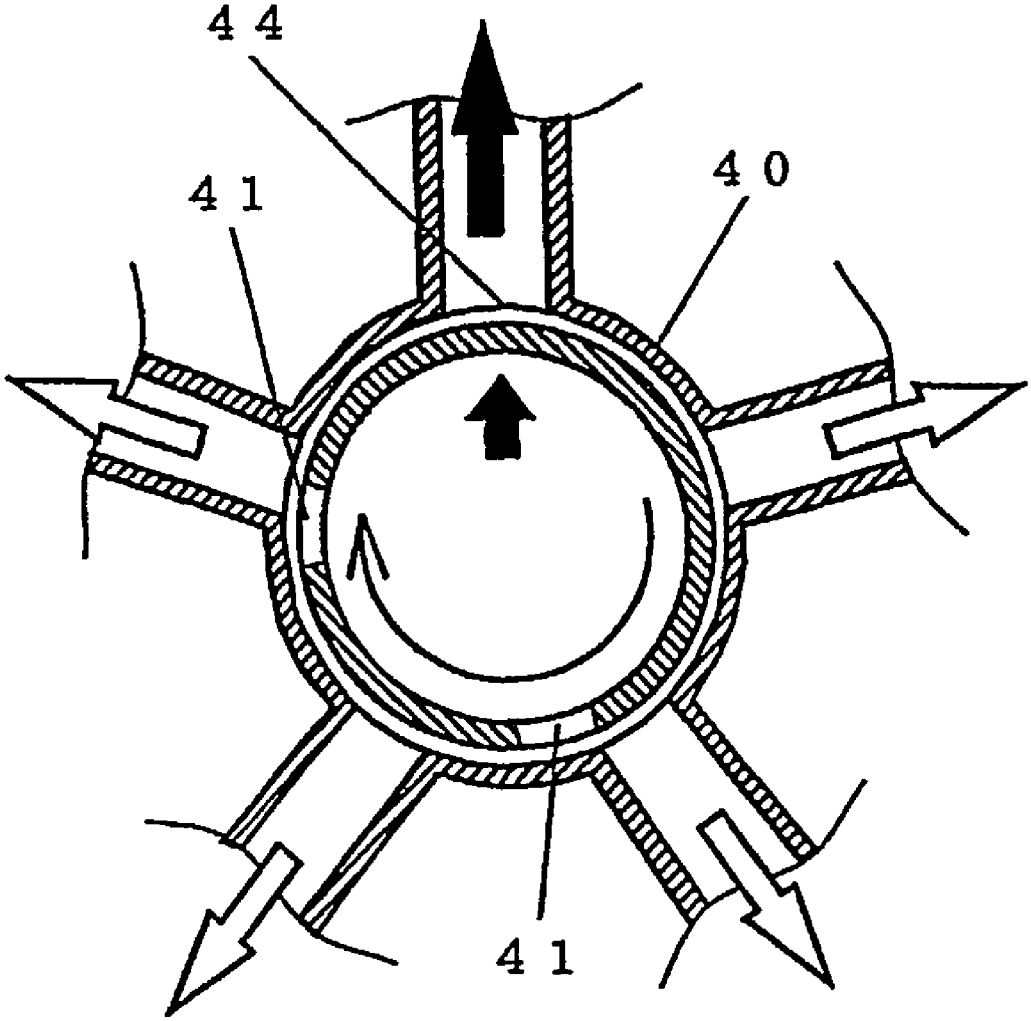
FIG. 32 is a fragmentary sectional view of a changeover unit of a dishwasher in accordance with exemplary embodiment 12 of the present invention.

FIG. 32 is a fragmentary sectional view of a changeover unit of a dishwasher in accordance with exemplary embodiment 12 of the present invention.

The washer of exemplary embodiment 12 differs from that of exemplary embodiment 10 in the following structure.

As shown in FIG. 32, discharge ports are arranged in a rotary water dividing unit so that any one of washing devices discharges washing water. Basic structures and operations of the water dividing structure are similar to those in exemplary embodiment 1. Elements of exemplary embodiment 12 similar to those in exemplary embodiment 1 have the same reference numbers, and the description of these elements is omitted.

Operations and functions will be described hereinafter. During an operation in which rotary water dividing unit 40 is rotated to direct the washing water discharged from washing pump 28, a plurality of discharge ports 41 always communicate with one divided water discharge port 44, and the washing water is not simultaneously discharged to the washing passages. The washing water is always sprayed from one place while the plurality of washing nozzles are sequentially switched. Washing pump 28 requires power for dashing water corresponding to only one discharge port 41, though washing pump 28 has the plurality of washing nozzles and discharge port 41. When a small washing pump with a small flow rate can be used, fed water reserved in washing tub 22 can be reduced. The reduction of the flow quantity can further shorten warming time of the washing water. Energy saving, speedy washing, and water saving can be realized. The washing pump can be downsized, so that a space of a mechanism unit in a body can be reduced and therefore a dishwasher having expanded washing capacity is obtained. A body dimension is reduced. The downsizing of the body improves the installing ability that most severely disturbs the spread of dishwashers.

Washing energy, namely the product of discharge pressure and discharge flow quantity, in embodiment 12 is less than that in embodiment 1. However, the fed water of the washer in embodiment 12 can be reduced greater than that of the washer in embodiment 1. Therefore, the warming time of the washing washer in the washer in embodiment 12 is shortened, more thermal energy can be applied to eating utensils, and thus high washing performance can be maintained.

Exemplary Embodiment 13

Figure 33:
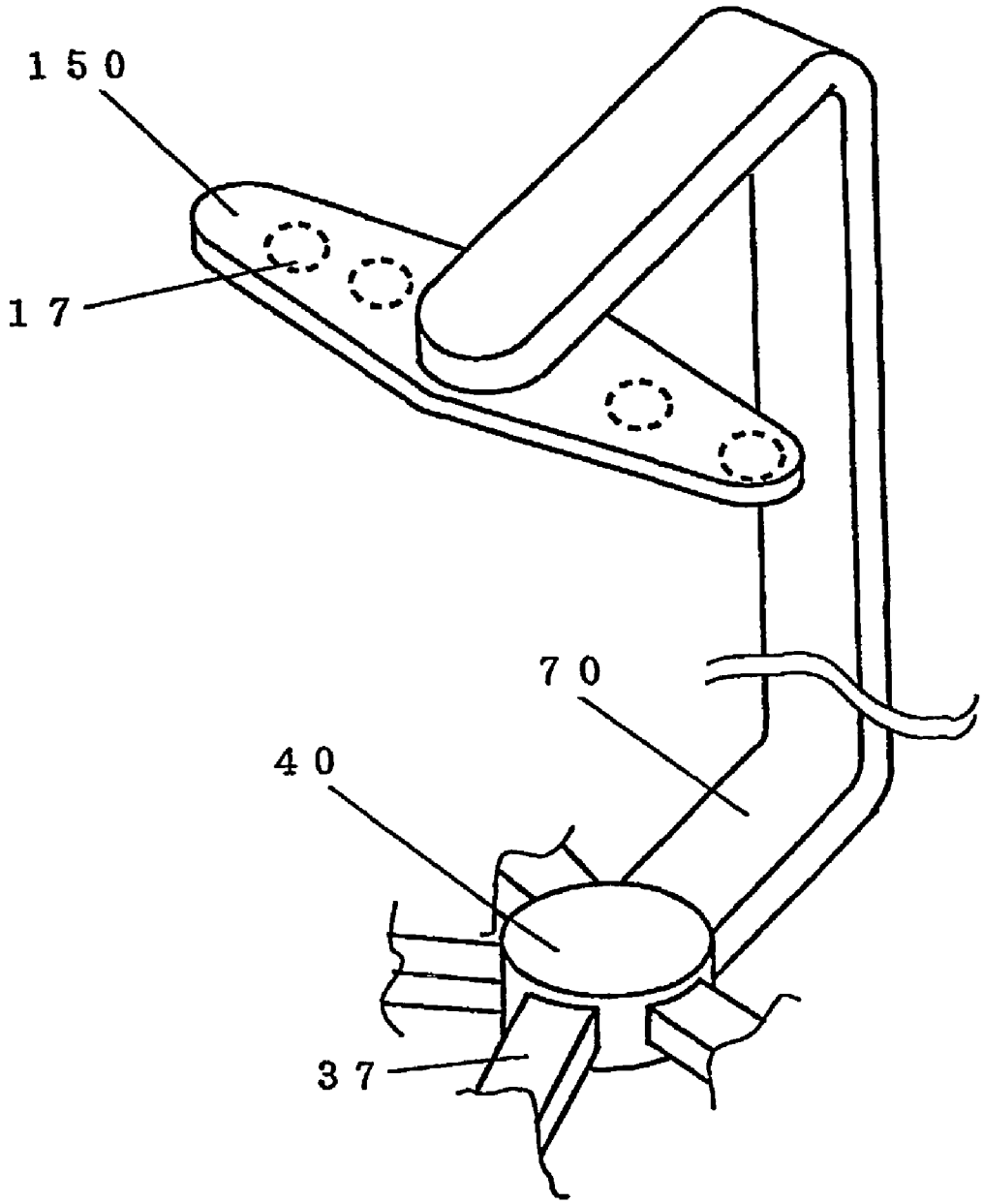
FIG. 33 is a fragmentary perspective view of a changeover unit of a dishwasher in accordance with exemplary embodiment 13 of the present invention.
Figure 34:
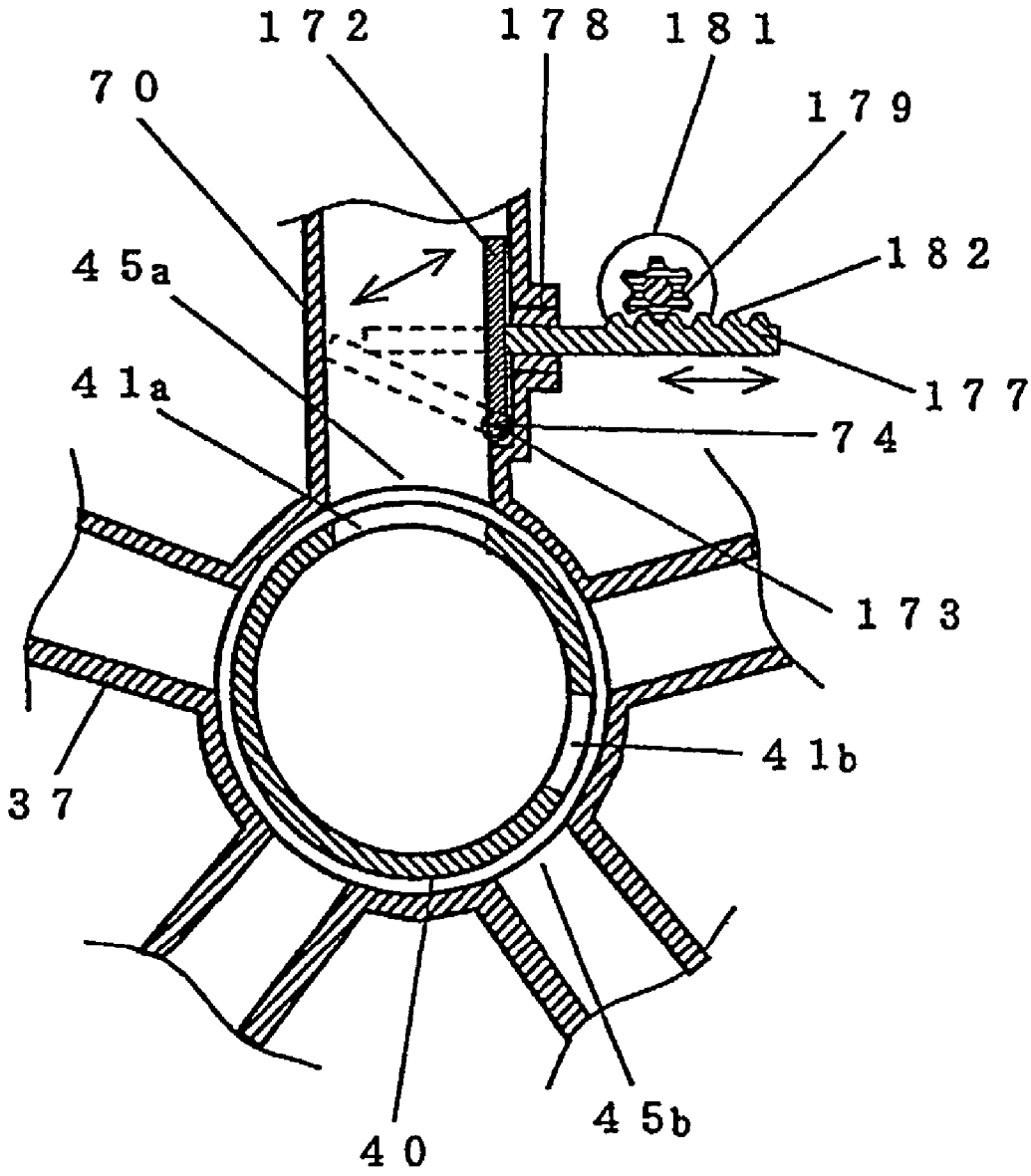
FIG. 34 is a sectional view of a passage varying device of the dishwasher in accordance with exemplary embodiment 13.

FIG. 33 is a fragmentary perspective view of a changeover unit of a dishwasher in accordance with exemplary embodiment 13 of the present invention. FIG. 34 is a sectional view of a passage varying device of the dishwasher The washer of exemplary embodiment 13 differs from that of exemplary embodiment 10 in the following structure.

As shown in FIG. 33 and FIG. 34, discharge ports in rotary water dividing unit 40 are rectangular, and have two types of openings: normal type discharge port 41*b* and horizontally long type discharge port 41*a*. Divided water discharge ports also have two types of openings; normal type divided water discharge port 45*b* and horizontally long type divided water discharge port 45*a*. Washing/discharging passage 70 communicating with horizontally long type divided water discharge port 45*a* and spray port 17 of washing nozzle 150 have a larger cross sectional area than that of feeding/discharging passage 37. A passage varying device for varying passage cross sectional area is disposed in washing/discharging passage 70 of divided water output unit 43. Variable valve 172 is turnably disposed in washing/discharging passage 70. Spring 74 disposed on turning shaft 173 of variable valve 172 presses variable valve 172 against an inner wall of washing/discharging passage 70. Rod 177 has a function of pressing variable valve 172. Rod 177 is slidably mounted on a wall face of washing/discharging passage 70 via oil seal 178. Rod 177 linearly slides between pinion 179 disposed on rod 177 and rack 182 mounted on rod driving motor 181, thereby varying the passage cross sectional area. A turning angle of variable valve 172 is detected by detecting an initial position and a stroke of rod 177.

Variable valve 172, turning shaft 173, spring 74, rod 177, oil seal 178, pinion 179, rod driving motor 181, and rack 182 constitute the passage varying device. For moving the rod, a mechanism for moving the rod with a solenoid coil, an air pump, a fluid pump, or a cam is used (not shown).

Basic structures and functions for forming a water dividing structure are similar to those of exemplary embodiment 1. Elements of exemplary embodiment 13 similar to those in exemplary embodiment 1 have the same reference numbers, and the descriptions of these elements is omitted.

Operations and functions will be described hereinafter. Spray time of washing water from a washing device, spray pressure, and spray flow quantity can be variously changed with a matching manner between each discharge port and each divided water discharge port. For example, when washing nozzle 88 communicating with normal opening type divided water discharge port 45*b* overlaps on with normal opening type discharge port 41*b*, washing water is sprayed at normal pressure A1 and normal flow quantity B1 and for a spray time C1. Next, when washing nozzle 88 overlaps with horizontally long type discharge port 41*a*, the washing water is sprayed at normal pressure A1 and normal flow quantity B1 and for spray time C2 that is longer in accordance with the horizontally long length.

When washing nozzle 189 with a large flow rate communicating with horizontally long type divided water discharge port 45*a* overlaps on normal opening type discharge port 41*b*, washing water is sprayed at slightly low pressure A2 and normal flow quantity B1 and for spray time C2. Next, when washing nozzle 189 overlaps on horizontally long type discharge port 41*a*, the washing water is sprayed at low pressure A3 and large flow quantity B2 for a greater spray time C3. In other words, A1>A2>A3, B1<B2, and C1<C2<C3.

A washing time of a specific washing device can therefore be set longer than usual. Advantages are produced when washing stubborn dirt such as a grain of rice. Spray of the washing water at the low pressure but large flow rate is highly effective for rinsing garbage attached to eating utensils. When the washing water is sprayed from the upper part of washing tub 22, the washing effect is further improved. Variation of the discharge pressure or discharge flow quantity causes change of the flow rate or the spray angle of the washing device. A dishwasher for washing eating utensils more widely and highly efficiently is obtained.

When few eating utensils are washed, a passage varying device is perfectly closed to stop the spray from part of the washing device. At this time, spray time of the other washing devices increases. Therefore, high washing performance can be exhibited for a shorter time.

When eating utensils having stubborn dirt are washed, high-pressure washing is effective. The passage varying means is narrowed to allow the spray of high-pressure washing water. Therefore, speedy washing is allowed. A dishwasher that changes a washing method in response to quantity and quality of the dirt adhered to eating utensils is thus obtained.

Discharge ports or feeding/discharging passages described in embodiment 13 may have a substantially rectangular, circular, or elliptical cross section, or a combination of these shapes. Such structure can produce similar advantages. The structure in which the feeding/discharging passages have a passage changeover unit has been described in embodiment 13, but the present invention is not limited to this. The passage changeover unit may be disposed in a divided water discharge unit to vary an opening area of the divided water discharge ports. This produces a similar advantages. Opening shapes of the divided water discharge ports and the passage varying device do not need to be realized integrally. For example, elements can be independently formed. The washing nozzle for washing a hard-to-wash grain of rice is set to discharge the washing water for a longer time than the other washing nozzles, thereby shortening washing time.

Exemplary Embodiment 14

Figure 35:
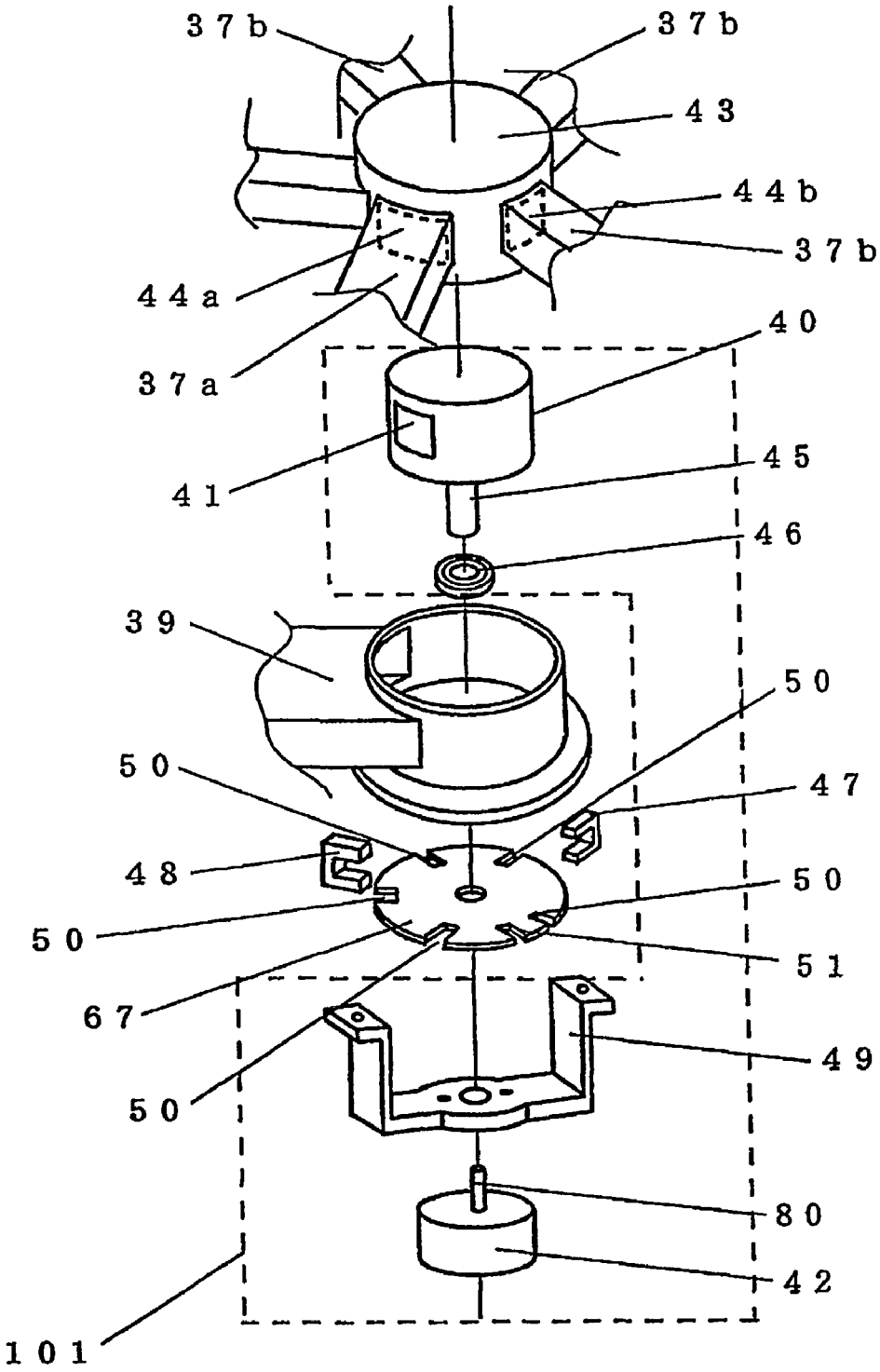
FIG. 35 is a perspective view of a changeover unit of a dishwasher in accordance with exemplary embodiment 14 of the present invention.
Figure 36:
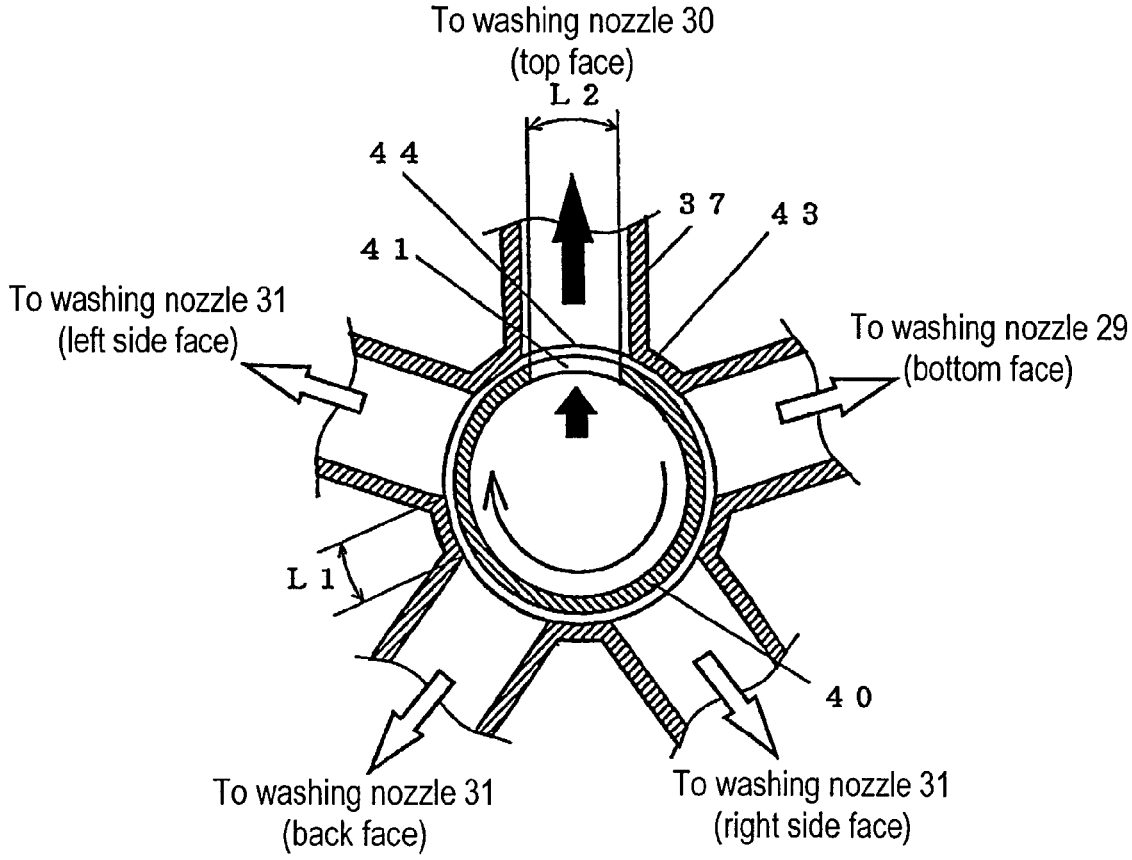
FIG. 36 is a fragmentary sectional view of the changeover unit of the dishwasher in accordance with exemplary embodiment 14.
Figure 36:
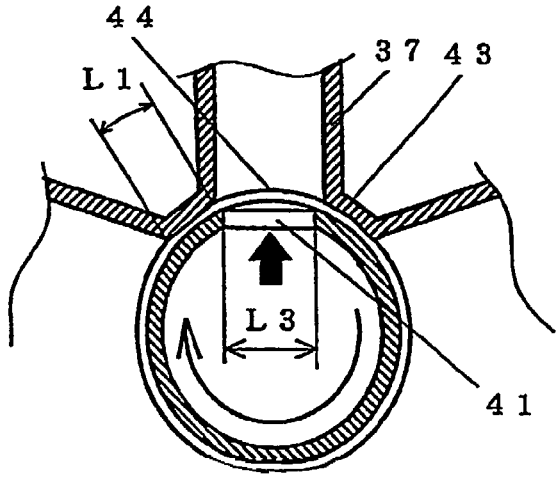
Figure 37:
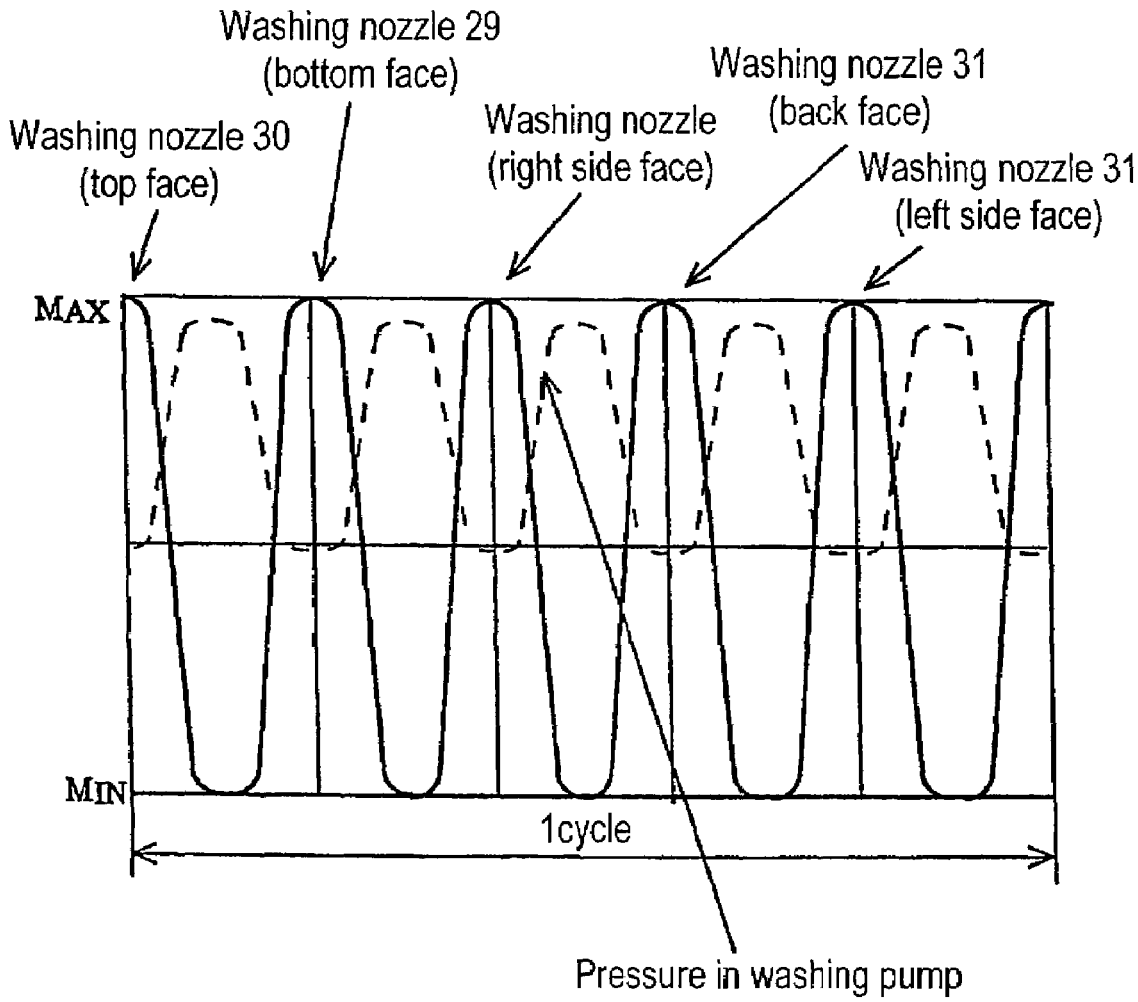
FIG. 37 is a graph showing variation in discharge pressure of each washing nozzle and a washing pump per cycle of a rotary water dividing unit of the dishwasher in accordance with exemplary embodiment 14.

FIG. 35 is a perspective view of a changeover unit of a dishwasher in accordance with exemplary embodiment 14 of the present invention. FIG. 36 is a fragmentary sectional view of the changeover unit of the dishwasher. FIG. 37 is a graph showing variation in discharge pressure of each washing nozzle and a washing pump per cycle of a rotary water dividing unit of the dishwasher.

The washer of exemplary embodiment 14 differs from that of exemplary embodiment 1 in the following structure.

As shown in FIG. 35, FIG. 36, and FIG. 37, divided water discharge ports 44 and feeding/discharging passages 37 communicating with them have two types of combinations having different passage cross sectional areas. A passage cross sectional area of a first combination of first divided water discharge port 44*a* and first feeding/discharging passage 37*a* communicating with it is larger than an opening area of discharge port 41. This passage cross sectional area is further larger than passage cross section area of the other four combinations of second divided water discharge ports 44*b* and second feeding/discharging passages 37*b* communicating with them. When rotary water dividing unit 40 rotates to match discharge port 41 with first divided water discharge port 44*a*, they maintain such a positional relationship such that passage pressure loss does not occur when washing water from discharge port 41 flows into divided water discharge port 44*a*. Only one first divided water discharge port 44*a* has an opening area larger than that of discharge port 41 in embodiment 14, but the present invention is not limited to this. Two, three, or all of the other divided water discharge ports 44 may have an opening area larger than that of discharge port 41. This case also produces similar advantages.

In FIG. 36, rotary water dividing unit 40 rotates to sequentially match divided water discharge ports 44 formed in its side face to with discharge port 41 communicating with each washing nozzle, thereby sequentially feeding the washing water to each washing nozzle. FIG. 36 shows a structure where discharge port 41 is formed in a cylindrical side face of rotary water dividing unit 40 and a structure where discharge port 41 is formed in a planar part formed on the cylindrical side face. When discharge port 41 is formed in the cylindrical side face of rotary water dividing unit 40, circumferential direction length L2 of discharge port 41 is equal to or longer than circular arc length L1 between adjacent divided water discharge ports 44. When discharge port 41 is formed in the planar part disposed on the cylindrical side face of rotary water dividing unit 40, length L3 of discharge port 41 is equal to or longer than circular arc length L1. This point is different from that of embodiment 1.

FIG. 37 shows variation in spray force of each washing nozzle and discharge pressure of washing pump 28 for one rotation of rotary water dividing unit 40.

Basic structures and functions for forming a water dividing structure are similar to those of exemplary embodiment 1. Elements of exemplary embodiment 14 similar to those in exemplary embodiment 1 have the same reference numbers, and the descriptions of these elements is omitted.

Operations and functions of water dividing structure 35, namely a characteristic structure of exemplary embodiment 14, will be described hereinafter. The washing water pressurized by washing pump 28 firstly flows through aqueduct 39 and discharges from discharge port 41 formed in rotary water dividing unit 40. At this time, rotary water dividing unit 40 is continuously rotated at a low speed by driving motor 42, and the opening position of discharge port 41 sequentially matches with the opening positions of five divided water discharge ports 44. When the opening positions match with each other, the washing water is fed through respective feeding/discharging passages 37 to washing nozzle 29 (lower face), a washing nozzle for the right side face (not shown), washing nozzle 31 (back face), washing nozzle 32 (left side face), and washing nozzle 30 (top face), sequentially. Since divided water discharge port 44*a* and feeding/discharging passage 37*a* have the passage cross sectional area, which is larger than the opening area of discharge port 41, passage pressure loss caused by switching between washing water directions can be reduced. Therefore, a smaller washing pump can be used. Therefore, energy consumption, noise, and cost can be reduced.

Since circumferential length L2 of discharge port 41 is equal to or more than circular arc length L1 between adjacent divided water discharge ports 44, discharge port 41 certainly matches with any divided water discharge port 44 wherever discharge port 41 lies during the rotation of rotary water dividing unit 40. Therefore, a problem in that no washing nozzle discharges the washing water is prevented. The washing pump is prevented from being closed, thereby mitigating pressure rising of each part in the feeding/discharging passage, preventing the washing water from leaking out of the dishwasher through a seal part or a joint part, and improving durability.

The opening area and the opening length of the divided water discharge port described in embodiment 14 do not need to be wholly realized, and the elements can be independently formed.

Exemplary Embodiment 15

Figure 38:
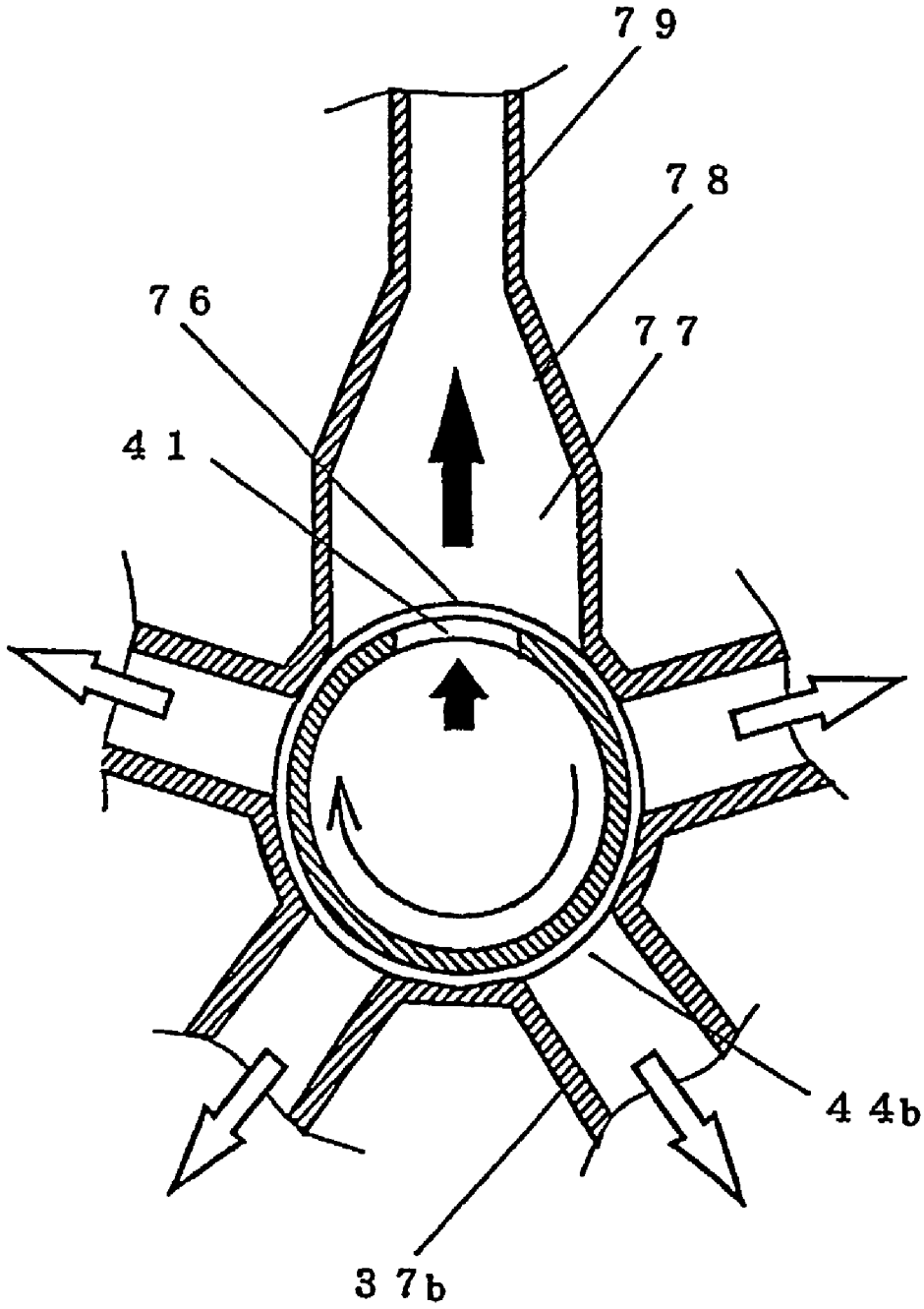
FIG. 38 is a sectional view of a water dividing structure of a dishwasher in accordance with exemplary embodiment 15 of the present invention.
Figure 39:
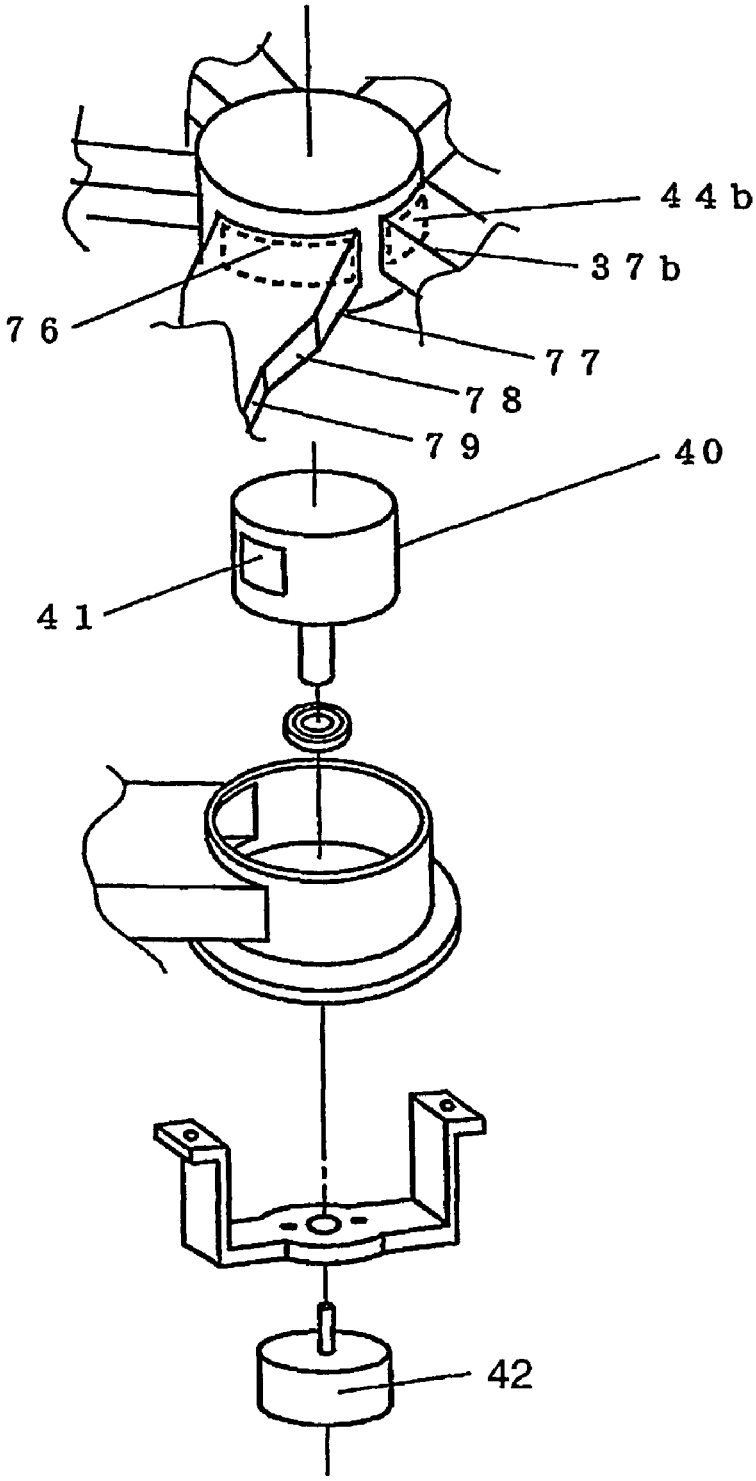
FIG. 39 is an exploded perspective view of the water dividing structure of the dishwasher in accordance with exemplary embodiment 15.

FIG. 38 is a sectional view of a water dividing structure of a dishwasher in accordance with exemplary embodiment 15 of the present invention. FIG. 39 is an exploded perspective view of the water dividing structure of the dishwasher.

The washer of exemplary embodiment 15 differs from that of exemplary embodiment 14 in the following structure.

As shown in FIG. 38 and FIG. 39, divided water discharge port 76 has a rectangular shape circumferentially longer than that of discharge port 41. First feeding/discharging passage 77 comprises two passages: passage 78 having a cross sectional area that changes from a cross sectional area of first divided water discharge port 76 to that of second feeding/discharging passage 37*b*; and passage 79 having a cross sectional area equal to that of second divided water discharge ports 44*b*. Rotary water dividing unit 40 is rotated by driving motor 42 that simply continuously rotates at a constant speed without requiring the detection of a position or a rotational angle. Basic structures and functions for forming a water dividing structure are similar to those of exemplary embodiment 1. Elements of exemplary embodiment 15 similar to those in exemplary embodiment 1 have the same reference numbers, and the descriptions of these elements is omitted.

Operations and functions will be described hereinafter. Since rotary water dividing unit 40 is rotated at a constant speed, spray time of washing water by each washing nozzle for one spray increases with increasing circumferential circular arc length of the divided water discharge port. First divided water discharge port 76 has a rectangular shape circumferentially longer than that of discharge port 41. Therefore, the spray time of the washing nozzle associated with divided water discharge port 76 is longer than those of the other washing nozzles.

The washing nozzle for washing out a conventionally hard-to-wash grain of rice is set to discharge the washing water for a longer time than those of the other washing nozzles, thereby shortening the washing time. For performing the operation discussed above, conventionally, there has been problems related to volume and cost. For example, speed of the driving motor for rotating the rotary water dividing unit must be varied and a detecting unit for detecting positions of the feeding/discharging passages is required. However, the washer of embodiment 15 does not require these elements. A simple and inexpensive washer is therefore obtained.

Since passage 78 having a cross section that changes from a cross section of first divided water discharge port 76 to that of second feeding/discharging passage 37*b* is provided, expansion of the passage can be prevented from increasing circulated washing water. Therefore, reduction of fed water allows shortening of warming time, and washing time and energy consumption can be reduced.

The discharge port or the feeding/discharging passages described in embodiment 15 may have a substantially rectangular, circular, or elliptical cross section, or combination of these shapes. Any shape can produce a similar advantages. The opening shape of the first rotary water dividing unit and a variable passage discussed in embodiment 15 do not need to be wholly realized, and the elements can be independently formed.

Exemplary Embodiment 16

Figure 40:
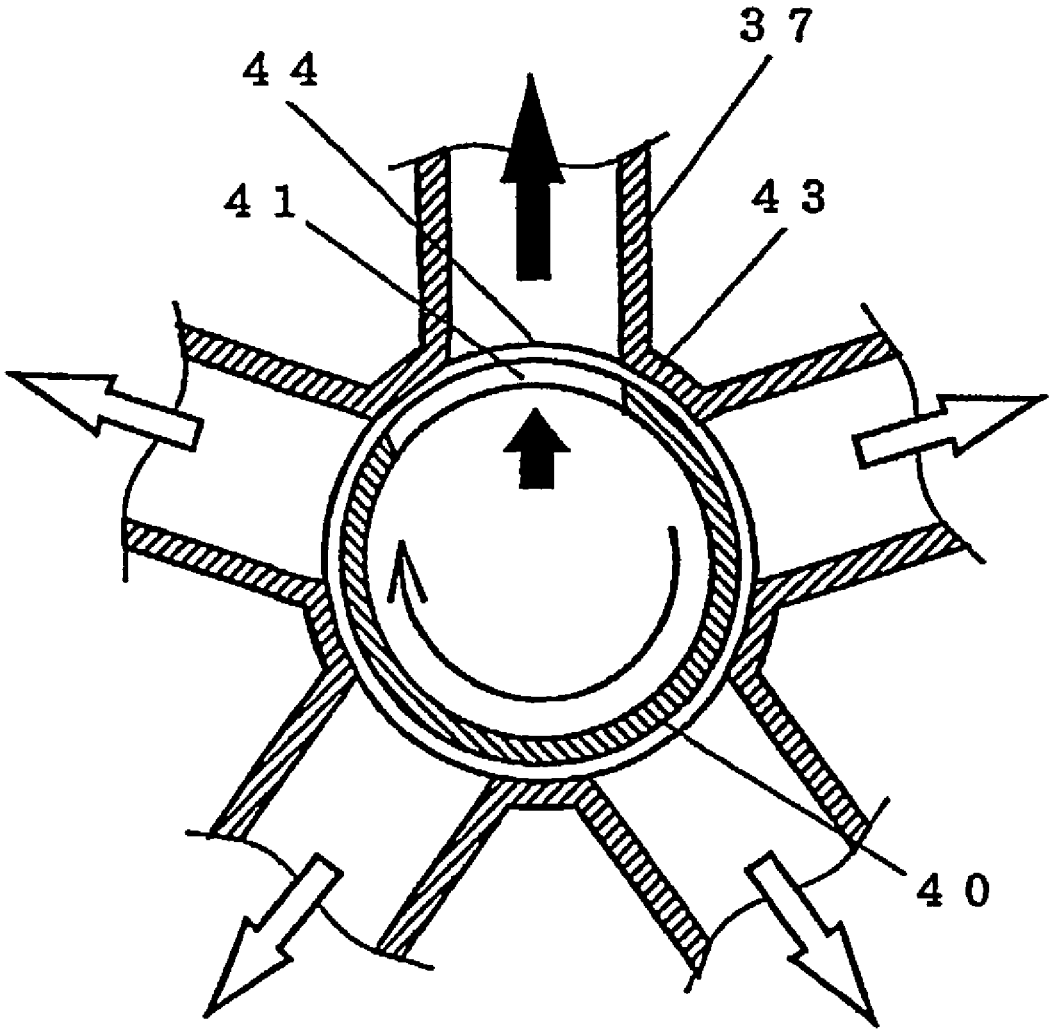
FIG. 40 is a fragmentary sectional view of a changeover unit of a dishwasher in accordance with exemplary embodiment 16 of the present invention.
Figure 41:
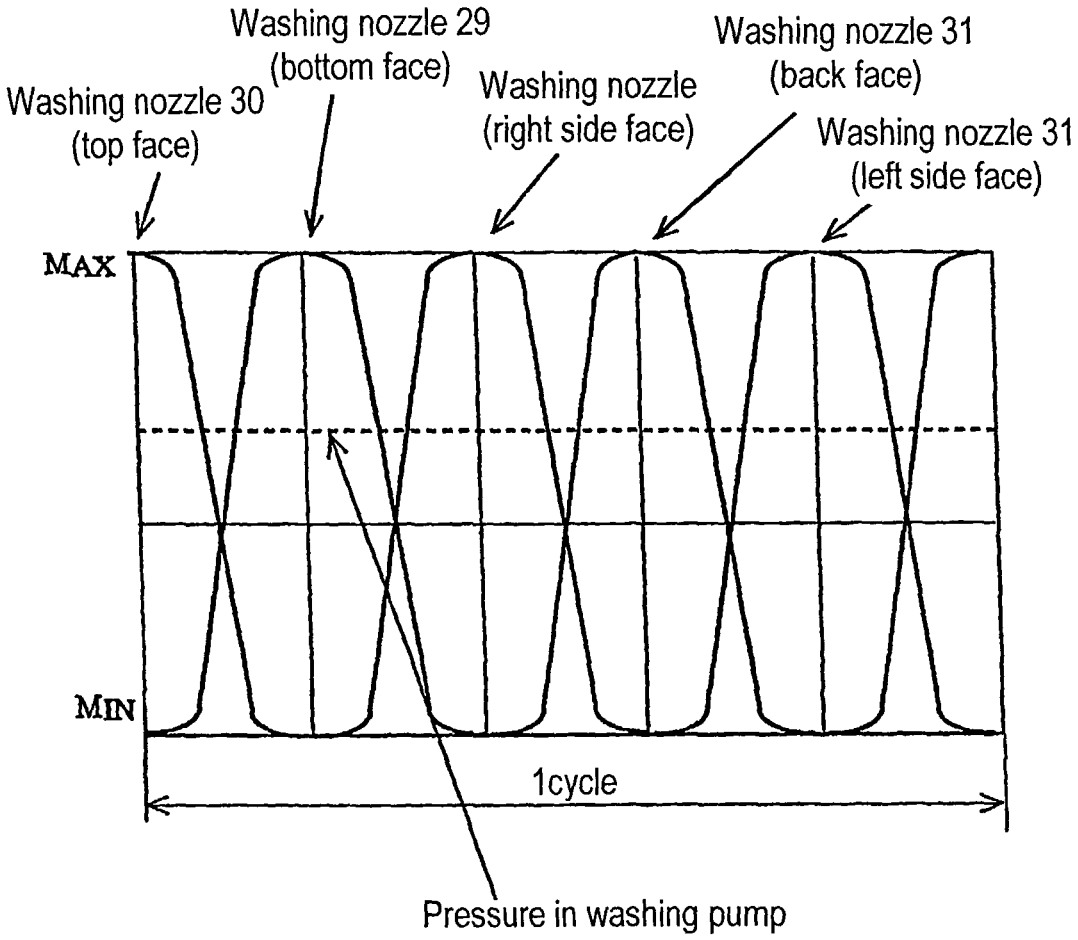
FIG. 41 is a graph showing variation in discharge pressure of each washing nozzle and a washing pump per cycle of a rotary water dividing unit of the dishwasher in accordance with exemplary embodiment 16.

FIG. 40 is a fragmentary sectional view of a changeover unit of a dishwasher in accordance with exemplary embodiment 16 of the present invention. FIG. 41 is a graph showing variation in discharge pressure of each washing nozzle and a washing pump per cycle of a rotary water dividing unit of the dishwasher.

The washer of exemplary embodiment 16 differs from that of exemplary embodiment 1 in the following structure.

As shown in FIG. 40, circumferential direction length of discharge port 41 is equal to or longer than the sum of circular arc length of divided water discharge port 44 and circular arc length between divided water discharge ports 44. Basic structures and functions for forming a water dividing structure are similar to those of exemplary embodiment 1. Elements of exemplary embodiment 16 similar to those in exemplary embodiment 1 have the same reference numbers, and the descriptions of these elements is omitted.

In embodiment 16, during the rotation of rotary water dividing unit 40, a feeding/discharging passage having an area equal to the opening area of discharge port 41 can be secured wherever discharge port 41 lies. Because only steady load is applied to washing pump 28 as shown in FIG. 40, a circulated washing water amount discharged from a washing pump can always be kept constant. Therefore, pressure applied to a connection part or a seal part in the feeding/discharging passage is prevented from varying, and endurance reliability is prevented from being degraded. Individual washing energy discharged from each washing device varies periodically, but the entire washing system can always apply constant washing energy to eating utensils. Therefore, the eating utensils can be washed efficiently.

Exemplary Embodiment 17

Figure 42:
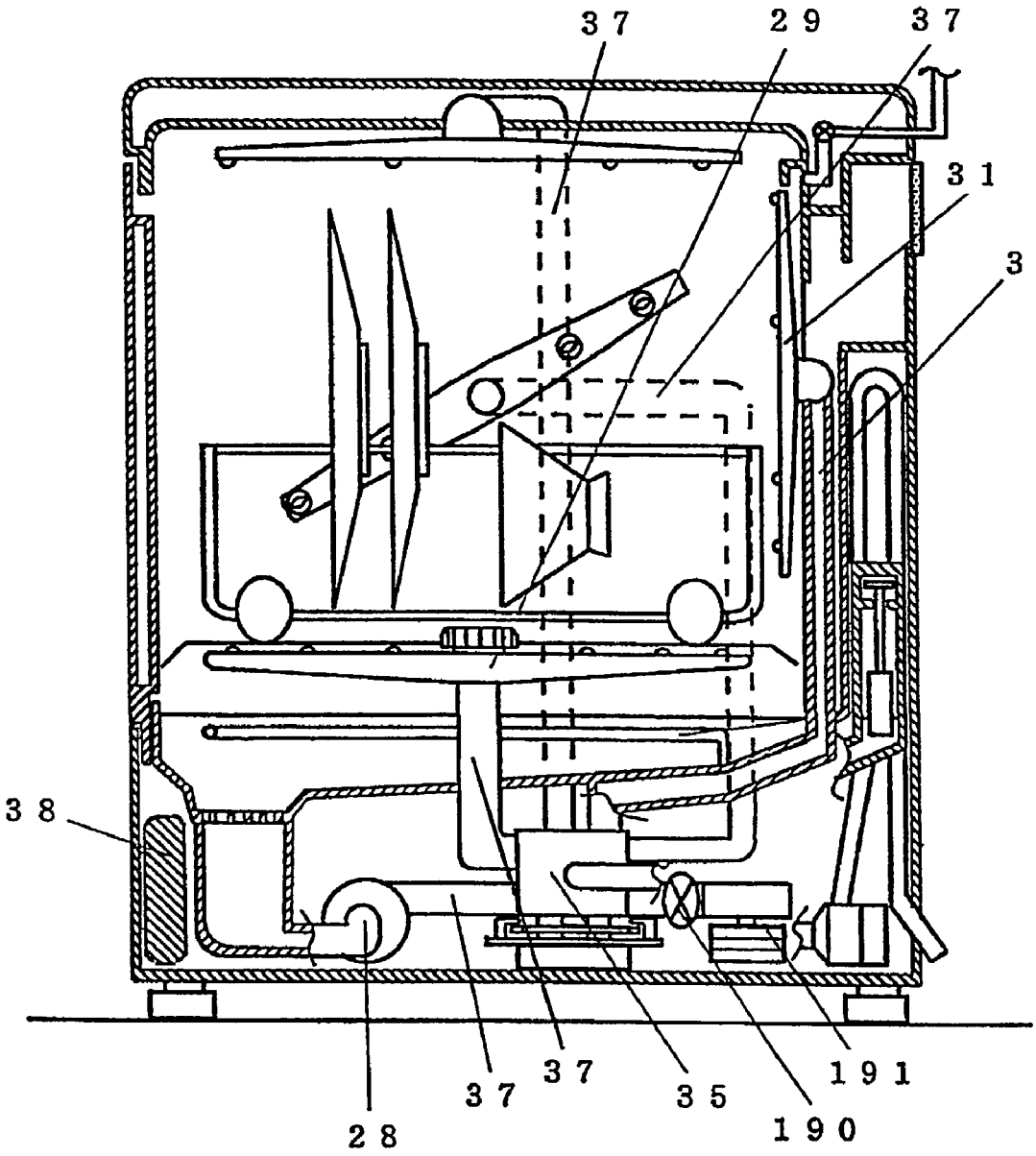
FIG. 42 is a sectional view of a dishwasher in accordance with exemplary embodiment 17 of the present invention.
Figure 43:
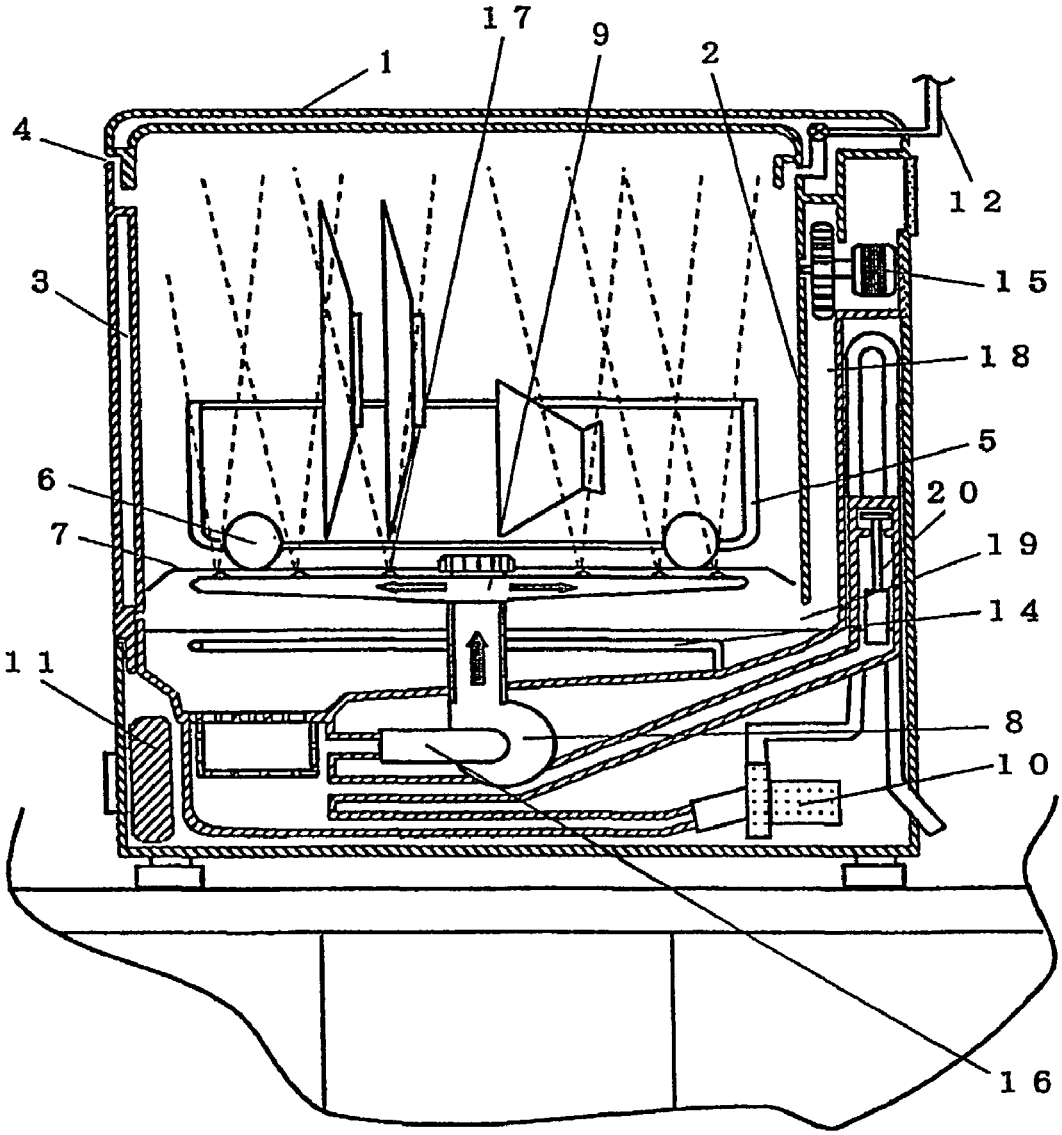
FIG. 43 is a block diagram of a conventional dishwasher.

FIG. 42 is a sectional view of a dishwasher in accordance with exemplary embodiment 17 of the present invention.

The washer of exemplary embodiment 17 differs from that of exemplary embodiment 1 in the following structure.

As shown in FIG. 42, fan 191 is disposed via open/close valve 190 in fluid communication with feeding/discharging passage 37 between washing pump 28 and water dividing structure 35.

Basic structures and functions for forming the water dividing structure are similar to those of exemplary embodiment 1. Elements of exemplary embodiment 17 similar to those in exemplary embodiment 1 have the same reference numbers, and descriptions of these elements is omitted.

Open/close valve 190 and fan 191 constitute a blowing device.

Open/close valve 190 is closed so as to prevent washing water in a washing passage from intruding into fan 191 during a washing operation. When drying air is intended to be jetted, open/close valve 190 is opened. At this time, the drying air is jetted to eating utensils sequentially from various washing nozzles via water dividing structure 35.

Thus, the air can be sequentially jetted from a plurality of washing nozzles in the structure of exemplary embodiment 17. The washing water containing dirt can be removed from the eating utensils during a draining operation of a rinsing process, so that rinsing performance improves. The drying air is efficiently jetted to the eating utensils during a drying process, so that drying performance improves. The air is jetted not simultaneously but sequentially from a plurality of washing devices, so that a small blowing device can be used. Specifically, when components are overlapped and accommodated in a rack in a component washer for washing the components, the drying air is jetted from various directions and therefore drying time can be extremely reduced.

Washing pump 28 may be used itself as the blowing device (not shown). Rotational speed of washing pump 28 is increased in this structure, thereby jetting high-pressure air to eating utensils.

Washing nozzles efficiently jet drying air to the eating utensils while rotating, so that soiled water can be widely removed during the rinsing process, rinsing performance is further improved, and speedy drying of the eating utensils is allowed. This structure requires no open/close valve, so that the structure can be realized more simply and at a low cost.

Exemplary Embodiment 18

Figure 12:
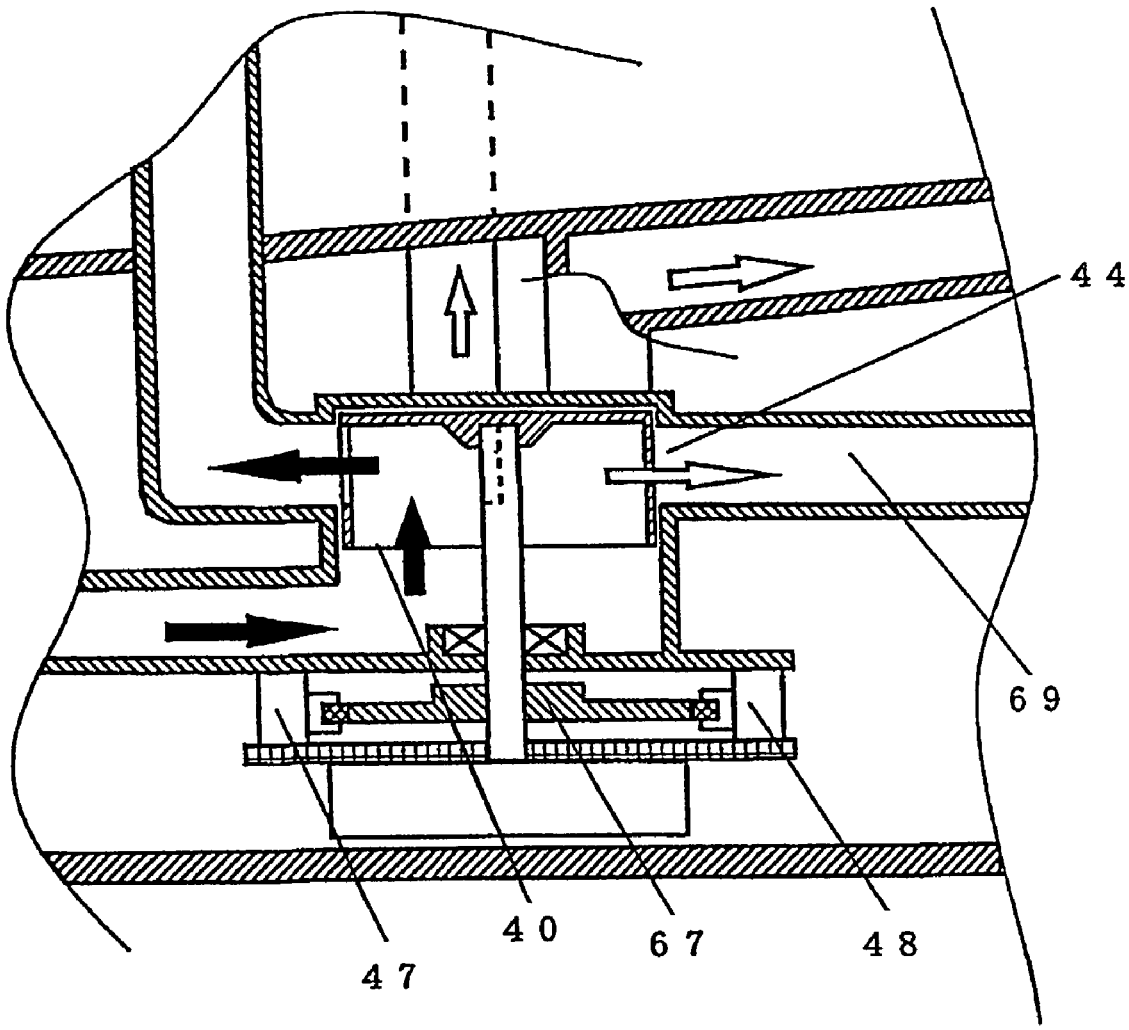
FIG. 12 is a fragmentary sectional view showing a water dividing structure and flow of washing water in the dishwasher in accordance with exemplary embodiment 18.

FIG. 11 is a sectional view of a dishwasher in accordance with exemplary embodiment 18 of the present invention. FIG. 11 is the same as the view of the dishwasher in accordance with exemplary embodiment 2 discussed above. FIG. 12 is a fragmentary sectional view showing a structure of a water dividing structure and flow of washing water in the dishwasher.

The washer of exemplary embodiment 18 differs from that of exemplary embodiment 1 in the following structure.

As shown in FIG. 11, one of feeding/discharging passages 37 is communicated with draining passage (functional device) 69. Another feeding/discharging passage 37 is communicated with garbage collecting filter (functional device, foreign matter collecting device) 120.

Elements of exemplary embodiment 18 similar to those in exemplary embodiment 1 have the same reference numbers, and the descriptions of these elements is omitted.

Operations and functions will be described hereinafter. The washer of embodiment 1 individually requires drain pump 33; however, in the washer of embodiment 18, washing pump 28 can function as a drain pump since one of feeding/discharging passages 37 communicates with draining passage 69. Rotary water dividing unit 40 in the washer is controlled so that discharge port 41 is not turned to feeding/discharging passages 37 communicating with draining passage 69 during a washing process but water is drained through draining passage 69 only during a draining process. When the washing water leaks from water dividing structure 35 to draining passage 69 during a washing operation, a drain open/close valve or a check valve (not shown) is disposed in feeding/discharging passages 37 between water dividing structure 35 and draining passage 69. Otherwise, a gap between discharge port 41 and divided water discharge port 44 is sealed. The following operation is also considered. During the washing operation, the rotary water dividing unit is continuously rotated in a constant direction, and the washing water is not drained out of the washer through the draining passage because of the open/close valve. During the draining, the discharge port in the rotary water dividing unit is operated so as to make the washing water flow to the draining passage.

One of feeding/discharging passages 37 communicates with garbage collecting filter (foreign matter collecting device) 120 for collecting garbage in the washing water. When rotary water dividing unit 40 continuously rotates in one direction, the soiled washing water is intermittently sprayed to garbage collecting filter 120 to collect dirt during the washing operation. By the completion of washing process and the rinsing process, dirt such as the garbage can be mostly collected by garbage collecting filter 120. Spray time for garbage collecting filter 120 can be extended by control of the rotary water dividing unit. The garbage can be certainly collected even during a short washing time. Additionally, the following method can be used: a method of forwardly and reversely rotating rotary water dividing unit 40 so as to prevent the washing water from being fed to feeding/discharging passages 37 for collecting garbage during a final rinsing process; or a method of rotating rotary water dividing unit 40 in one direction and installing the drain open/close valve (not shown) in feeding/discharging passages 37 between water dividing structure 35 and garbage collecting filter 120. Thus, the washing water does not flow through the garbage, but only fresh water is used for washing the eating utensils. The garbage is therefore prevented from re-adhering to the eating utensils. Thus, washed eating utensils are sanitary.

In embodiment 18, thus, without installing another new feeding/discharging passage, the washing water discharged by a washing water feeding device can be fed to a functional device such as a garbage collecting filter by accurately controlling washing flow quantity, spray time, and spray timing using a water dividing structure. A washing pump is used as a drain pump to downsize a mechanism unit and reduce cost. Discharge pressure of the washing pump can be used as a driving source for moving a movable unit such as an open/close valve disposed in the functional device, without requiring any solenoid valve or other driving source.

All elements in the garbage collecting structure and the drain structure do not need to be integrally formed, and each element may be independently formed. In embodiment 18, washing nozzles are disposed at tops of feeding/discharging passages and one of the feeding/discharging passages is provided not with a washing nozzle but rather the garbage collecting filter, or the washing pump communicating with the draining passage is used as the drain pump. However, the present invention is not limited to this. As a functional device, a detergent throwing apparatus, a detergent dissolving apparatus, a water softener, an ion generating apparatus using acid or alkali, or a clarifying apparatus can be used. When the drying air generated by the blowing device is used as the functional device as shown in embodiment 17, for example, the drying air may be used as a driving source for opening or closing a lid of an exhaust port. The drying air is also used as cooling air for dehumidifying and drying, or as drawing-in air for introducing outside air.

INDUSTRIAL APPLICABILITY

A washer structure of the present invention allows spray of washing water to any objects to be washed from a plurality of directions without increasing fed water. High efficient washing allowing shorter washing can be realized. The number of rinsings is decreased, energy consumption is reduced, and also water consumption is reduced. The objects to be washed can be easily set at setting positions in a rack, and therefore a washer having high setting ability can be obtained.

The invention claimed is:

1. A washer comprising:

washing devices for sequentially spraying washing water from various directions to an object to be washed, each of said washing devices having a spray port from which the washing water is to be sprayed;

a washing water feeding device for feeding the washing water to said washing devices;

a controller for controlling an operation of said washing water feeding device;

at least one rack for holding the object to be washed;

a washing tub for accommodating said at least one rack, said washing tub having an opening;

a cover for opening or closing the opening of said washing tub;

feeding/discharging passages for feeding/discharging the washing water and for coupling said washing water feeding device with said washing devices, respectively; and a water dividing structure including (i) a rotary water dividing unit having a wall defining a hollow interior, and plural discharge ports in said wall and communicating with said hollow interior, with at least one of said plural discharge ports being in a portion of said wall that is substantially orthogonal to a rotational axis of said rotary water dividing unit, and (ii) a driving device for rotating said rotary water dividing unit about the rotational axis, wherein said water dividing structure is for allowing the washing water to be sequentially fed to each of said washing devices by allowing the washing water, when fed by said washing water feeding device, to enter into said hollow interior and then be discharged from said plural discharge ports into said feeding/discharging passages upon rotation of said rotary water dividing unit, and wherein, of said washing devices, at least one is disposed in a lower part of said washing tub, at least one is disposed in an upper part of said washing tub, and at least one is disposed on a back face of said washing tub.

2. The washer according to claim 1, wherein said water dividing structure further includes (iii) an aqueduct for guiding the washing water, when pressurized by said washing water feeding device, into said hollow interior, and (iv) a divided water output unit having divided water discharge ports, said feeding/discharging passages being coupled to said divided water discharge ports, respectively, with said rotary water dividing unit being rotatably disposed at a position facing said divided water output unit, and with said plural discharge ports and said divided water discharge ports being arranged so that, during rotation of said rotary water dividing unit, said plural discharge ports sequentially faces said divided water discharge ports to feed the washing water from said hollow interior, after being guided thereinto by said aqueduct, through said plural discharge ports sequentially to said feeding/discharging passages, such that the washing water is guided to each of said washing devices and is sprayed from each of said washing devices.

3. The washer according to claim 2, wherein said driving device is to control said rotary water dividing unit such that said plural discharge ports face said divided water discharge ports during a process of feeding the washing water to said washing tub.

4. The washer according to claim 2, wherein said driving device is to control said rotary water dividing unit such that said plural discharge ports face said divided water discharge ports during a process of draining the washing water.

5. The washer according to claim 1, wherein said wall includes a substantially cylindrical portion, with said plural discharge ports other than said at least one of said plural discharge ports being in said substantially cylindrical portion, and with said plural discharge ports being arranged so that the washing water discharged from said plural discharge ports is sprayed simultaneously from at least two of said washing devices, and the washing water is sprayed sequentially by said washing devices.

6. The washer according to claim 1, wherein said driving device is for setting any rotational speed of said rotary water dividing unit, and said rotary water dividing unit is designed to rotate at any rotational speed set by said driving device.

7. The washer according to claim 1, wherein said driving device has a rotational angle detecting mechanism for detecting a rotational angle of said rotary water dividing unit.

8. The washer according to claim 1, wherein said driving device is for forwardly and reversely rotating said rotary water dividing unit.

9. The washer according to claim 1, wherein said wall comprises a substantially cylindrical wall, with said plural discharge ports other than said at least one of said plural discharge ports being in said substantially cylindrical wall so that respective rotation tracks of said plural discharge ports other than said at least one of said plural discharge ports are different from each other.

10. The washer according to claim 1, wherein said rotary water dividing unit has a horizontally disposed rotatable shaft.

11. The washer according to claim 1, wherein said washing water feeding device comprises a washing pump having a washing pump discharge port, and said driving device has a driving shaft, with said driving shaft being disposed in a substantially identical direction relative to a flow direction of the washing water when discharged from said washing pump discharge port, and with said driving device being disposed on an a side of said rotary water dividing unit that is opposite to a side of said rotary water dividing unit on which is disposed said washing pump discharge port.

12. The washer according to claim 1, further comprising:

divided water discharge ports coupled to said feeding/discharging passages, respectively, wherein a circumferential length of at least one of said plural discharge ports is substantially equal to or longer than a circular arc length between respective openings of adjacent said divided water discharge ports.

13. The washer according to claim 1, further comprising:

divided water discharge ports coupled to said feeding/discharging passages, respectively, wherein a circumferential length of at least one of said plural discharge ports is substantially equal to or longer than a sum of a circular arc length of any of said divided water discharge ports and a circular arc length between respective openings of adjacent said divided water discharge ports.

14. The washer according to claim 1, wherein said controller is for controlling the operation of said washer water feeding device so as to spray the washing water from any one of said washing devices.

15. The washer according to claim 14, wherein said water dividing structure further comprises a rotational position detecting mechanism, and said controller is for controlling the operation of said washer water feeding device so as to spray the washing water from one of a substantially upper part and a substantially side part of said washing tub during completion of at least any rinsing process of a washing procedure.

16. The washer according to claim 14, wherein said water dividing structure is for controlling a feeding time of the washing water to each of said washing devices, and said controller is for controlling the operation of said washer water feeding device so that a spray time of each of said washing devices is set to a predetermined time.

17. The washer according to claim 14, wherein said controller is for controlling the operation of said washer water feeding device so that a first spray time of each of said washing devices during a primary washing process is longer than a second spray time of each of said washing devices during a rinsing process.

18. The washer according to claim 14, wherein said water dividing structure is to feed the washing water to a specific one of said washing devices, and said controller is for controlling the operation of said washer water feeding device so that the washing water is selectively sprayed to the object to be washed accommodated in a partial region of said at least one rack.

19. The washer according to claim 18, wherein said controller is for controlling the operation of said washing water feeding device such that during any washing process the washing water is sequentially sprayed from all of said washing devices.

20. The washer according to claim 14, wherein said at least one rack comprises plural racks, the object to be washed comprises eating utensils having substantially similar shapes, and said plural racks are constructed and arranged to have placed therein the eating utensils.

21. The washer according to claim 20, wherein said controller is for controlling the operation of said washing water feeding device such that during any washing process the washing water is sequentially sprayed from all of said washing devices.

22. The washer according to claim 1 further comprising a functional device, wherein at least one of said feeding/discharging passages communicates with said functional device.

23. The washer according to claim 22, wherein said functional device has a foreign matter collecting mechanism for collecting foreign matter contained in the washing water.

24. The washer according to claim 1 further comprising a draining passage for draining the washing water from said washing tub, wherein one of said feeding/discharging passages communicates with said draining passage.

25. The washer according to claim 1, wherein said washing water feeding device is vertically disposed.

26. The washer according to claim 1 wherein said water dividing structure is disposed between said washing water feeding device and said washing devices, said water dividing structure further includes a divided water output unit having divided water discharge ports, said washing devices communicate with said divided water discharge ports, respectively, via said feeding/discharging passages, and said divided water output unit is associated with said rotary water dividing unit so that said plural discharge ports other than said at least one of said plural discharge ports sequentially faces and communicates with all but at least one of said divided water discharge ports, and said at least one of said plural discharge ports communicates with said all but at least one of said divided water discharge ports, when said rotary water dividing unit rotates such that upon rotation of said rotary water dividing unit, after the washing water enters said hollow interior, the washing water is discharged from said plural discharge ports into said feeding/discharging passages through said divided water discharge ports, respectively.

27. The washer according to claim 1, wherein said driving device is to rotate said rotary water dividing unit during a process of feeding the washing water to said washing tub.

28. The washer according to claim 1, wherein said driving device is to rotate said rotary water dividing unit during a process of draining the washing water.

29. The washer according to claim 1, wherein said controller is for controlling the operation of said washer water feeding device so as to spray the washing water from any one of said washing devices.

30. The washer according to claim 1, wherein at least one of said washing devices is for spraying the washing water while said at least one of said washing devices is turning.

31. A washer comprising:

washing devices for sequentially spraying washing water from various directions to an object to be washed, each of said washing devices having a spray port from which the washing water is to be sprayed;

a washing water feeding device for feeding the washing water to said washing devices, said washing water feeding device having a washing water feeding device discharge port;

a controller for controlling an operation of said washing water feeding device;

at least one rack for holding the object to be washed;

a washing tub for accommodating said at least one rack, said washing tub having an opening;

a cover for opening or closing the opening of said washing tub;

feeding/discharging passages for feeding/discharging the washing water and for coupling said washing water feeding device with said washing devices, respectively; and a water dividing structure having a driving device and a divided water output unit, said divided water output unit having plural divided water discharge ports, and said water dividing structure for allowing the washing water to be sequentially fed to each of said washing devices, wherein at least one of said plural divided water discharge ports is formed at a position higher than that of said washing water feeding device discharge port, wherein, of said washing devices, at least one is disposed in a lower part of said washing tub, at least one is disposed in an upper part of said washing tub, and at least one is disposed on a back face of said washing tub, and wherein at least one of said plural divided water discharge ports is in a portion of a wall that is substantially orthogonal to an axis of said divided water output unit.

32. A washer comprising:

washing devices for sequentially spraying washing water from various directions to an object to be washed, each of said washing devices having a spray port from which the washing water is to be sprayed;

a washing water feeding device for feeding the washing water to said washing devices;

a controller for controlling an operation of said washing water feeding device;

at least one rack for holding the object to be washed;

a washing tub for accommodating said at least one rack, said washing tub having an opening;

a cover for opening or closing the opening of said washing tub;

feeding/discharging passages for feeding/discharging the washing water and for coupling said washing water feeding device with said washing devices, respectively; and a water dividing structure including (i) a changeover unit having a rotary water dividing unit with a discharge port, (ii) a driving device for rotating said rotary water dividing unit, and (iii) a divided water output unit having divided water discharge ports, with a cross sectional area of at least a first of said divided water discharge ports and a passage cross sectional area of a first of said feeding/discharging passages communicating with said first of said divided water discharge ports each being larger than an opening area of said discharge port, wherein said rotary water dividing unit faces said divided water output unit and said discharge port and said divided water discharge ports are arranged so that, during rotation of said rotary water dividing unit, said discharge port sequentially faces said divided water discharge ports to feed the washing water, when pressurized by said washing water feeding device, from said rotary water dividing unit sequentially to said divided water discharge ports such that the washing water is fed sequentially to each of said feeding/discharging passages, is guided to each of said washing devices, and is sprayed from each of said washing devices, and wherein, of said washing devices, at least one is disposed in a lower part of said washing tub, at least one is disposed in an upper part of said washing tub, and at least one is disposed on a back face of said washing tub.

33. The washer according to claim 32, wherein an opening of said first of said divided water discharge ports has a rectangular or substantially elliptical shape that is circumferentially longer than a shape of an opening of said discharge port.

34. The washer according to claim 33, wherein said first of said feeding/discharging passages comprises a first passage that changes in cross sectional area from that of said first of said divided water discharge ports to that of a second of said feeding/discharging passages, and a second passage having a cross sectional area that is substantially identical to a passage cross sectional area of a second of said divided water discharge ports.

35. The washer according to claim 32, wherein said water dividing structure further includes an aqueduct for guiding the washing water, when pressurized by said washing water feeding device, to said changeover unit.

36. A washer comprising:

washing devices for sequentially spraying washing water from various directions to an object to be washed, each of said washing devices having a spray port from which the washing water is to be sprayed;

a washing water feeding device for feeding the washing water to said washing devices;

a controller for controlling an operation of said washing water feeding device;

at least one rack for holding the object to be washed;

a washing tub for accommodating said at least one rack, said washing tub having an opening;

a cover for opening or closing the opening of said washing tub;

feeding/discharging passages for feeding/discharging the washing water and for coupling said washing water feeding device with said washing devices, respectively; and a water dividing structure including (i) a changeover unit having a rotary water dividing unit with discharge ports, with at least one of said discharge ports being in a portion of said rotary water dividing unit that is substantially orthogonal to a rotational axis of said rotary water dividing unit, (ii) a driving device for rotating said rotary water dividing unit, and (iii) a divided water output unit having divided water discharge ports, wherein at least one of said plural divided water discharge ports is in a portion of a wall that is substantially orthogonal to an axis of said divided water output unit, with said rotary water dividing unit and said divided water output unit being disposed so as to prevent all of said discharge ports from simultaneously communicating with said divided water discharge ports during rotation of said rotary water dividing unit, wherein said rotary water dividing unit faces said divided water output unit and said discharge ports and said divided water discharge ports are arranged so that, during rotation of said rotary water dividing unit, said discharge ports sequentially face said divided water discharge ports to feed the washing water, when pressurized by said washing water feeding device, from said rotary water dividing unit sequentially to said divided water discharge ports such that the washing water is fed sequentially to each of said feeding/discharging passages, is guided to each of said washing devices, and is sprayed from each of said washing devices, and wherein, of said washing devices, at least one is disposed in a lower part of said washing tub, at least one is disposed in an upper part of said washing tub, and at least one is disposed on a back face of said washing tub.

37. The washer according to claim 36, wherein an opening of at least one of said discharge ports has a rectangular or substantially elliptical shape that is circumferentially longer than shapes of the openings of the other of said discharge ports.

38. The washer according to claim 36, wherein said discharge ports and said divided water discharge ports are formed in said rotary water dividing unit and said divided water output unit, respectively, so that the washing water is always to be discharged from one of said washing devices.

39. The washer according to claim 36, wherein an opening of at least a first of said divided water discharge ports has a rectangular or substantially elliptical shape that is circumferentially longer than shapes of openings of the other of said divided water discharge ports, and a first of said feeding/discharging passages communicating with a first of said divided water discharge ports has a cross sectional area larger than cross sectional areas of the other of said feeding/discharging passages.

40. The washer according to claim 36, wherein said water dividing structure further includes an aqueduct for guiding the washing water, when pressurized by said washing water feeding device, to said changeover unit.

41. A washer comprising:

washing devices for sequentially spraying washing water from various directions to an object to be washed, each of said washing devices having a spray port from which the washing water is to be sprayed;

a washing water feeding device for feeding the washing water to said washing devices;

a controller for controlling an operation of said washing water feeding device;

at least one rack for holding the object to be washed;

a washing tub for accommodating said at least one rack, said washing tub having an opening;

a cover for opening or closing the opening of said washing tub;

feeding/discharging passages for feeding/discharging the washing water and for coupling said washing water feeding device with said washing devices, respectively; and a water dividing structure including (i) a changeover unit having a rotary water dividing unit with discharge ports, (ii) a driving device for rotating said rotary water dividing unit, and (iii) a divided water output unit having divided water discharge ports, with said rotary water dividing unit and said divided water output unit being disposed so as to prevent all of said discharge ports from simultaneously communicating with said divided water discharge ports during rotation of said rotary water dividing unit, wherein said rotary water dividing unit faces said divided water output unit and said discharge ports and said divided water discharge ports are arranged so that, during rotation of said rotary water dividing unit, said discharge ports sequentially face said divided water discharge ports to feed the washing water, when pressurized by said washing water feeding device, from said rotary water dividing unit sequentially to said divided water discharge ports such that the washing water is fed sequentially to each of said feeding/discharging passages, is guided to each of said washing devices, and is sprayed from each of said washing devices, wherein, of said washing devices, at least one is disposed in a lower part of said washing tub, at least one is disposed in an upper part of said washing tub, and at least one is disposed on a back face of said washing tub, and wherein said divided water output unit includes a passage varying device for varying passage cross sections of said feeding/discharging passages.

42. A washer comprising:

washing devices for sequentially spraying washing water from various directions to an object to be washed, each of said washing devices having a spray port from which the washing water is to be sprayed;

a washing water feeding device for feeding the washing water to said washing devices;

a controller for controlling an operation of said washing water feeding device;

at least one rack for holding the object to be washed;

a washing tub for accommodating said at least one rack, said washing tub having an opening;

a cover for opening or closing the opening of said washing tub;

feeding/discharging passages for feeding/discharging the washing water and for coupling said washing water feeding device with said washing devices, respectively;

a water dividing structure having a driving device, said water dividing structure for allowing the washing water to be sequentially fed to each of said washing devices; and a blowing device for feeding air, wherein said blowing device has a fan and an open/close valve, said open/close valve is for switching between the washing water and the air, and said blowing device is constructed and arranged to feed the air sequentially from said plurality of washing devices after switching of said open/close valve, and wherein, of said washing devices, at least one is disposed in a lower part of said washing tub, at least one is disposed in an upper part of said washing tub, and at least one is disposed on a back face of said washing tub.

43. The washer according to claim 42, wherein said washing water feeding device has a pump, said pump is for feeding the washing water and feeding the air, and said pump is for feeding the air after switching of the open/close valve.

44. The washer according to claim 42, wherein said water dividing structure further has (i) a rotary water dividing unit having at least one discharge port, (ii) a divided water output unit having divided water discharge ports, with said feeding/discharging passages being coupled to said divided water discharge ports, respectively, and (ii) an aqueduct for guiding the washing water, when pressurized by said washing water feeding device, to said rotary water dividing unit, with said rotary water dividing unit being rotatably disposed at a position facing said divided water output unit and said at least one discharge port and said divided water discharge ports being arranged so that, during rotation of said rotary water dividing unit, said at least one discharge port sequentially faces said divided water discharge ports to feed the washing water, after having been guided by said aqueduct to said rotary water dividing unit, through said at least one discharge port sequentially to said feeding/discharging passages, such that the washing water is guided to each of said washing devices and is sprayed from each of said washing devices.

* * * * *